US010132558B2

(12) United States Patent
Eveland et al.

(10) Patent No.: US 10,132,558 B2
(45) **Date of Patent: *Nov. 20, 2018**

(54) REFRIGERATOR WITH EASY ACCESS DRAWER

(71) Applicant: WHIRLPOOL CORPORATION, Benton Harbor, MI (US)

(72) Inventors: Michael J. Eveland, Cedar Rapids, IA (US); Steven G. Herndon, Cedar Rapids, IA (US); Todd E. Kniffen, Williamsburg, IA (US); Bill J. Koons, Williamsburg, IA (US)

(73) Assignee: Whirlpool Coporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/884,571

(22) Filed: Jan. 31, 2018

(65) Prior Publication Data

US 2018/0149419 A1 May 31, 2018

Related U.S. Application Data

(63) Continuation of application No. 15/361,648, filed on Nov. 28, 2016, which is a continuation of application (Continued)

(51) Int. Cl.

*F25D 11/02* (2006.01)
*F25D 25/02* (2006.01)

(Continued)

(52) U.S. Cl.

CPC ..... *F25D 25/025* (2013.01); *F25C 5/182* (2013.01); *F25C 5/22* (2018.01); *F25D 11/02* (2013.01);

(Continued)

(58) Field of Classification Search

CPC ..... F25C 5/005; F25D 11/02; F25D 17/065; F25D 25/025; F25D 27/005; F25D 2317/061; F25D 2325/022

See application file for complete search history.

(56) References Cited

U.S. PATENT DOCUMENTS 1,017,197 A 2/1912 Barnes
1,064,314 A 6/1913 German (Continued)

FOREIGN PATENT DOCUMENTS

EP 716278 A1 3/2000
EP 715136 A1 12/2001

(Continued)

*Primary Examiner* — Jonathan Bradford

(74) *Attorney, Agent, or Firm* — Nyemaster Goode, P.C.

(57) ABSTRACT

A bottom mount refrigerator is provided with a pantry compartment that is accessible from outside the refrigerator by pulling open an easy access pantry drawer without the need to first open the fresh food compartment or the freezer compartment. A divider between the pantry compartment and the fresh food compartment is formed by a secondary mullion and a transparent shelf. The secondary mullion is provided with a light source for illuminating the contents of the pantry drawer. A light source at the rear of the pantry compartment shines generally forwardly and upwardly to illuminate the fresh food compartment.

20 Claims, 53 Drawing Sheets

Related U.S. Application Data

No. 14/603,557, filed on Jan. 23, 2015, now Pat. No. 9,534,825, which is a continuation of application No. 12/427,032, filed on Apr. 21, 2009, now Pat. No. 8,966,926.

(60) Provisional application No. 61/051,364, filed on May 8, 2008.

(51) Int. Cl.

| | |
|---|---|
| ***F25D 17/06*** | (2006.01) |
| ***F25D 27/00*** | (2006.01) |
| ***F25C 5/182*** | (2018.01) |
| ***F25D 17/04*** | (2006.01) |
| ***F25D 23/06*** | (2006.01) |
| ***F25D 29/00*** | (2006.01) |
| ***F25C 5/20*** | (2018.01) |
| *F25B 21/02* | (2006.01) |
| *F25D 23/02* | (2006.01) |

(52) U.S. Cl.

CPC ..... *F25D 17/045* (2013.01); *F25D 17/065* (2013.01); *F25D 23/028* (2013.01); *F25D 23/066* (2013.01); *F25D 27/00* (2013.01); *F25D 27/005* (2013.01); *F25D 29/00* (2013.01); *F25B 21/02* (2013.01); *F25D 23/021* (2013.01); *F25D 2317/061* (2013.01); *F25D 2317/0661* (2013.01); *F25D 2323/021* (2013.01); *F25D 2325/022* (2013.01); *F25D 2400/04* (2013.01); *F25D 2500/02* (2013.01); *F25D 2600/04* (2013.01); *F25D 2700/121* (2013.01)

(56) References Cited

U.S. PATENT DOCUMENTS

| | | | |
|---|---|---|---|
| 1,377,411 | A | 5/1921 | Douglas |
| 1,377,455 | A | 5/1921 | Beidler |
| 1,604,621 | A | 10/1926 | Wallace |
| 2,064,926 | A | 12/1936 | Kuebler |
| 2,765,633 | A | 10/1956 | Muffly |
| 2,779,165 | A | 1/1957 | Pichler et al. |
| 3,025,679 | A | 3/1962 | Keighley |
| 3,122,005 | A | 2/1964 | Costantini et al. |
| 3,146,606 | A | 9/1964 | Grimes et al. |
| 3,151,472 | A | 10/1964 | Harle et al. |
| 3,226,939 | A | 1/1966 | Harbison et al. |
| 3,308,631 | A | 3/1967 | Kniffin |
| 3,350,899 | A | 11/1967 | Jones et al. |
| 3,359,751 | A | 12/1967 | Stevens |
| 3,440,308 | A | 4/1969 | Carbary |
| 3,561,231 | A | 2/1971 | Webb |
| 3,633,374 | A | 1/1972 | Canter |
| 3,640,088 | A | 2/1972 | Simms et al. |
| 3,745,779 | A | 7/1973 | Bright |
| 3,775,994 | A | 12/1973 | Linstromberg et al. |
| 3,789,620 | A | 2/1974 | Benasutti et al. |
| 3,834,177 | A | 9/1974 | Scarlett |
| 3,866,434 | A | 2/1975 | Pugh et al. |
| 3,889,888 | A | 6/1975 | Prada |
| 3,902,331 | A | 9/1975 | True et al. |
| 3,911,692 | A | 10/1975 | Maxwell et al. |
| 3,972,204 | A | 8/1976 | Sidorenko et al. |
| 4,007,600 | A | 2/1977 | Simms et al. |
| 4,020,644 | A | 5/1977 | True, Jr. et al. |
| 4,084,725 | A | 4/1978 | Buchser |
| 4,087,140 | A | 5/1978 | Linstromberg |
| 4,118,451 | A | 10/1978 | Schaus et al. |
| 4,142,373 | A | 3/1979 | Weibel, Jr. et al. |
| 4,142,377 | A | 3/1979 | Fogt et al. |
| 4,142,378 | A | 3/1979 | Bright et al. |
| 4,250,923 | A | 2/1981 | Johnson |
| 4,280,682 | A | 7/1981 | Zukausky |
| 4,332,146 | A | 6/1982 | Yamazaki et al. |
| 4,614,088 | A | 9/1986 | Brooks |
| 4,662,186 | A | 5/1987 | Park et al. |
| 4,732,009 | A | 3/1988 | Frohbieter et al. |
| 4,835,978 | A | 6/1989 | Cole |
| 4,838,026 | A | 6/1989 | Searl et al. |
| 4,889,316 | A | 12/1989 | Donahue, Jr. |
| 4,922,725 | A | 5/1990 | Rasmussen |
| 4,970,871 | A | 11/1990 | Rudick |
| 4,997,109 | A | 3/1991 | Carper |
| 5,033,636 | A | 7/1991 | Jenkins |
| 5,037,004 | A | 8/1991 | Katz |
| 5,056,688 | A | 10/1991 | Goetz |
| 5,117,654 | A | 6/1992 | Steffenhagen |
| 5,157,940 | A | 10/1992 | Bertu et al. |
| 5,198,244 | A | 3/1993 | Rice et al. |
| 5,211,462 | A | 5/1993 | Bien et al. |
| 5,212,955 | A | 5/1993 | Hogan et al. |
| 5,261,248 | A | 11/1993 | Willis et al. |
| 5,273,219 | A | 12/1993 | Beach, Jr. et al. |
| 5,310,090 | A | 5/1994 | Taylor |
| 5,327,856 | A | 7/1994 | Schroeder et al. |
| 5,355,686 | A | 10/1994 | Weiss et al. |
| 5,375,432 | A | 12/1994 | Cur et al. |
| 5,542,264 | A | 8/1996 | Hortin |
| 5,596,182 | A | 1/1997 | Edwards et al. |
| 5,729,997 | A | 3/1998 | Witsoe et al. |
| 5,758,512 | A | 6/1998 | Peterson et al. |
| 5,810,331 | A | 9/1998 | Smock et al. |
| 5,816,060 | A | 10/1998 | Brownell et al. |
| 5,823,001 | A | 10/1998 | Patrick et al. |
| 5,834,126 | A | 11/1998 | Sheu |
| 5,849,227 | A | 12/1998 | Chikugo et al. |
| 5,899,083 | A | 5/1999 | Peterson et al. |
| 5,947,342 | A | 9/1999 | Song et al. |
| 5,992,167 | A | 11/1999 | Hill et al. |
| 6,050,097 | A | 4/2000 | Nelson et al. |
| 6,053,472 | A | 4/2000 | DeLand |
| 6,062,826 | A | 5/2000 | Morimoto et al. |
| 6,148,620 | A | 11/2000 | Kumagai et al. |
| 6,351,967 | B1 | 3/2002 | Adachi et al. |
| 6,438,976 | B2 | 8/2002 | Shapiro et al. |
| 6,442,954 | B1 | 9/2002 | Shapiro et al. |
| 6,497,113 | B1 | 12/2002 | Yamada et al. |
| 6,547,349 | B2 | 4/2003 | Sessa et al. |
| 6,574,974 | B1 | 6/2003 | Herzog et al. |
| 6,604,377 | B2 | 8/2003 | Watanabe et al. |
| 6,629,429 | B1 | 10/2003 | Kawamura et al. |
| 6,655,166 | B1 | 12/2003 | Williams |
| 6,708,726 | B2 | 3/2004 | Hashimoto |
| 6,716,099 | B2 | 4/2004 | Pfleiderer et al. |
| 6,735,959 | B1 | 5/2004 | Najewicz |
| 6,755,166 | B2 | 6/2004 | Chang et al. |
| 6,880,355 | B2 | 4/2005 | Jung |
| 6,880,949 | B2 | 4/2005 | Miozza et al. |
| 6,964,177 | B2 | 11/2005 | Lee et al. |
| 7,065,975 | B1 | 6/2006 | Herndon et al. |
| 7,076,967 | B2 | 7/2006 | Lee et al. |
| 7,188,479 | B2 | 3/2007 | Anselmino et al. |
| 7,222,497 | B2 | 5/2007 | An et al. |
| 7,222,498 | B2 | 5/2007 | Lee et al. |
| 7,228,701 | B2 | 6/2007 | Kim |
| 7,266,957 | B2 | 9/2007 | Anderson et al. |
| 7,284,390 | B2 | 10/2007 | Van Meter et al. |
| 7,475,562 | B2 | 1/2009 | Jackovin |
| 7,784,888 | B2 | 8/2010 | Oh et al. |
| 7,971,443 | B2 | 7/2011 | Nishita et al. |
| 8,201,977 | B2 | 6/2012 | Thomas et al. |
| 2001/0025505 | A1 | 10/2001 | Nelson et al. |
| 2003/0126881 | A1 | 7/2003 | Lee et al. |
| 2004/0148957 | A1 | 8/2004 | Pohl et al. |
| 2005/0061016 | A1 | 3/2005 | Lee et al. |
| 2006/0090496 | A1 | 5/2006 | Adamski et al. |
| 2006/0260347 | A1 | 11/2006 | Coulter et al. |
| 2007/0074527 | A1 | 4/2007 | Lee et al. |
| 2007/0095080 | A1 | 5/2007 | An et al. |

(56) References Cited

U.S. PATENT DOCUMENTS

| | | | |
|---|---|---|---|
| 2007/0103940 | A1 | 5/2007 | Chung |
| 2007/0109764 | A1 | 5/2007 | Bienick |
| 2008/0168792 | A1 | 7/2008 | Tunzi |

FOREIGN PATENT DOCUMENTS

| | | | |
|---|---|---|---|
| EP | 1482263 | A2 | 12/2004 |
| EP | 1517103 | A2 | 3/2005 |
| EP | 1519131 | A1 | 3/2005 |
| JP | 50069644 | A | 6/1975 |
| JP | 50069644 | U | 6/1975 |
| JP | 04124570 | A | 4/1992 |
| JP | 06011228 | A | 1/1994 |
| JP | 2000065458 | A | 3/2000 |
| WO | 03102481 | A1 | 12/2003 |
| WO | 2004085937 | A1 | 10/2004 |

REFRIGERATOR WITH EASY ACCESS DRAWER

CROSS-REFERENCE TO RELATED APPLICATIONS

This application is a Continuation Application of and claims priority to U.S. patent application Ser. No. 15/361,648, filed Nov. 28, 2016, entitled "REFRIGERATOR WITH EASY ACCESS DRAWER," pending, which is a Continuation Application of and claims priority to U.S. patent application Ser. No. 14/603,557, filed Jan. 23, 2015, entitled "REFRIGERATOR WITH EASY ACCESS DRAWER," now issued as U.S. Pat. No. 9,534,825, which is a Continuation Application of and claims priority to U.S. patent application Ser. No. 12/427,032 filed Apr. 21, 2009, entitled "REFRIGERATOR WITH EASY ACCESS DRAWER," now issued as U.S. Pat. No. 8,966,926, which claims priority from U.S. Provisional Application No. 61/051,364 filed on May 8, 2008, entitled "APPARATUS AND METHOD FOR DISPENSING ICE FROM A BOTTOM MOUNT REFRIGERATOR WITH EASY ACCESS DRAWERS," the disclosures of which are hereby incorporated by reference in their entireties.

TECHNICAL FIELD

This invention relates generally to a consumer-type refrigerator, and more particularly to a bottom mount refrigerator in combination with at least one easily accessible refrigerated compartment drawer.

BACKGROUND OF THE INVENTION

Consumer refrigerators such as might be found in a household typically include a fresh food compartment and a freezer compartment. The refrigerator is provided with an evaporator for maintaining the fresh food compartment at a temperature range of about 32-40 degrees Fahrenheit. The same or an additional evaporator may be used to maintain the freezer compartment below freezing, usually near 0 degrees Fahrenheit.

Traditionally, the freezer compartment has been provided above the fresh food compartment in a so-called top mount refrigerator. The freezer compartment may also be located side-by-side with the fresh food compartment. A bottom mount refrigerator is one in which the freezer compartment is mounted below the fresh food compartment. These bottom mount refrigerators are popular because they provide easier access to the fresh food compartment, and provide relatively wider storage space than the freezer section of a similarly sized side-by-side model.

Ice makers are commonly provided within the freezer compartments of consumer refrigerators to automatically make ice. These ice makers are attached to a water line to provide fresh water to make ice. A sensing mechanism is provided to determine when the supply needs to be replenished and more ice made. There are numerous well-known structures for making and storing ice in the freezer compartment of a consumer refrigerator.

A popular feature on consumer refrigerators that include automatic ice makers, especially side-by-side models, is ice dispensing through the freezer door. According to this feature, a user can obtain ice without opening the door to the freezer compartment. A passage, cavity, or the like is provided through the door to the freezer, and ice can be automatically dispensed from the ice maker in the freezer compartment through the freezer door. Preferably the ice is dispensed at a convenient height for a user. Bottom mount refrigerators have presented a unique challenge because the freezer compartment is located lower than desired for an ice dispensing location. If the ice is formed in the bottom mount freezer compartment, it is necessary to lift the ice to dispense it at a comfortable dispensing height. Heretofore, this has not been practical.

In addition, many current refrigerators offer vegetable or meat storage in select areas within the refrigerator compartment. These storage areas are commonly known as crisper drawers and are internal drawers which can only be accessed if the fresh food compartment door is already open. Some refrigerators have begun to include a full width pantry or crisper drawer which is also an internal storage compartment which can only be accessed if the fresh food compartment door is already open.

Many bottom mount refrigerators include two fresh food compartment doors that open in a French-door style. In this French-door style of bottom mount refrigerator, a user must open both doors to access an internal full-width pantry or crisper drawer. This not only complicates access to the internal pantry or crisper drawer, but also requires exposing the entirety of the fresh food compartment to warmer external conditions when the only access needed is to the internal pantry or crisper drawer. Additionally, if the fresh food compartment doors cannot be opened fully, access to the internal pantry or crisper drawer may be limited.

SUMMARY OF THE INVENTION

According to one embodiment, the present invention is directed to a bottom mount refrigerator that includes a freezer compartment, a fresh food compartment located above the freezer compartment, a door for the fresh food compartment, an ice dispenser for dispensing ice through the door, and a pantry drawer located above the freezer compartment. The pantry drawer is accessible without opening the door for fresh food compartment. The pantry drawer may be separated from the fresh food compartment by a divider that includes a transparent shelf. The pantry drawer may be maintained at a temperature for storing fresh fruits and vegetables. A top edge of pantry drawer may be positioned at a height to match a stand height kitchen counter. Ice may be dispensed from the ice dispenser even with the pantry drawer in an open position.

According to another embodiment, the present invention is a bottom mount refrigerator that includes a freezer compartment, a fresh food compartment located above the freezer compartment, an ice compartment within the fresh food compartment, a door for the fresh food compartment, a pantry compartment accessible without opening the fresh food door located above the freezer compartment, and an ice dispenser in the door for dispensing ice from the ice compartment to a consumer. The pantry drawer may be separated from the fresh food compartment by a divider that includes a transparent shelf. The pantry drawer may be maintained at a temperature for storing fresh fruits and vegetables. The top edge of the drawer may be matched to the standard height of a kitchen counter. The pantry drawer may be located beside the fresh food compartment.

According to another embodiment, the present invention is a refrigerator that has an insulated cabinet. A fresh food compartment within the cabinet is provided for storing foods at a temperature above 32 degrees Fahrenheit. A fresh food door is provided for sealing the fresh food compartment in closed position and permitting access to the fresh food compartment in an open position. An ice compartment is accessible by opening the fresh food door. An ice dispenser will dispense ice through the fresh food door without opening the fresh food door. A freezer compartment is provided in the insulted cabinet for storing frozen food. A freezer compartment cover seals the freezer compartment when in a closed position and permits access to freezer compartment when in an open position. A pantry compartment is provided in the insulated cabinet between the freezer compartment and the fresh food compartment. A pantry drawer that includes a handle for pulling the drawer to an open position is slidingly disposed within the pantry compartment. The handle is accessible without opening the fresh food door or the freezer compartment cover. The refrigerator may include a divider for separating the fresh food compartment from the pantry compartment. The divider includes a mullion at the front of the insulated cabinet and a translucent shelf. The shelf may be transparent. A light source may be provided in the mullion for illuminating contents of the pantry drawer when it is pulled to an open position. A light source may be provided at the rear of the pantry compartment for illuminating the fresh food compartment when the fresh food door is open. The refrigerator may include a mechanism for adjusting an opening to vary the amount of cold air permitted to flow into the pantry compartment to selectively adjust a pantry compartment temperature. A temperature sensor may be provided in the pantry compartment for sensing the pantry temperature and automatically adjusting the pantry temperature within a desired range.

The specific techniques and structures employed by the invention to improve over the drawbacks of the prior systems and accomplish the advantages described above will become apparent from the following detailed description of exemplary embodiments of the invention and the appended drawings and claims.

DETAILED DESCRIPTION OF THE PREFERRED EMBODIMENTS

Figure 1:
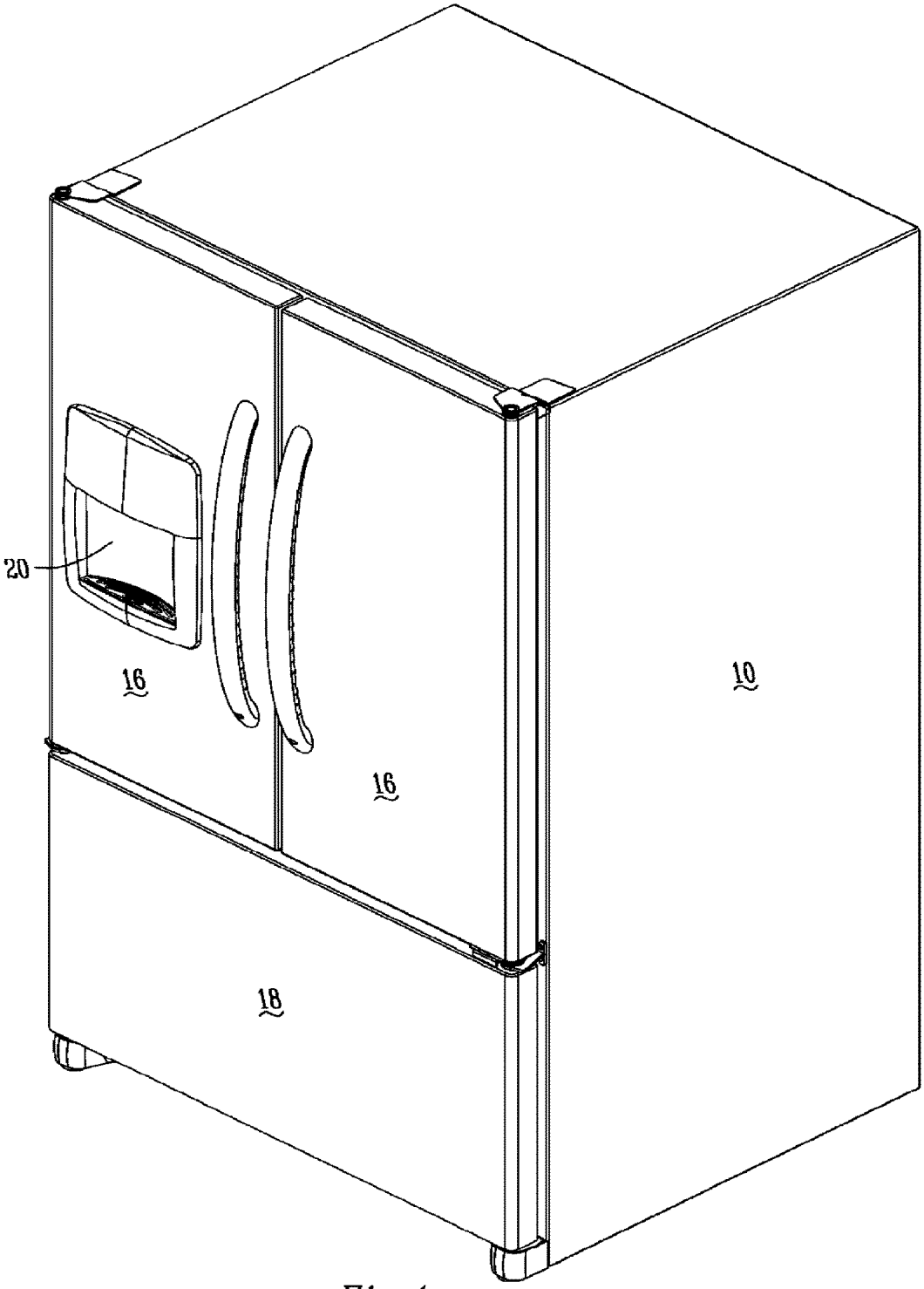
FIG. 1 is a perspective view of a bottom mount refrigerator according to one embodiment of the present invention.
Figure 2:
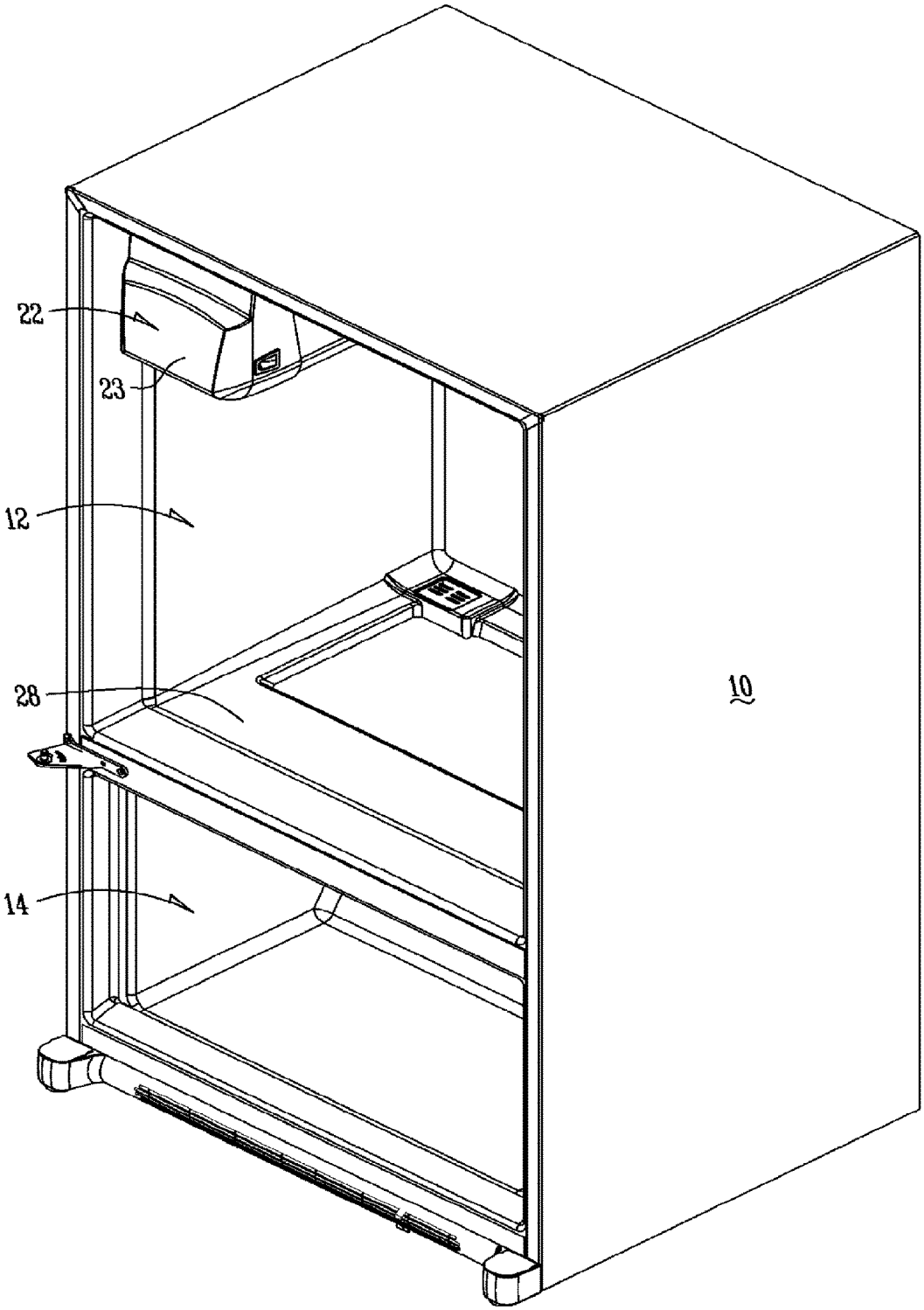
FIG. 2 is a perspective view of the bottom mount refrigerator having the doors removed.

A bottom mount refrigerator is generally designated in the drawings by the reference numeral 10. The refrigerator 10 includes a refrigerator or fresh food compartment 12 and a freezer compartment 14. Doors 16 are provided for the refrigerator compartment or fresh food compartment 12 and a door 18 is provided for the freezer compartment 14. One of the doors 16 includes an ice dispenser 20, which may also include a water dispenser.

Intermediate Temperature Ice Making Compartment

An ice making compartment or intermediate compartment 22 is provided in the refrigerator compartment 12. The ice making compartment 22 is shown to be in one of the upper corners of the refrigerator, or fresh food, compartment 12, but other locations are also within the scope of this invention. The ice making compartment 22 has a front cover 23 that is insulated to prevent the cold air of the ice making compartment 22 from passing into the refrigerator compartment and opening 21 is provided that mates with chute 19 of the ice dispenser 20. A seal may be provided between the opening 21 and chute 19 to prevent cold air from passing from the ice making compartment to the refrigerator compartment 12. Chute 19 may be adapted to engage opening 21 upon closing of door 16. Chute 19 and opening 21 may be opposingly angled as to provide added sealing upon closing of door 16. Additionally, an intermediate piece may be used to improve the seal be between chute 19 and opening 21. For example, a resilient seal may be used to assist in achieving this seal. Alternatively, a spring or other elastic material or apparatus may be utilized between or about the junction of chute 19 and opening 21. Other alternatives for sealing between chute 19 and opening 21 should be evident to one skilled in the art.

Additionally, chute 19 should have a blocking mechanism located within or about it to assist in preventing or decreasing the flow of air or heat transfer within chute 19. For example, a flipper door that operates by a solenoid may be placed at the opening 21 to prevent cold air from leaving the ice making compartment 22 and entering into the refrigerator compartment.

Preferably, the ice making compartment 22 includes an ice maker 50 (as described below) that forms ice in an environment that is below freezing.

The ice making compartment 22 may be integrally formed adjacent the refrigerator compartment 12 during the liner forming process and insulation filling process. In such a process the intermediate compartment may be separated on at least one side from the fresh food compartment by the refrigerator liner. Alternatively, the ice making compartment 22 may be made or assembled remotely from the fresh food compartment and installed in the fresh food compartment 12. For example, this compartment 22 may be slid into the refrigerator compartment 12 on overhead rails (not shown) or other mounting. These methods are discussed subsequently.

The refrigerator 10 includes an evaporator 24 which cools the refrigerator compartment 12 and the freezer compartment 14. Normally, the refrigerator compartment 12 will be maintained at about 40° F. and the freezer compartment 14 will be maintained at approximately 0° F. The ice making compartment is maintained at a temperature below 32° F. or less in order to form ice, but is preferably not as cold as the freezer compartment 14. Preferably this temperature is in the range of 20° F. The walls of the ice making compartment are insulated to facilitate temperature control among other aspects. Grates or air vents 26 are provided in the wall 28 between the refrigerator compartment 12 and the freezer compartment 14 to allow air circulation between the compartments.

Air Ducts

Figure 5:
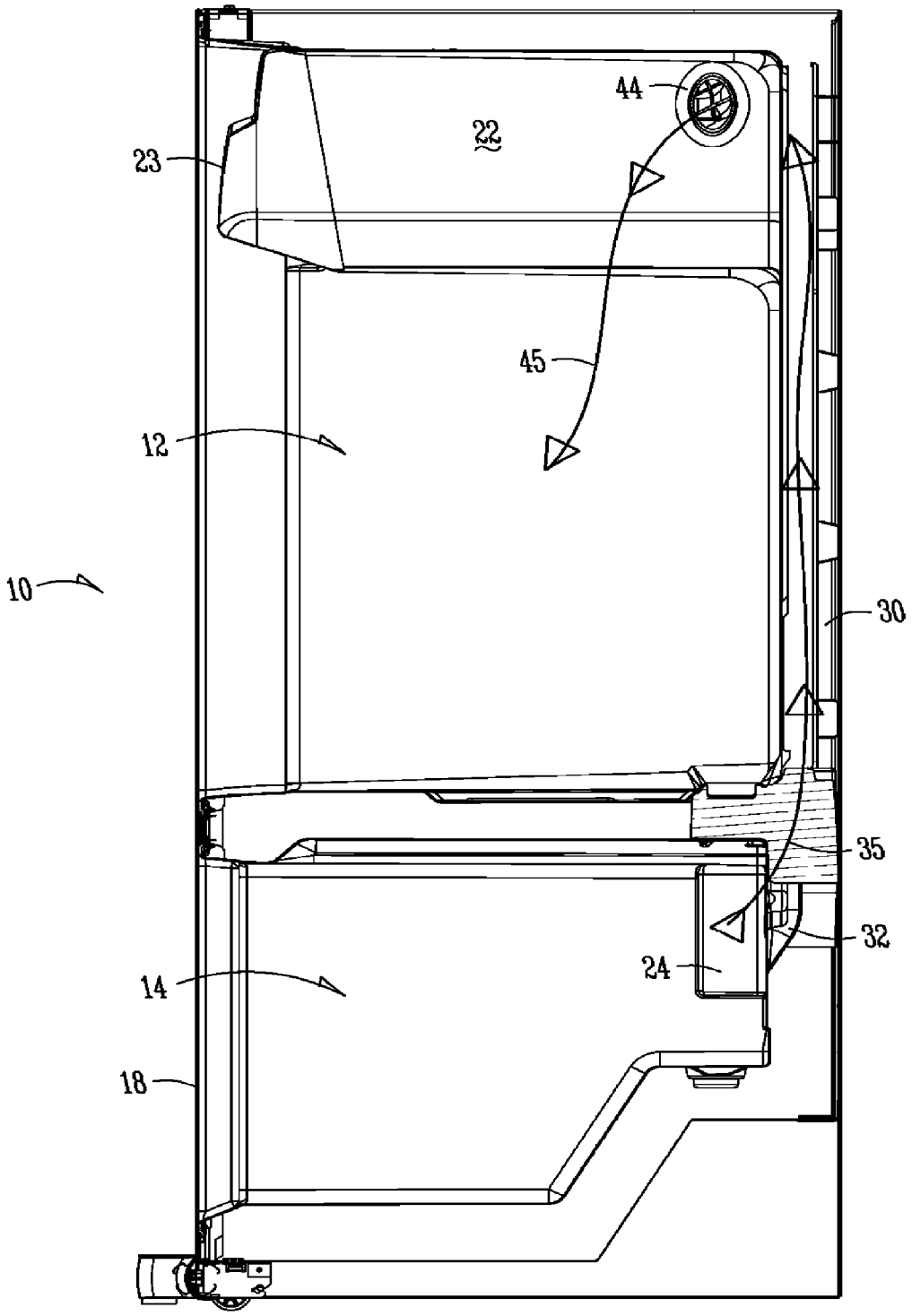
FIG. 5 is a sectional view taken along lines 5-5 of FIG. 4.

A cold air duct 30 extends between the freezer compartment 14 and the ice making or specialty compartment 22. More particularly, the cold air duct 30 has a lower air inlet 32 within the freezer compartment 14 and an upper outlet end 34 connected to a fan 36 mounted on the back wall of the ice maker 22. The fan 36 draws cold air from the freezer compartment and forces the cold air into the ice maker 22 so as to facilitate ice making. It is understood that the fan 36 may be located at the inlet end 32 of the cold air duct 30. The fan 36 controls the air flow from the freezer compartment 14 to the ice making compartment 22 and may be a variable speed fan. The fan can be actuated by conventional means. The cold air duct 30 preferably resides within the rear wall of the refrigerator 10, as seen in FIG. 5. The arrow 35 designates the air flow through the cold air duct 30.

Figure 6:
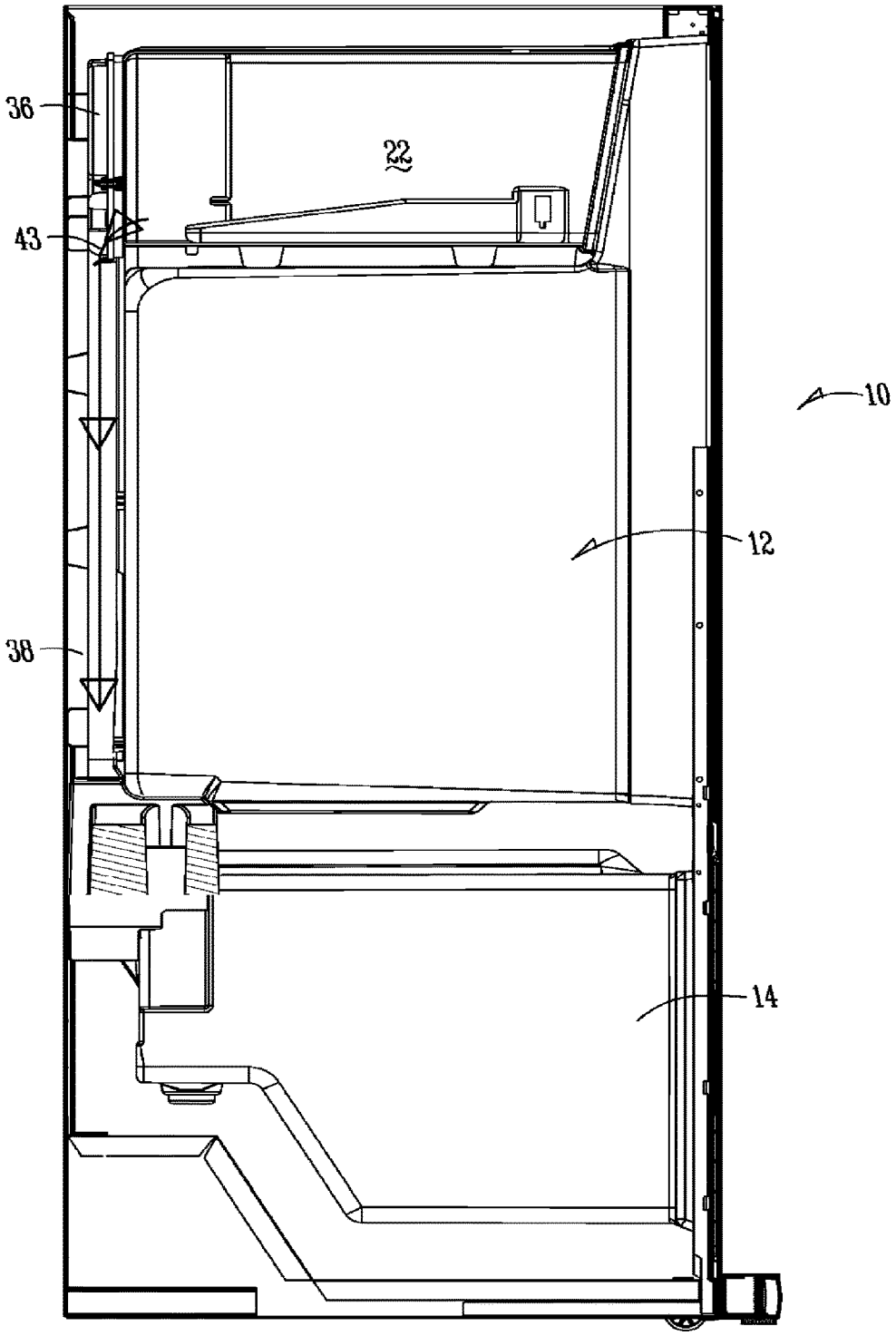
FIG. 6 is a sectional view taken along lines 6-6 of FIG. 4.

The refrigerator 10 also includes a return air duct 38 having an upper end 40 connected to the ice maker 22, and a lower end 42 terminating adjacent one of the air grates 26. Alternatively, the lower end 42 of the return air duct 38 may extend into the freezer compartment 14. Preferably, the return air duct 38 resides within the rear wall of the refrigerator 10, as seen in FIG. 6.

Figure 3:
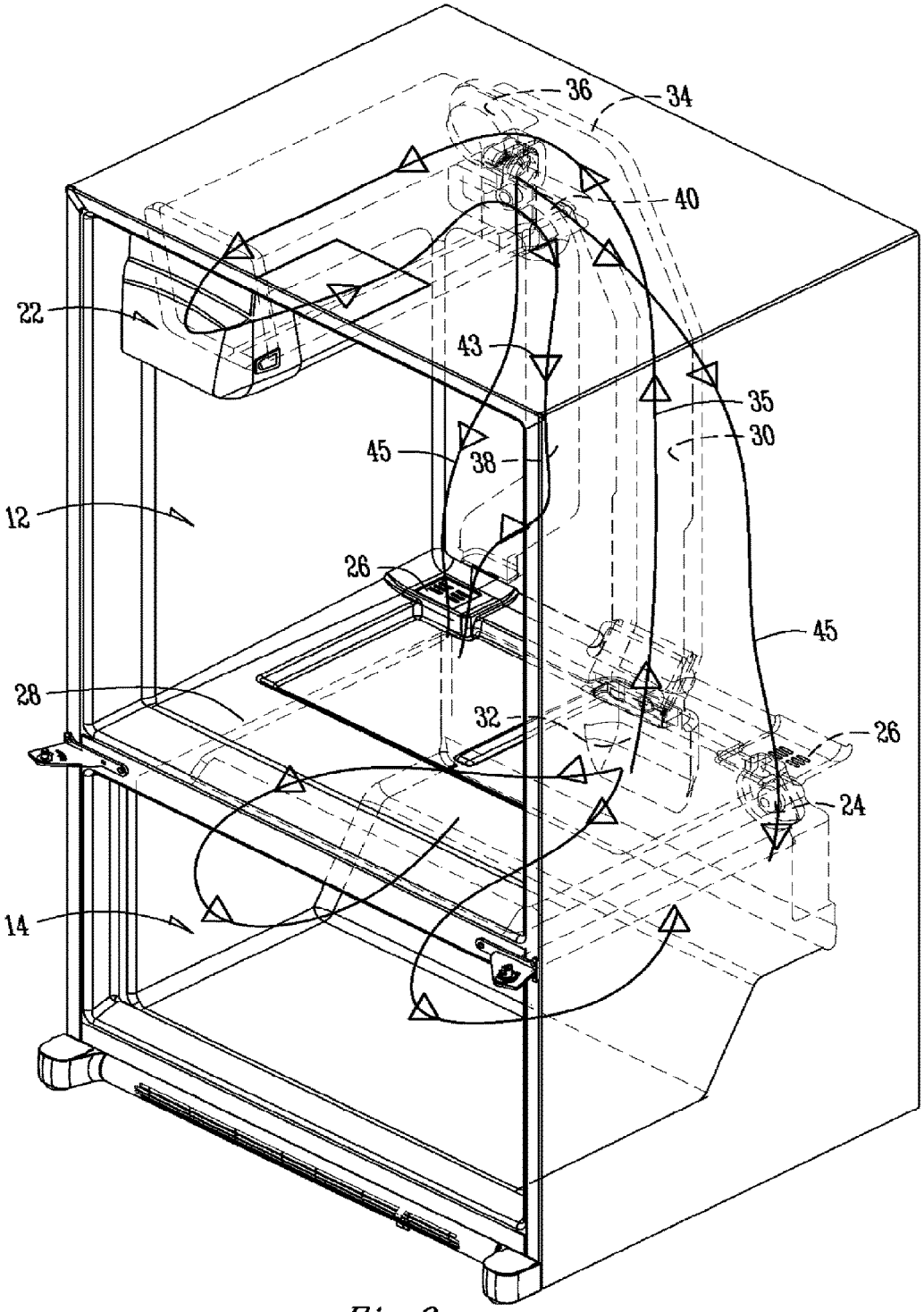
FIG. 3 is a view similar to FIG. 2 showing the cold air duct and return air duct for the ice making compartment.

The ice making compartment 22 also has an air vent for discharging air into the refrigerator compartment 14. Thus, a portion of the air from the ice making compartment 22 is directed through the return air duct 38 to the freezer compartment 14, as indicated by arrow 43 in FIG. 3, and another portion of the ice making compartment air is vented through the opening 44 into the refrigerator compartment 12, as indicated by arrows 45 in FIG. 3.

Figure 4:
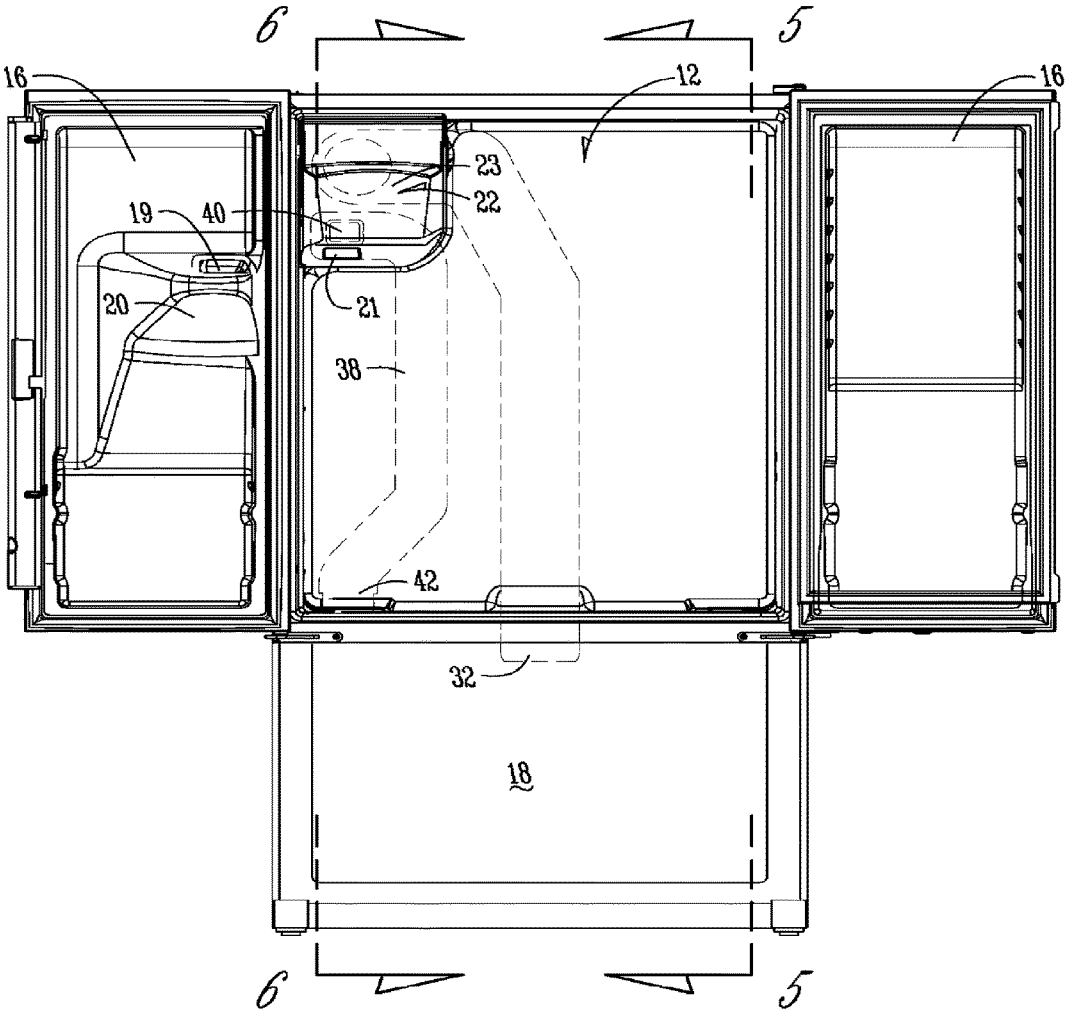
FIG. 4 is a front elevation view of the bottom mount refrigerator of the present invention with the doors open, and illustrating the cold air and return air ducts.

As seen in FIG. 4, the ice is discharged from the ice maker 22 in any conventional manner. Similarly, the ice dispenser 20 functions in a conventional manner.

Ice Maker

Figure 7:
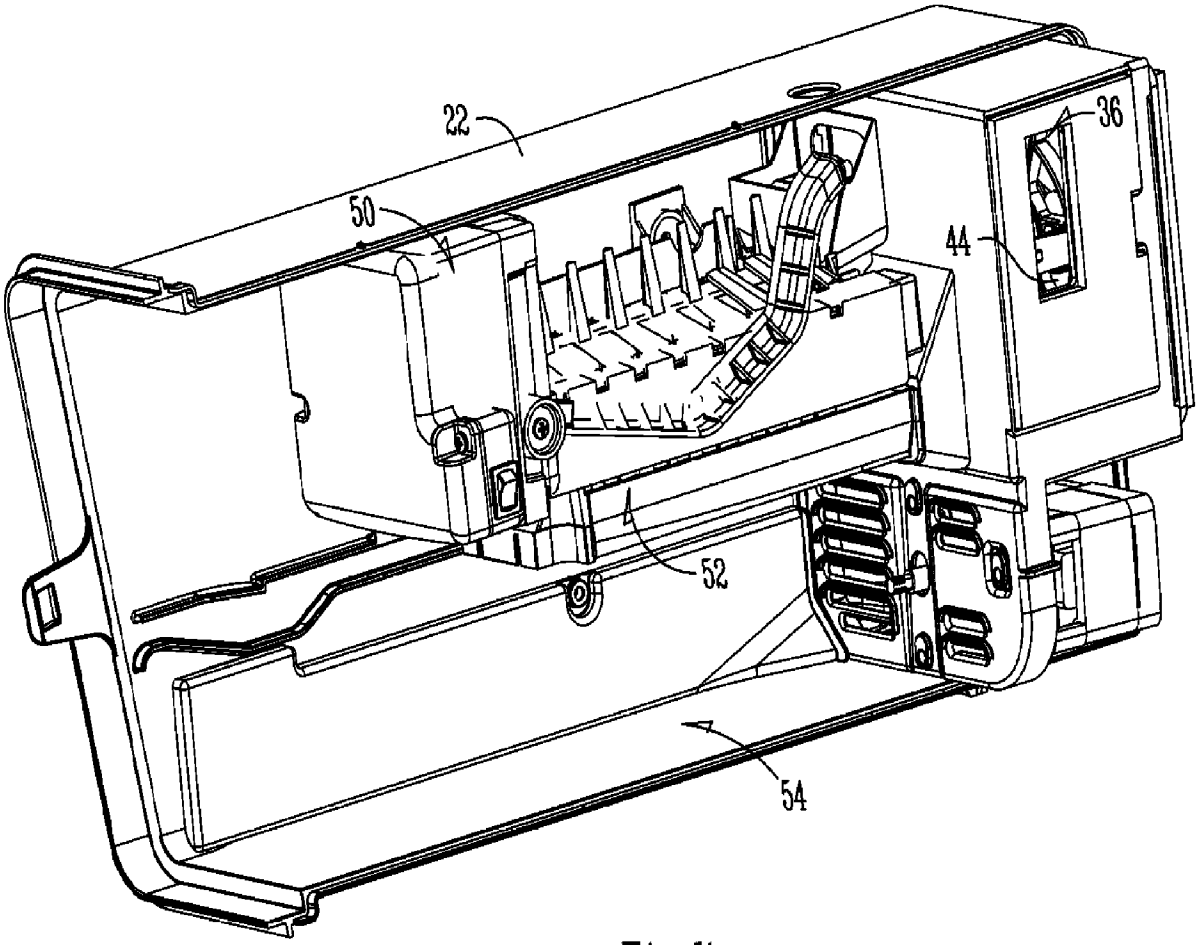
FIG. 7 is a perspective view of the ice maker positioned within the ice making compartment.
Figure 9:
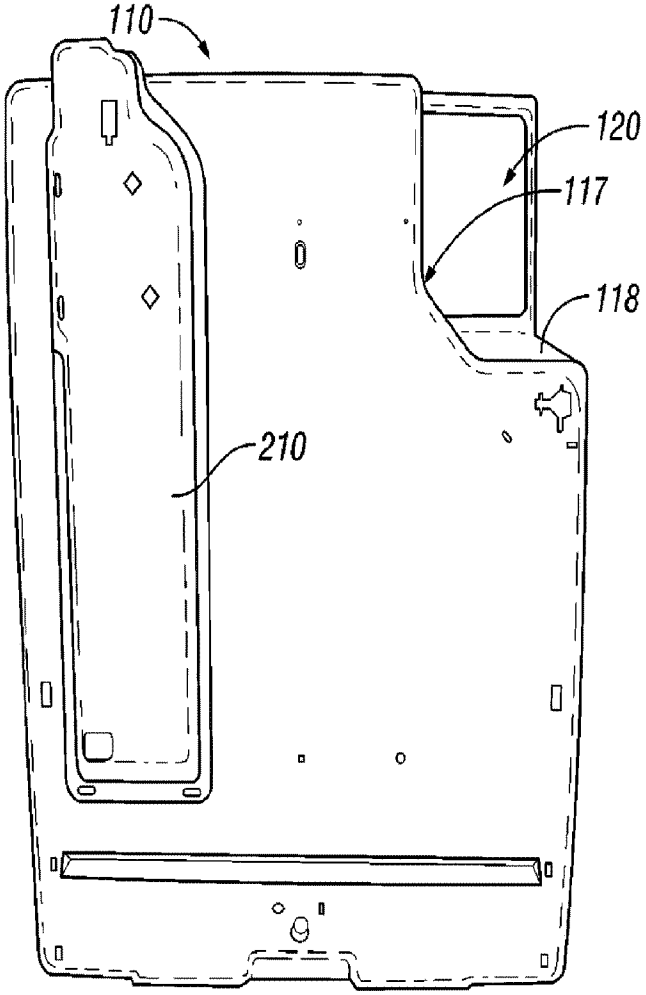
FIG. 9 is a front elevation view of the liner shown in FIG. 8 without the ice box attached.
Figure 8:
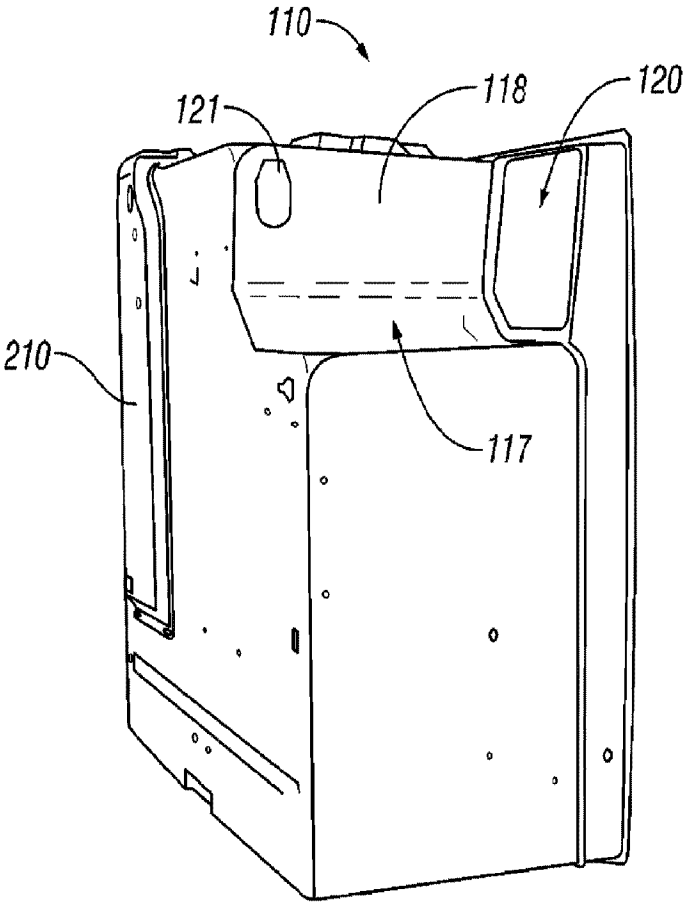
FIG. 8 is a perspective view of the fresh food compartment liner with the integrally formed ice making compartment of the present invention.
Figure 11:
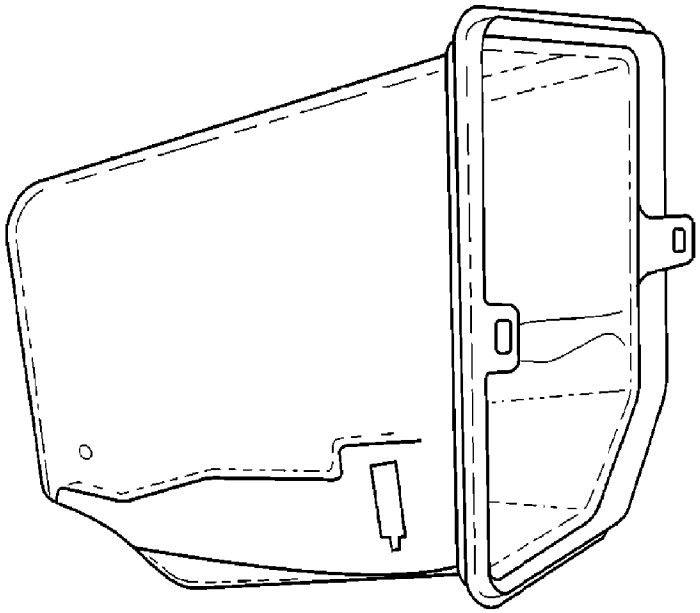
FIG. 11 is a perspective view of the ice box which mounts to the liner in accordance with one embodiment of the present invention.
Figure 10:
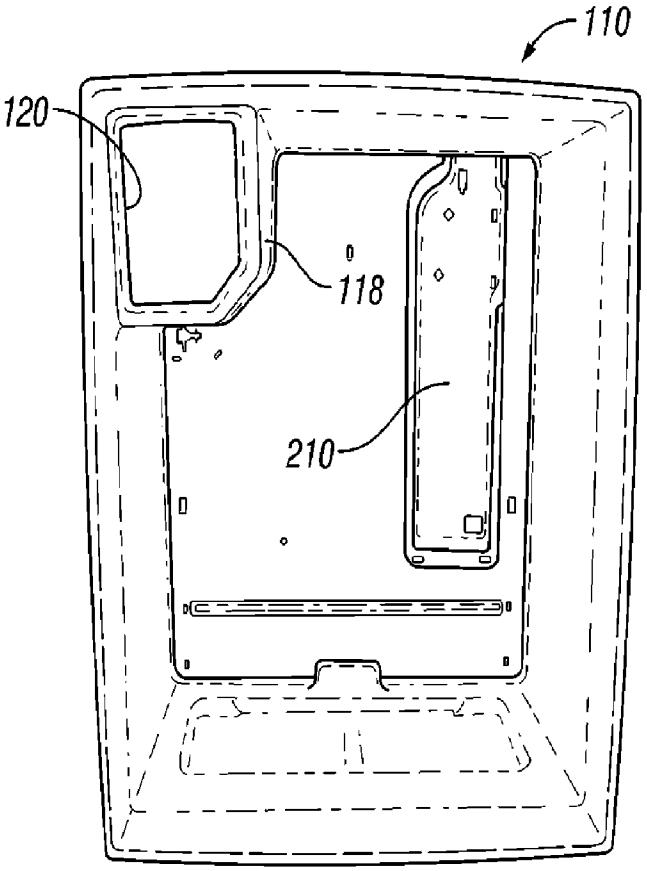
FIG. 10 is a side elevation view of the liner shown in FIG. 8.
Figure 12:
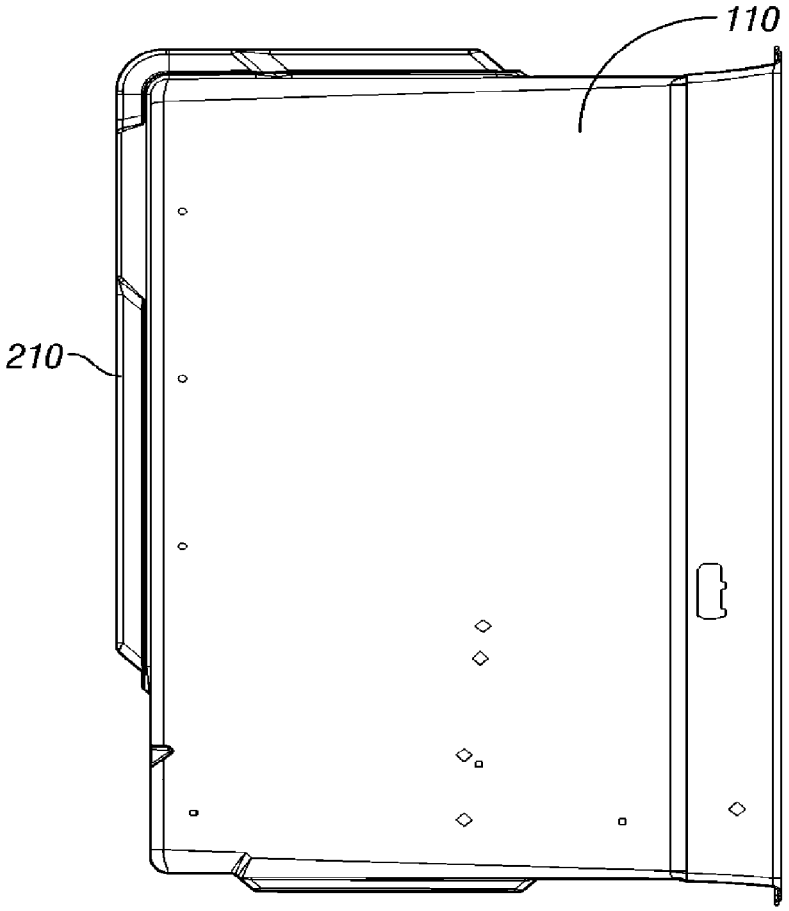
FIG. 12 is a right side elevation view of the fresh food compartment liner showing the water tank recess formed in the rear wall.
Figure 13:
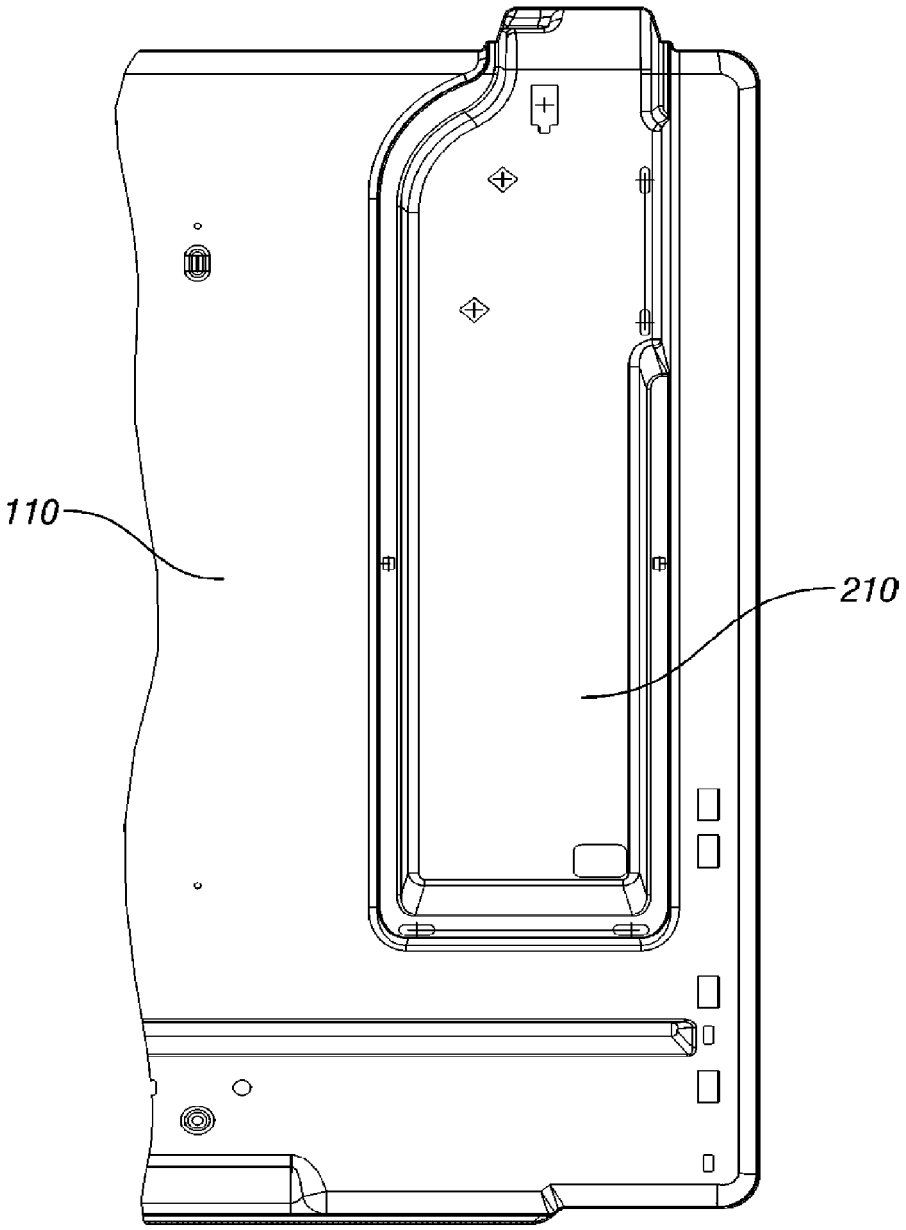
FIG. 13 is a partial front elevation view of the fresh food compartment liner showing the water tank recess.
Figure 14:
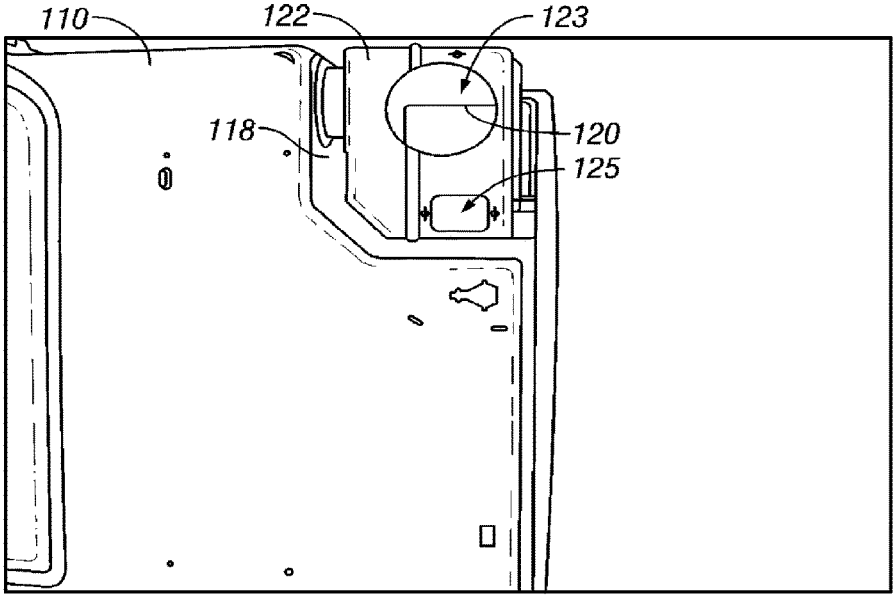
FIG. 14 is a rear perspective view of the fresh food compartment liner with the ice box installed within the outer shell of the fresh food compartment.
Figure 15:
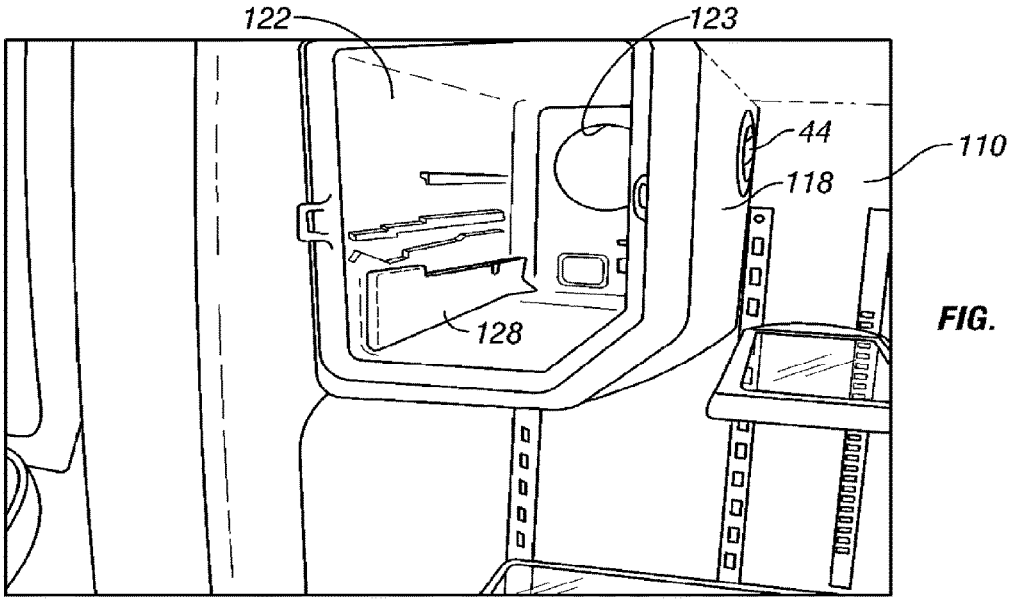
FIG. 15 is a front perspective view of the fresh food compartment with the ice maker and pan assembly removed for clarity.
Figure 16:
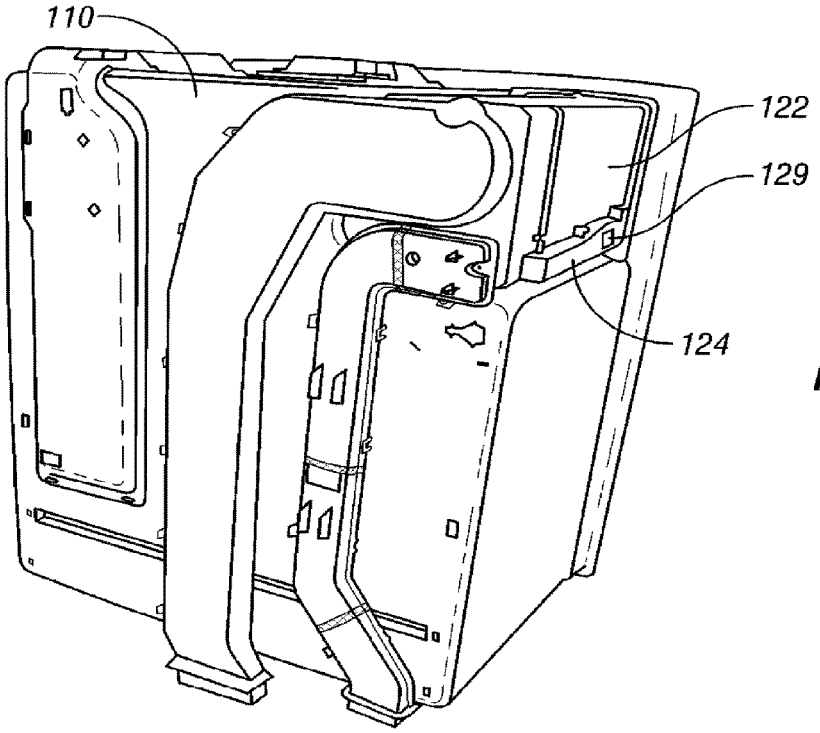
FIG. 16 is a perspective view of the liner, box and air ducts provided for the ice making compartment.
Figure 17:
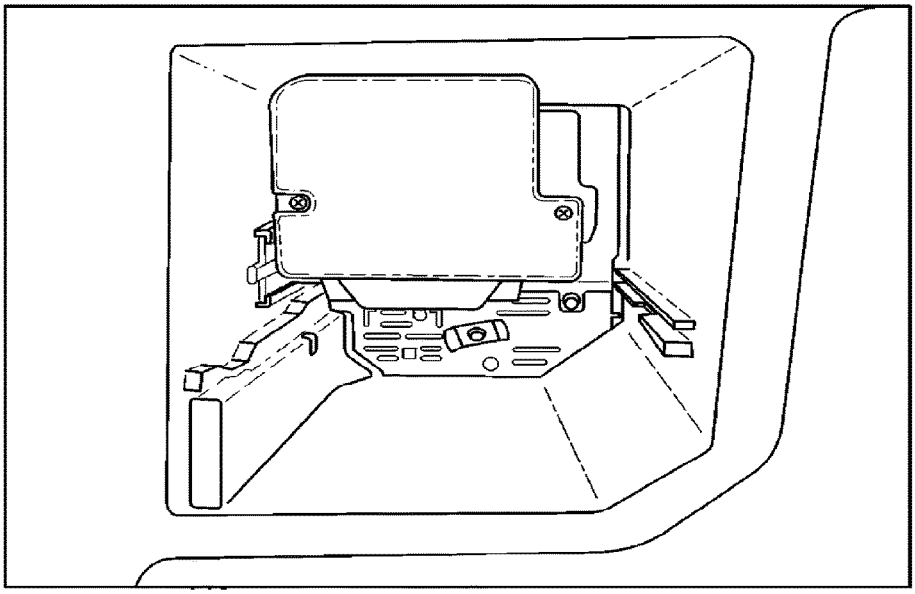
FIG. 17 is a front elevation view of the ice compartment with the pan assembly moved for clarity.
Figure 18:
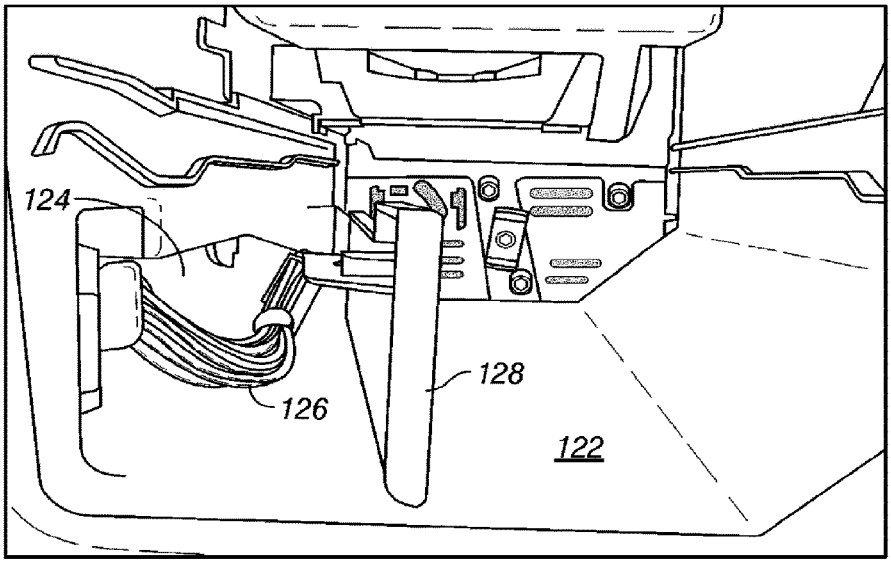
FIG. 18 is a view showing an internal portion of the ice making compartment with a wire harness cavity in an open position.
Figure 19:
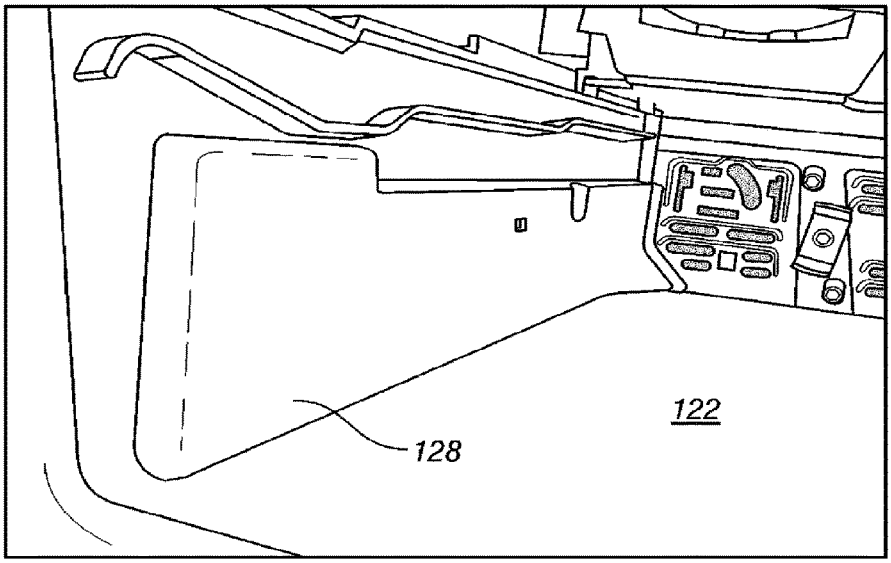
FIG. 19 is a view similar to FIG. 16 showing the wire harness cavity with a cover installed.
Figure 20:
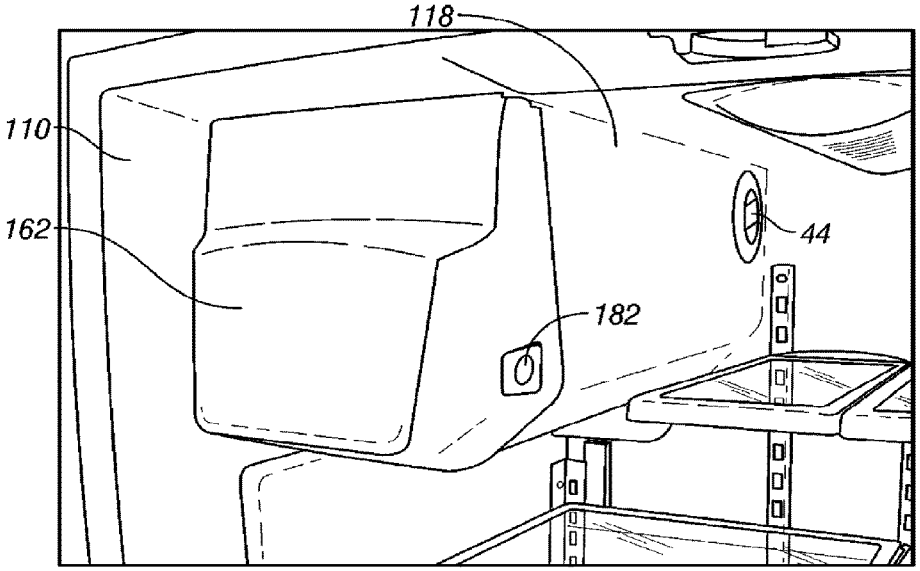
FIG. 20 is a perspective view from the front of the ice maker showing the bin and front cover in a closed position.
Figure 21:
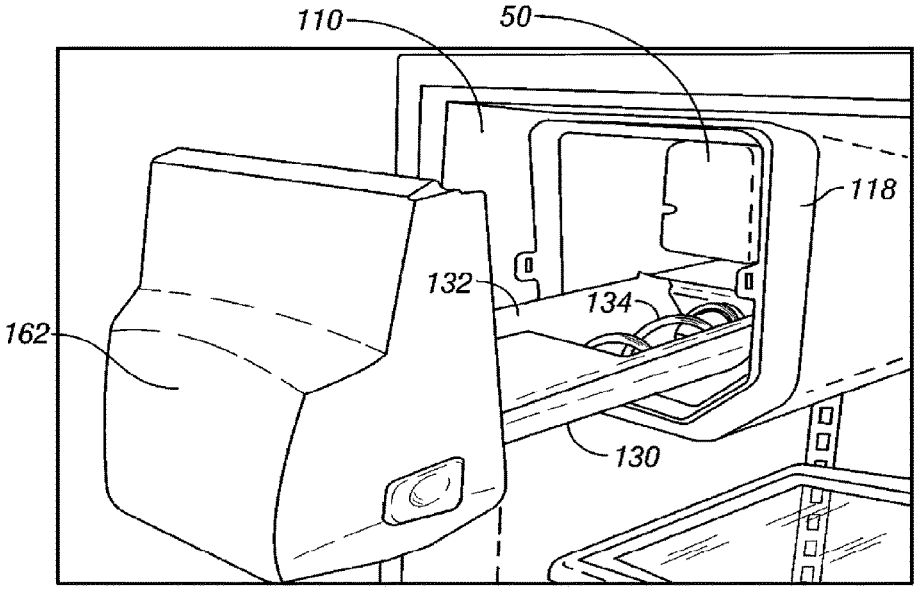
FIG. 21 is a view similar to FIG. 14 showing the bin and front cover in an open position.

As seen in FIG. 7, an ice maker 50 is positioned within the ice making compartment 22 with the ice storage area 54 with auger (not shown) removed for clarity. The ice maker 50 is mounted to an impingement duct 52. The impingement duct receives freezer air coming from the freezer compartment through the cold air duct 30 and the fan assembly 36. The opening 44 vents air into the refrigerator compartment 12. The auger assembly (not shown) is provided beneath the ice maker 50 along with an ice storage bin with an insulated cover 23. Impingement on the ice maker, as well as other aspects of ice making, is disclosed in Applicant's U.S. application Ser. No. 11/140,100 filed May 27, 2005 entitled REFRIGERATOR WITH IMPROVED ICE MAKER and is hereby incorporated by reference.

Control System (Generally)

As described in more detail below, a control system is provided that utilizes the ice making compartment 22, the cold air supply duct 30, the return air duct 38, the variable speed ice making fan 36, ice making impingement air duct 52, an ice making compartment thermistor (not shown), an ice making compartment electronic control damper, fresh food air return ducts 26, and a fresh food compartment thermistor (not shown). The above components are controlled by an algorithm that prioritizes the making of ice unless the fresh food temperature exceeds the set point temperature. This prioritization is achieved as follows:

i. When ice is a priority, the fresh food damper is closed and the fan runs at optimum speed. In this way, supply air from the freezer compartment 14 is discharged through the impingement air duct 52, through the ice storage area 54, and through the ice making compartment return air duct 38. One of the results of this air flow, is that ice is made at the highest rate.

ii. When the refrigerator compartment 12 is above set point, the electronic control damper opens and the fan runs at optimum speed. The supply air to the ice making compartment is routed almost entirely into the fresh food compartment which forces the warmer air to return to the evaporator coil of the refrigerator. This achieves a rapid return to the fresh food set point after which the damper closes and the ice making resumes.

iii. When the ice bin is full and the fresh food temperature is satisfied, the ice making fan runs at minimum speed. Aspects of this will include: reduced energy consumption; reduced sound levels; and minimized sublimation of ice.

The above control system permits precision control of both the ice making compartment 22 and the refrigeration compartment 12 separately, yet minimizes the complexity and the number of component parts necessary to do so.

Thermoelectric Alternative

A thermoelectric unit (not shown) may replace the impingement duct 52 with some concessions. Preferably the thermoelectric unit would contour about the ice maker as it effectively pulls heat out of the water. Alternatively, the thermoelectric unit could be the ice maker. Regardless, it should be understood that additionally, the thermoelectric unit would require a heat sink outside of the ice making compartment 22 to dissipate heat. A careful balance is required between the voltage of the thermoelectric unit and the temperature of the refrigerator compartment 12 if the heat sink is in the refrigerator compartment 12. For example, the higher the voltage, the more heat will be generated that will be required to be removed from the refrigerator compartment 12. A portion of the heat generated by the thermoelectric unit may be removed by venting freezer compartment air to the thermoelectric unit.

Integral Ice Making Compartment

Figure 37:
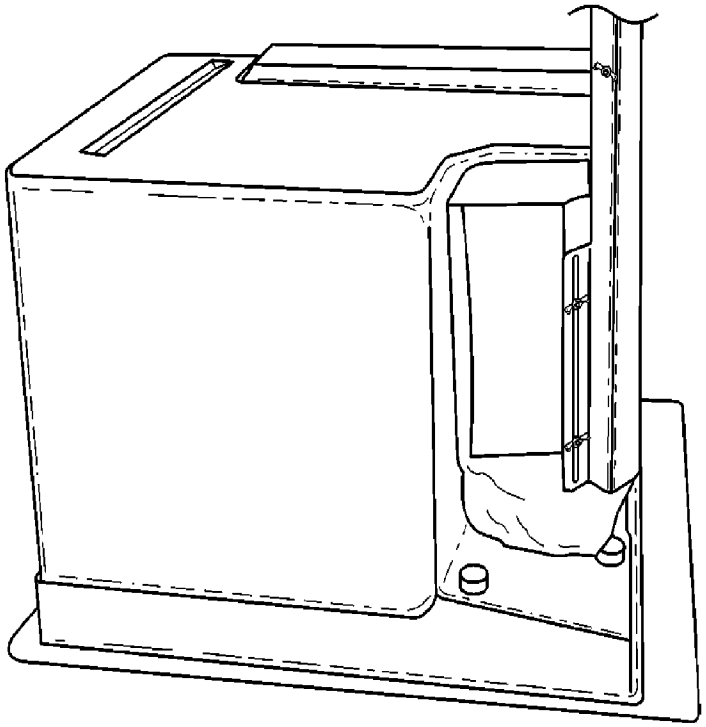
FIG. 37 is a view similar to 36 showing the plug inserted for formation of the ice making compartment.

FIGS. 8-25 and 33-35 show the preferred embodiment of the ice making compartment 22, wherein the compartment 22 is integrally formed with the liner 110 of the fresh food compartment 12. The integral formation of the ice compartment 22 takes place during the molding of the fresh food compartment liner 110. The liner 110 is formed in a conventional manner from a flat sheet of material using male and female molds 112, 114, as seen in FIGS. 36 and 37. The sheet material is heated and then placed between the open molds 112, 114, which are then closed in a vacuum box. Simultaneously, a three-dimensional plug 116 is moved in a direction opposite the male mold 112 so as to deform the sheet material from the rear side opposite the male mold 112. Alternatively, the plug 116 can be stationary and the liner 110 formed around the plug 116. The plug 116 forms a notch 117 in an upper corner of the liner 110. The notch 117 defines an outer shell 118 of the ice compartment 22. Thus, the outer shell 118 is integrally formed with the liner 110 of the fresh food compartment 12. After the liner 110 and the outer shell 118 are completely formed, the plug 116 is withdrawn and the male mold 112 is separated from the female mold 114. The liner 110 with the outer shell 118 of the ice compartment 22 is then removed and cooled. The front wall of the outer shell 118 is punched or cut so as to form an opening 120. A second hole 121 is punched or cut in the shell 118 for the air vent 44. The liner 112 is then moved to a punch station to trim the edges of the liner 110.

The ice compartment 22 includes a box 122 which is inserted through the front opening 120 into the outer shell 118 so as to define an inner shell. The space between the outer shell 118 and the box or inner shell 122 is filled with an insulating foam, such that the ice compartment 22 is insulated. This insulation process may take place at the same time that insulation is applied between the liner 110 and the outer cabinet of the refrigerator 10. The ice box 122 includes a rear hole 123 for connection to the cold air duct 30, a second rear hole 125 for connection to the return air duct 38, and a side hole 127 for the vent opening 44.

Modular Ice Making Compartment

Figure 38:
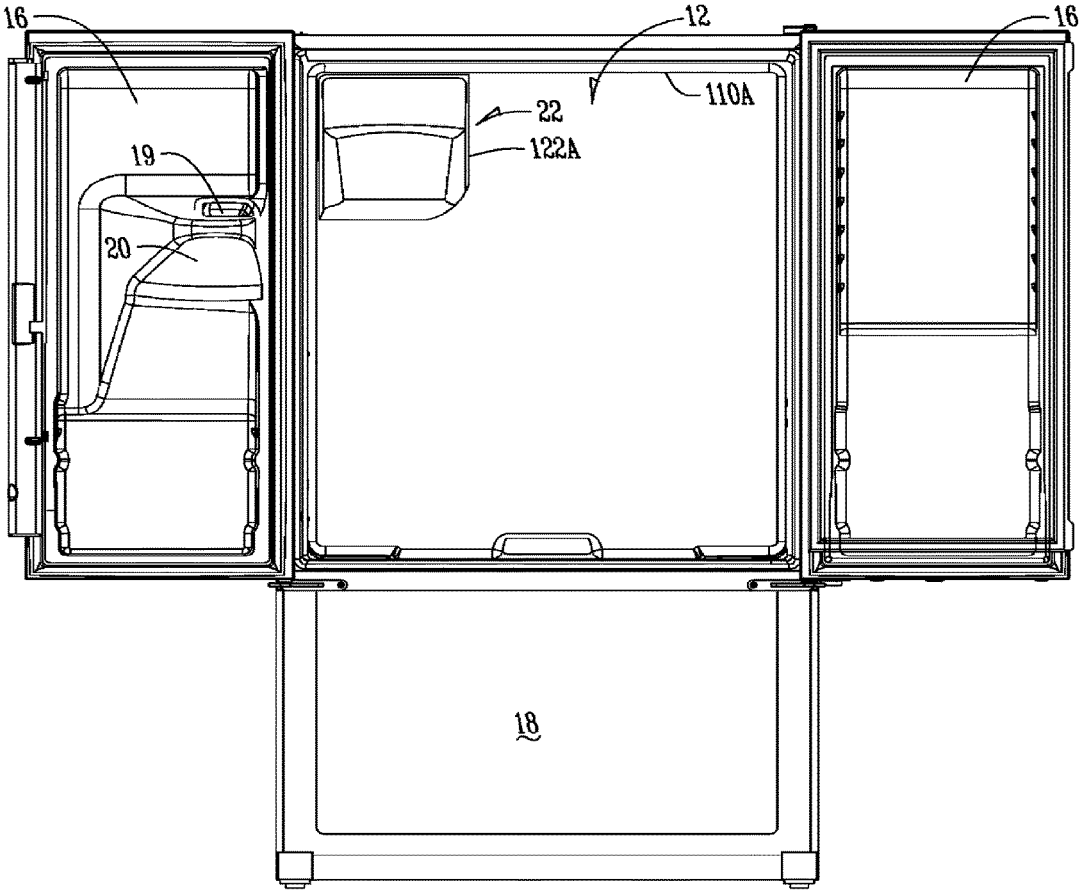
FIG. 38 is a view of an alternative embodiment of an ice making compartment formed separately from the fresh food compartment liner and mounted therein.
Figure 39:
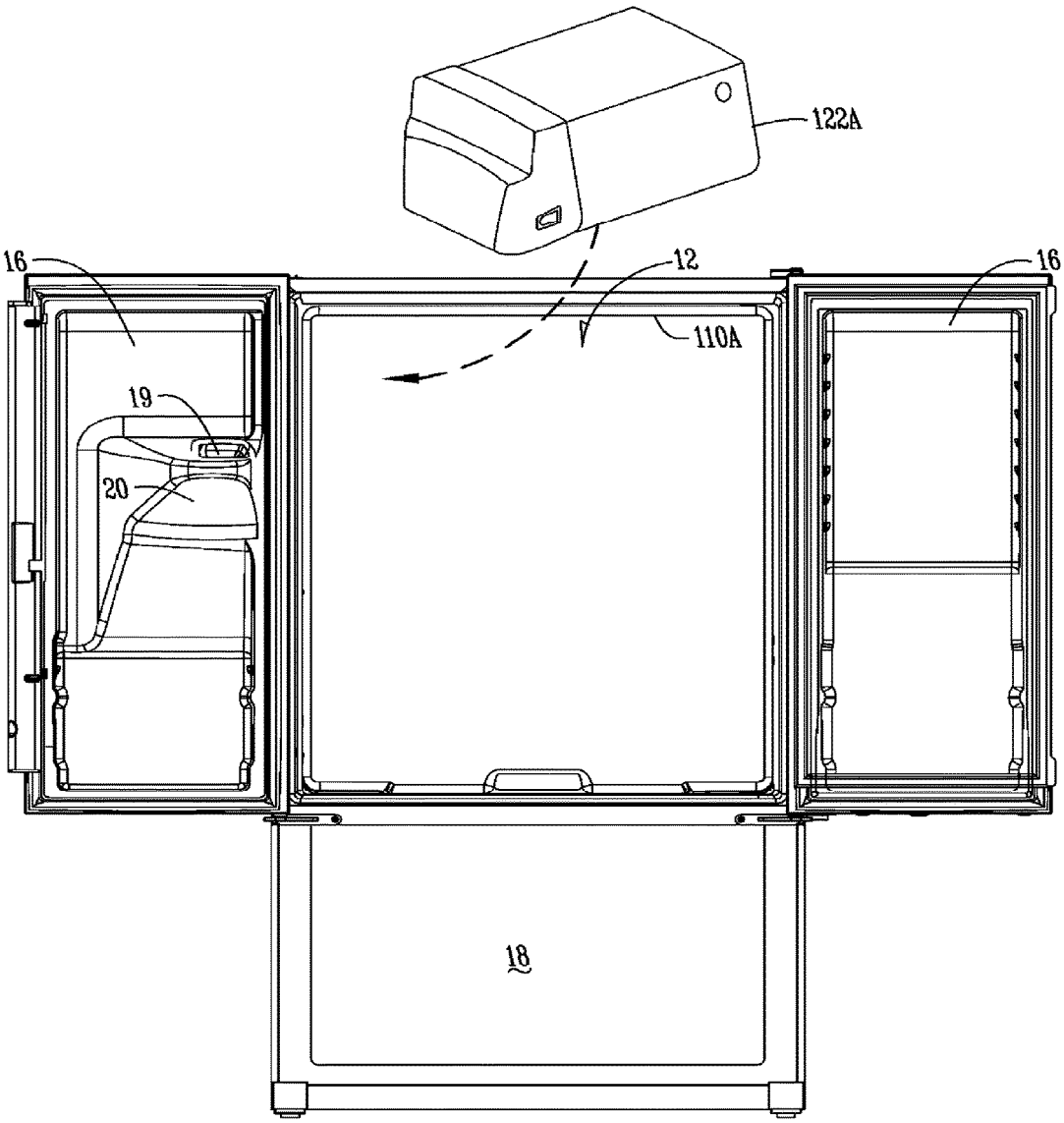
FIG. 39 is an exploded view of the separate ice compartment of the alternative embodiment.

As an alternative to an ice making compartment formed integrally in the liner 110, the compartment 22 can be formed separately and then attached to the liner. This modular compartment is shown in FIGS. 38 and 39, and includes the liner 110A of the fresh food compartment, and the ice box 122A, which preferably is insulated. All other features and components of the compartment 22 are the same, other than how it is made. The modular unit can be mounted anywhere in the fresh food compartment 12.

Wire Harness

The ice compartment 22 is adapted to receive the ice maker 50, which is mounted therein using any convenient means. The ice box 122 includes a recess 124 adapted to receive the wire harness 126 for the ice maker 50. The wire harness 126 may be adapted to allow for connection to the ice maker 50 prior to complete insertion or mounting of the ice maker 50 into the compartment 12. For example, the wire harness 126 may be adapted to be operatively connected to the refrigerator XX near the front portion of ice box 122 to allow for sufficient travel of the ice maker upon insertion or mounting of the ice maker 50. As shown in Figure YY, wire harness 126 is operatively connected at the rearward portion of ice maker 50. In this case, an assembler may connect the wire harness 126 to the ice maker 50 and/or the refrigerator XX prior to fully inserting or mounting ice maker 50 into ice box 122.

A cover 128 may be provided for the wire harness recess 124 so as to enclose the wire harness 126 prior to connecting the harness 126 to the ice maker 50. The ice box 122 has a hole 129 in a side wall to mount the connector or clip of the wire harness.

Ice Bin Assembly

Figure 22:
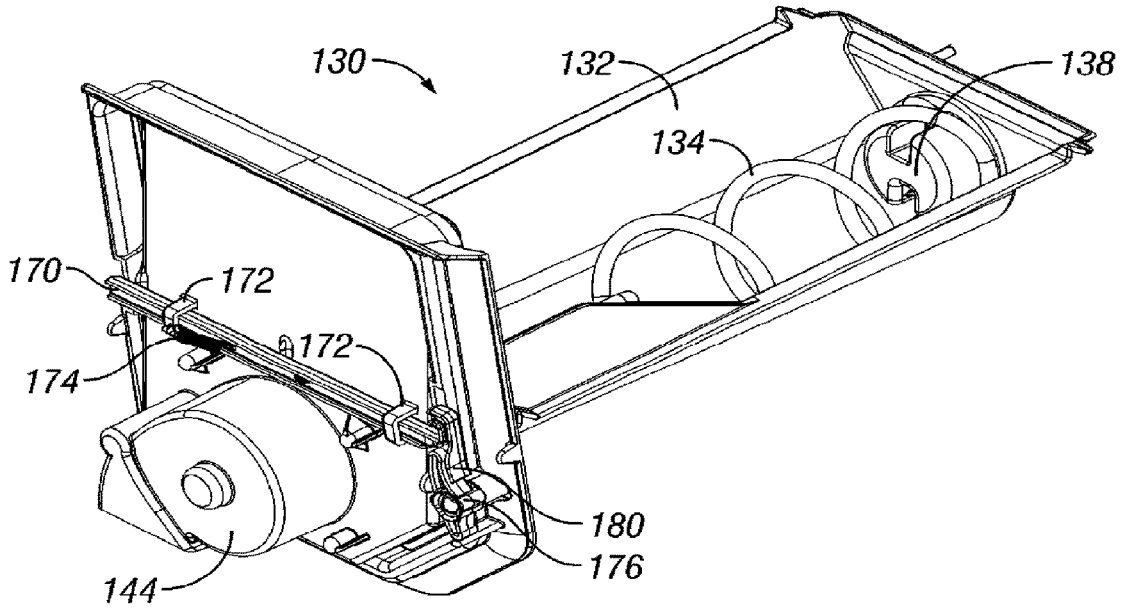
FIG. 22 is a perspective view of the ice pan, auger and motor assembly.
Figure 23:
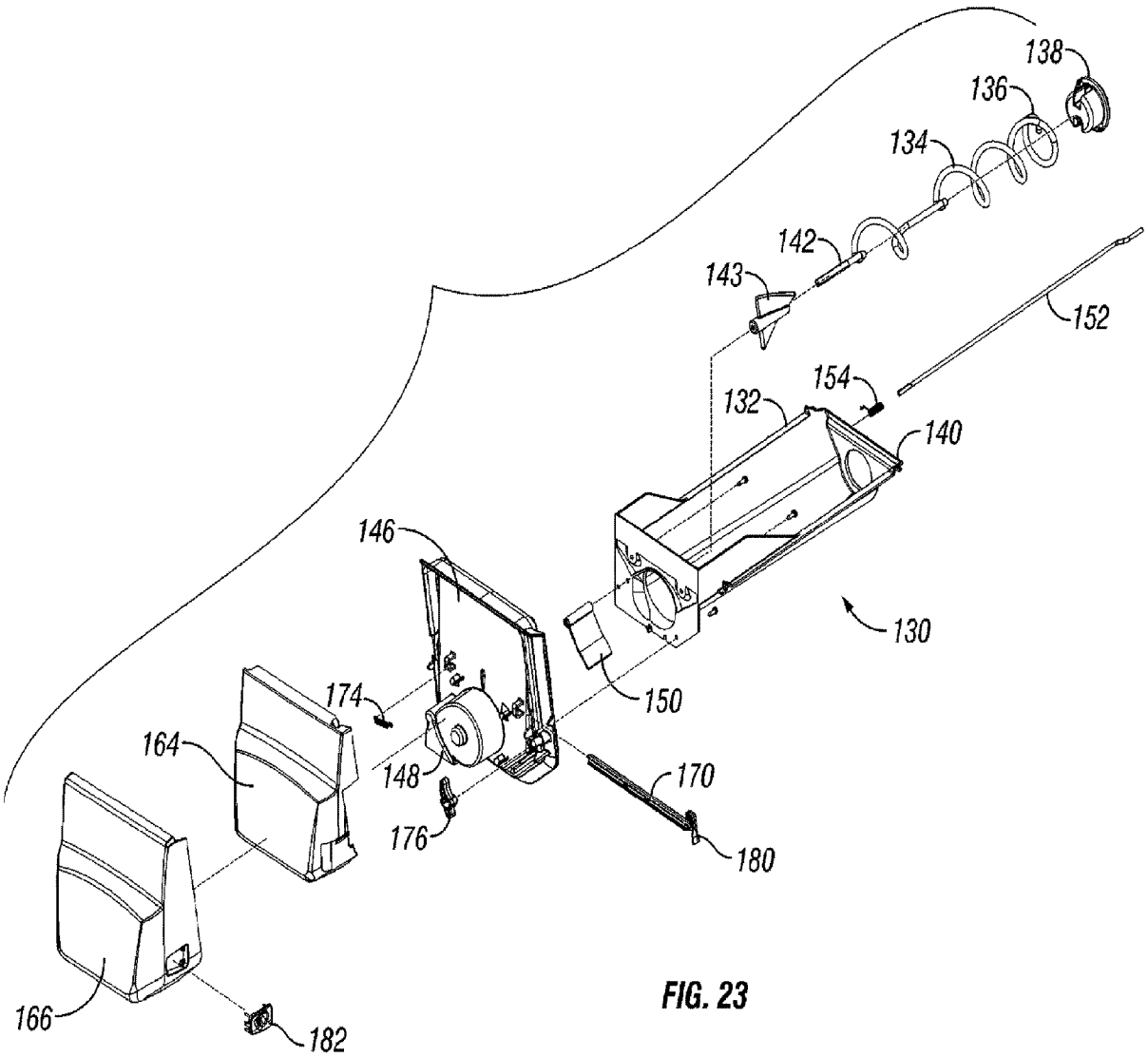
FIG. 23 is an exploded view of the ice pan, auger and motor assembly.
Figure 24:
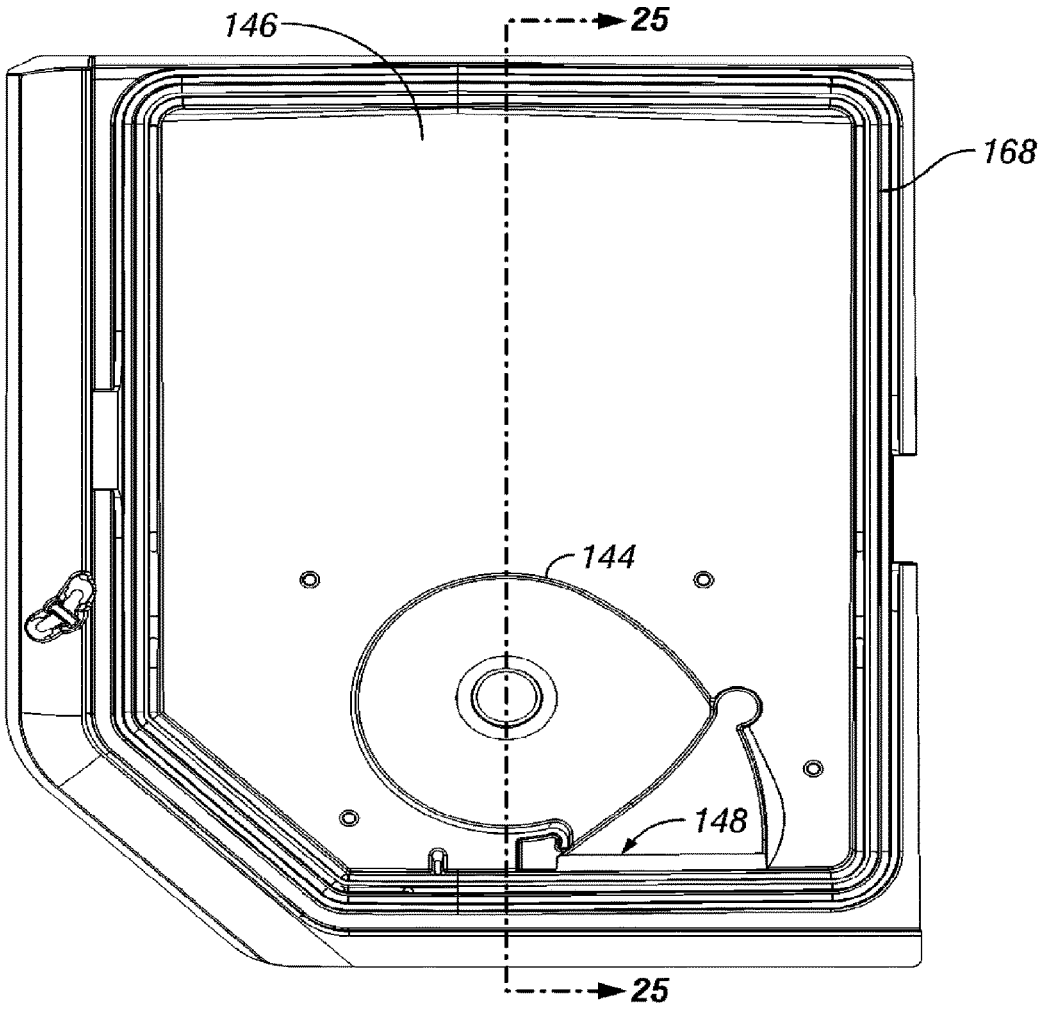
FIG. 24 is a rear elevation view of the bin assembly seal for the ice making compartment.
Figure 25:
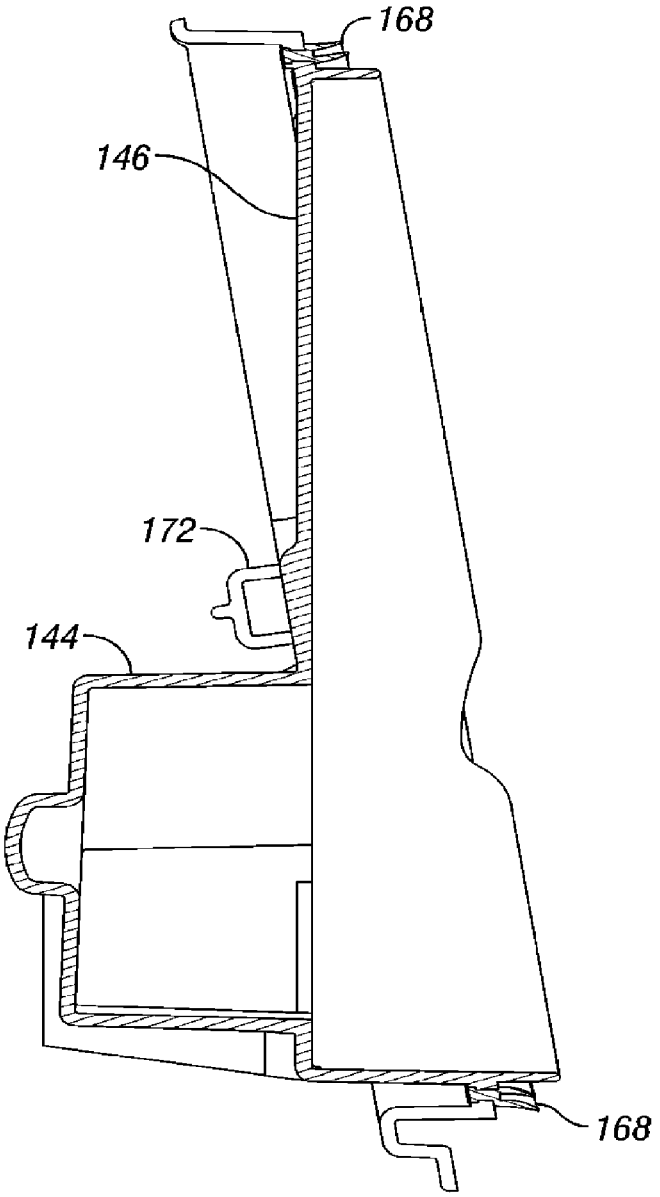
FIG. 25 is a sectional view taken along lines 25-25 of FIG. 24.
Figure 26:
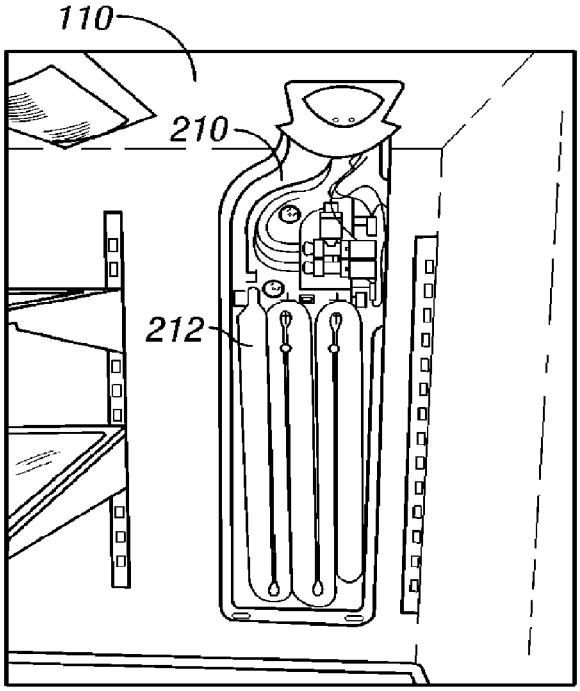
FIG. 26 is a front view of the water cavity formed within the rear wall of the fresh food compartment, with the water tank assembly mounted therein.
Figure 27:
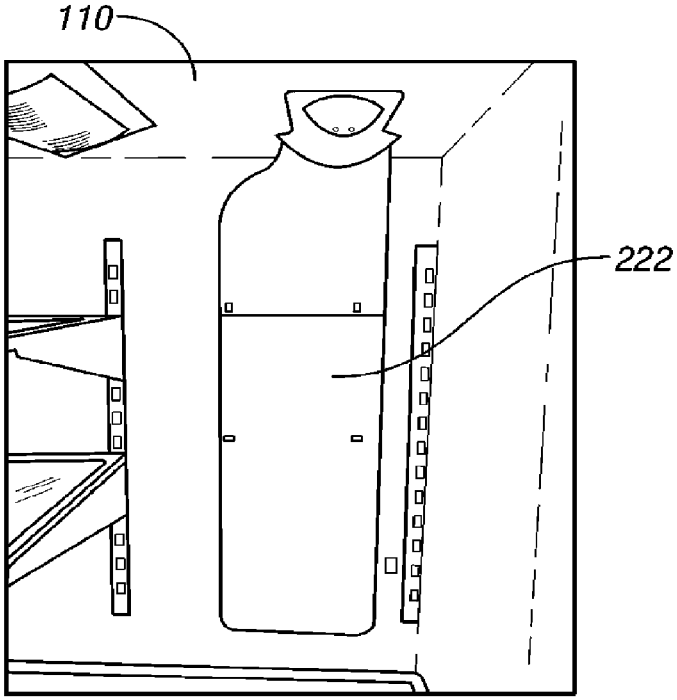
FIG. 27 is a front view of the fresh food compartment showing the cover installed over the water tank cavity.

The ice compartment 22 also includes an ice bin assembly 130. The assembly 130 is removable for assembly, service, and user access to bulk ice storage. The components of the bin assembly 130 are shown in FIGS. 22 and 23. The bin assembly 130 includes a tray or bin 132 for receiving ice from the ice maker 50. An auger 134 is mounted within the tray 132, with the first end 136 of the auger 134 being received in a motor 138 which is mounted in the upstream end 140 of the tray 132. The second end 142 of the auger 134 is mounted in a housing 144 on a front plate 146 of the bin assembly 130. A short piece of auger flighting 143 is provided on the second end 142 of the auger 134, within the housing 144. The housing 144 includes an outlet opening 148, with a flipper door 150 in the housing 144 to control opening and closing of the outlet opening 148. The flipper door 150 is mounted upon a shaft 152 extending through the tray 132. A spring 154 mounted on the shaft 152 engages the flipper door 150 to normally bias the door 150 to a closed position over the outlet opening 148. The shaft 152 can be turned by a solenoid (not shown) so as to move the flipper door 150 to an open position relative to the outlet opening 148, such that ice can be discharged from the tray 132 to the dispenser 20.

Front Cover Seal

A two-piece front cover 162 is provided on the bin assembly 130. A front cover 162 includes an inner panel 164 and an outer panel 166, as best seen in FIG. 23. Insulation is provided between the inner and outer panels 164, 166, such that the front cover 162 is insulated. The inner panel 164 mounts onto the front plate 146 of the bin assembly 130. A seal or compressible gasket 168 (FIG. 24) is provided around the outer perimeter front plate 146 so that when the bin assembly 130 is installed into the ice box 122, an air-tight seal is provided between the bin assembly 130 and the front opening 120 of the ice compartment 22. The seal 168 helps maintain the lower temperature of the ice making compartment 22, as compared to the higher temperature of the fresh food compartment 12.

The front cover 162 includes a latch mechanism for releasably locking the cover 162 to the ice compartment 22. The latch mechanism includes a lock bar 170 extending through a pair of collars 172 on the front plate 146 of the bin assembly 130 for lateral sliding movement between a locked and unlocked position. The lock bar 170 is normally biased to the locked position by a spring 174. A cam 176 is mounted on a peg 178 on the front plate 146 of the bin assembly 130 and is adapted to engage a flange or finger 180 on the end of the lock bar 170. The cam 176 overcomes the bias of the spring 74 when actuated by a finger button 182 mounted on the outer panel 166, so as to release the front cover 162 for removal of the bin assembly 130. Thus, the bin assembly 130 can be slid into the ice box 122 and retained with an air-tight seal to maintain the temperature of the ice compartment 22. A user can depress the button 182 on the bin assembly 130 to release the lock bar 170 for removal of the bin assembly 130 from the ice box 122.

Air Impingement

Figure 33:
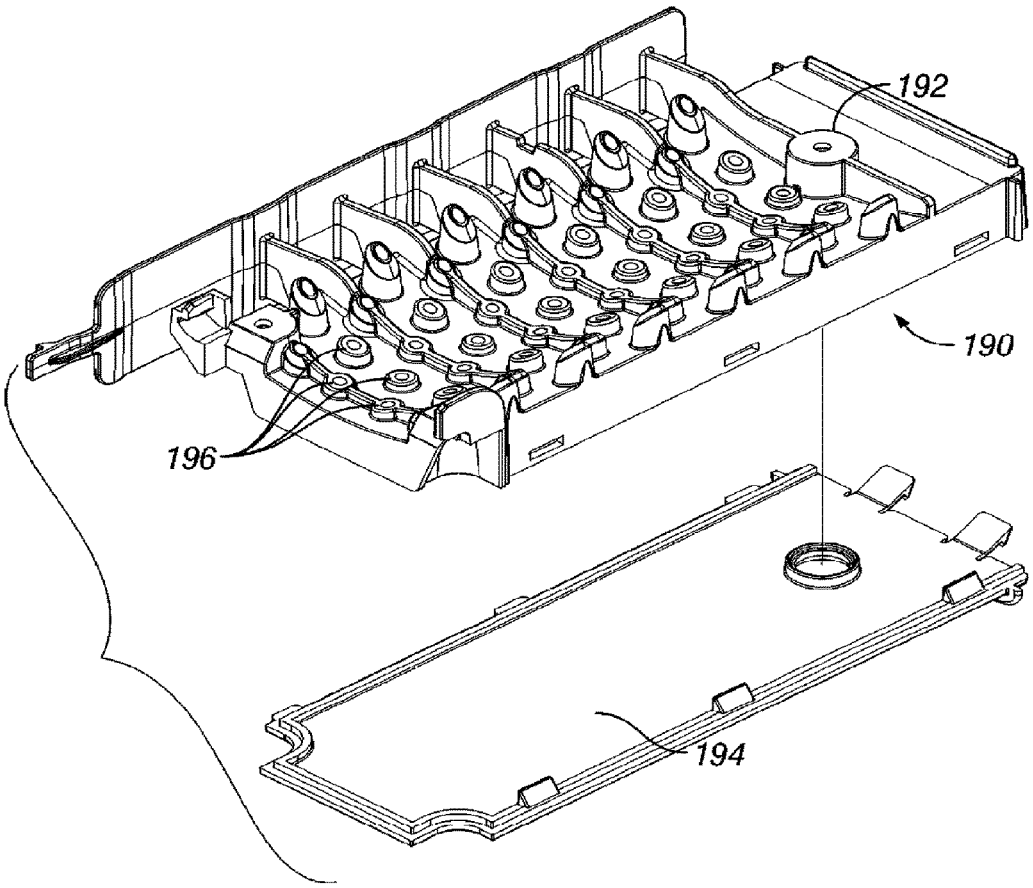
FIG. 33 is an exploded perspective view of the air impingement system of the present invention.
Figure 34:
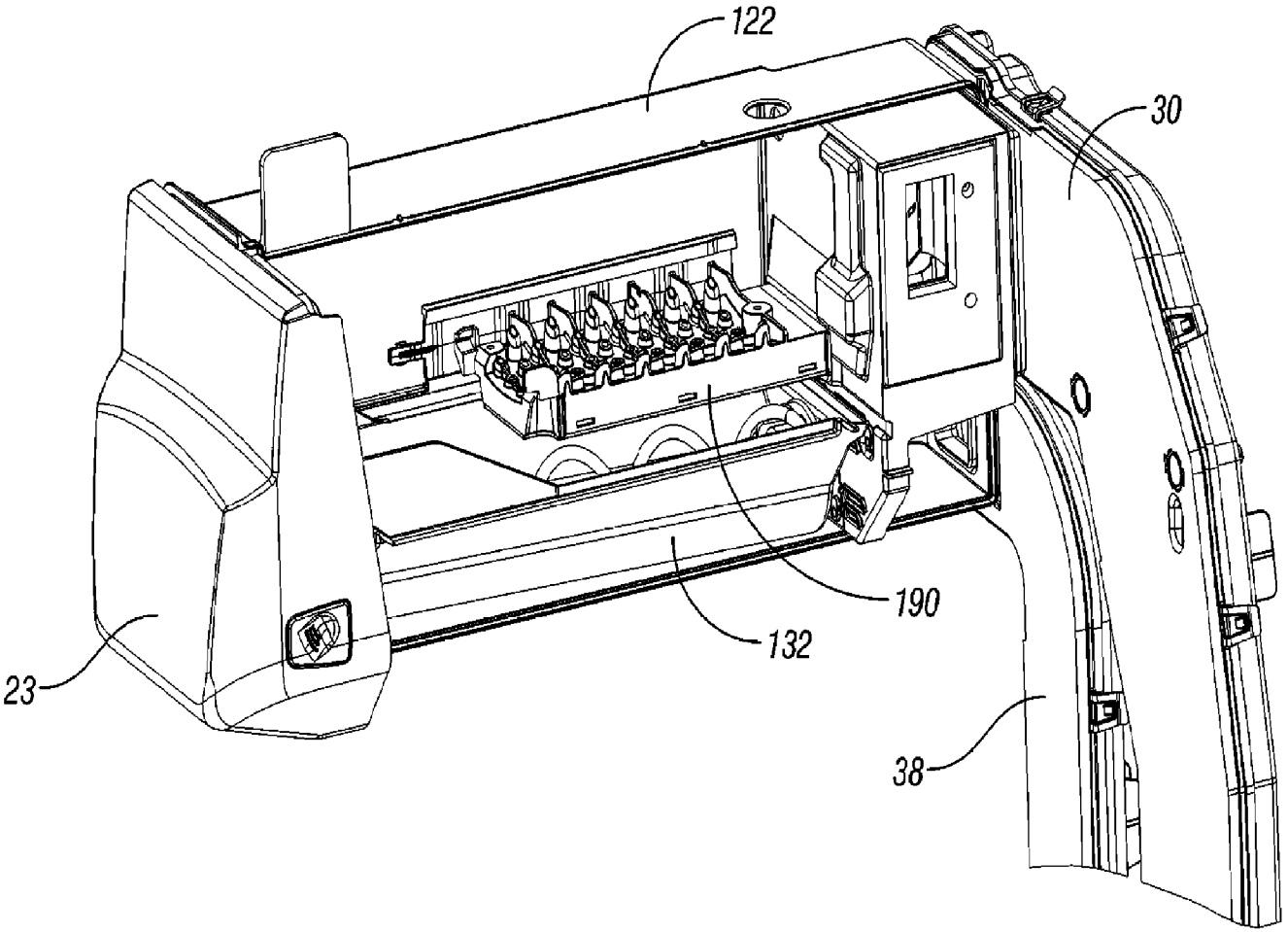
FIG. 34 is an assembled perspective view of the air impingement system in the ice box.
Figure 35:
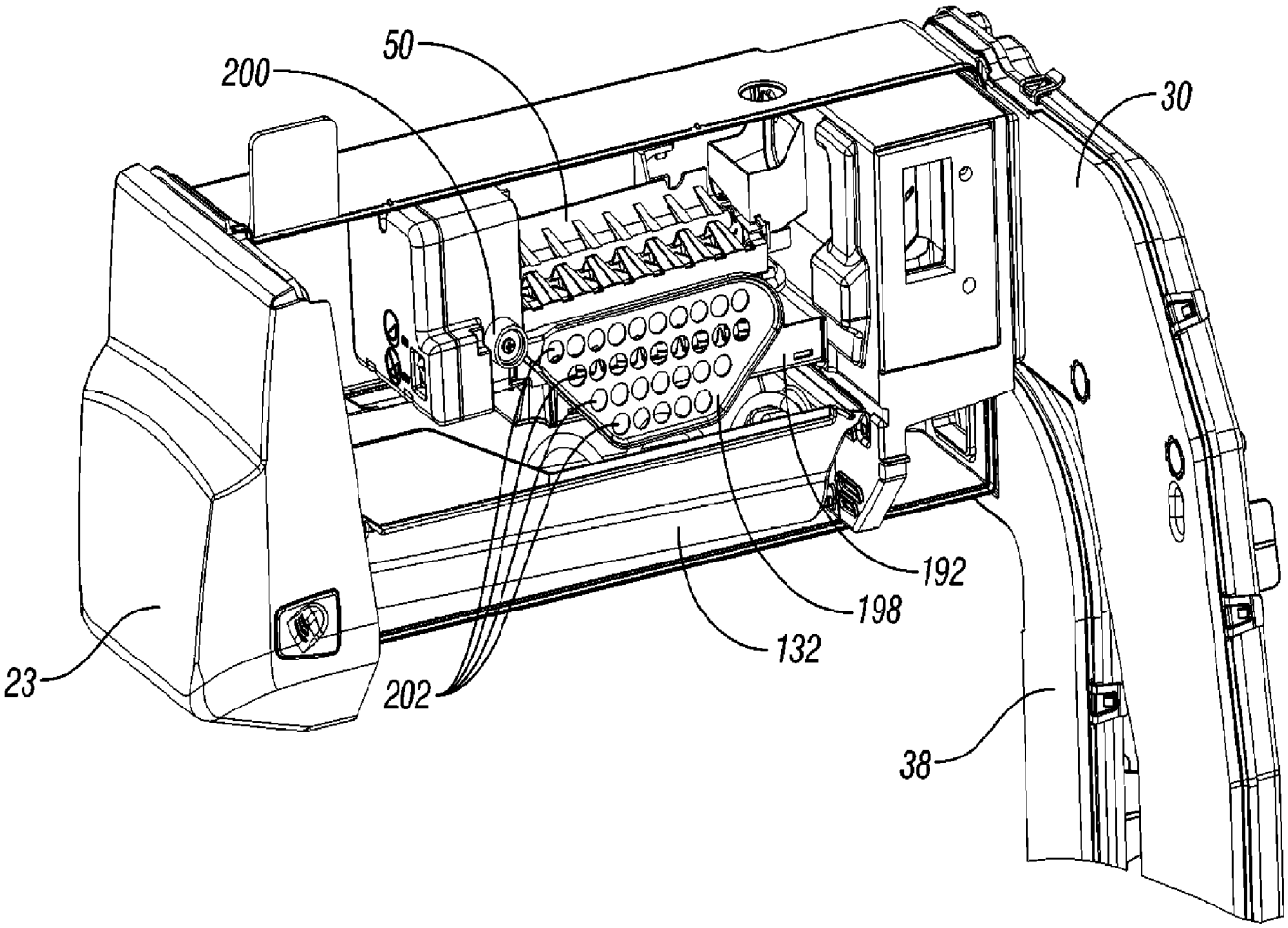
FIG. 35 is an assembled perspective view of the ice maker in the ice box.
Figure 36:
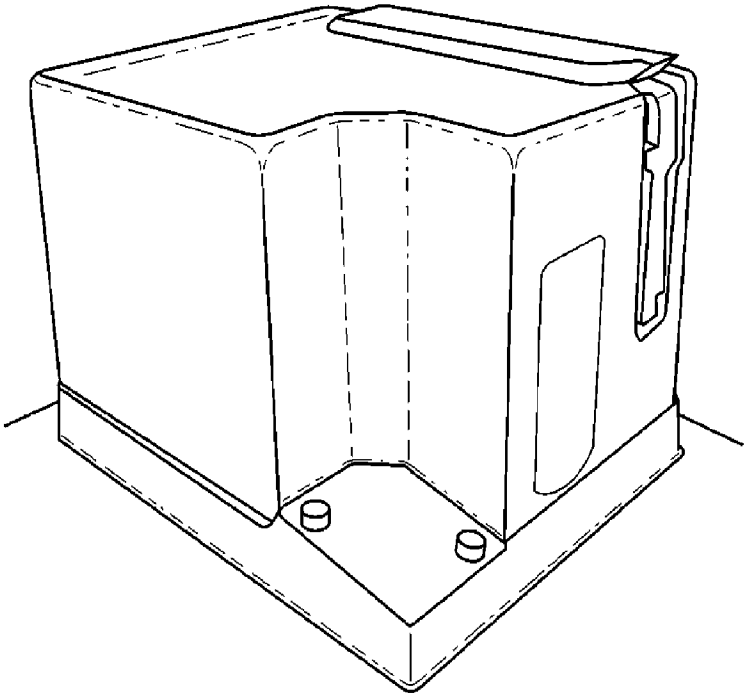
FIG. 36 is a view showing the male mold for forming the liner of the fresh food compartment according to the preferred embodiment of the present invention.

Another component of the ice maker 50 is an air impingement assembly 190, as shown in FIGS. 33-35. The impingement assembly 190 includes a manifold 192 and a bottom plate 194 which define an air plenum therebetween. The manifold 192 includes a plurality of holes or nozzles 196. The manifold 192 is operatively connected to the cold air duct 30 so the cold air from the freezer compartment 14 is directed into the manifold 192 by the fan 36, and through the impingement nozzles 196 onto the bottom of the mold of the ice maker 50, as best seen in FIG. 34.

The nozzles 196 are shown to be round, but may also be slotted, or any other shape. The nozzles 196 are preferably arranged in staggered rows. The diameter of the nozzles 196, the spacing between the nozzles 196, and the distance between the nozzles 196 and the ice mold are optimally designed to obtain the largest heat transfer coefficient for a prescribed air flow rate. For example, in a preferred embodiment, the nozzles 196 are round with a diameter of 0.2-0.25 inches, with a spacing of approximately 1.5 inches between adjacent nozzles, and a distance of 0.5-1.0 inches from the surface of the ice maker 50. The alignment of the nozzles 196 with the ice mold preferably avoids direct air impingement on the first two ice cube slots near the ice maker thermostat so as to avoid hollow ice production.

The air impingement assembly 190 speeds ice production by 2-3 times so as to meet large requirements of ice. The impingement assembly 190 is also compact so as to permit increased ice storage space in a larger sized tray 132.

Bale Plate

The ice maker 50 includes a bale plate 198 which shuts off the ice maker 50 when the level of ice cubes in the tray 132 reaches a pre-determined level. The plate 198 is pivotally connected to the ice maker 50 by a connector 200 at one end of the plate 198, as seen in FIG. 35. The plate 198 pivots in a vertical plane. The plate 198 is stronger than a conventional wire bale arm. The vertical orientation of the plate 198 prevents ice from hanging up on the plate, which happens with a wire bale arm. The plate includes a plurality of holes 202 to reduce weight and to improve air flow.

Water Valve and Tank Assembly

Prior art refrigerators with water and ice dispensers typically locate the water system components, such as tanks, valves, filter and tubing, throughout the refrigerator cabinet and base pan areas. This arrangement is prone to service calls to repair leaks and water restrictions due to the larger number of connections or fittings for the components. The multiple connections and various tubing lengths also add to manufacturing costs.

In the present invention, the water system is pre-assembled in a single module that can be quickly and easily installed. The module has less tubing runs and connections between components as compared to prior art water systems.

Figure 28:
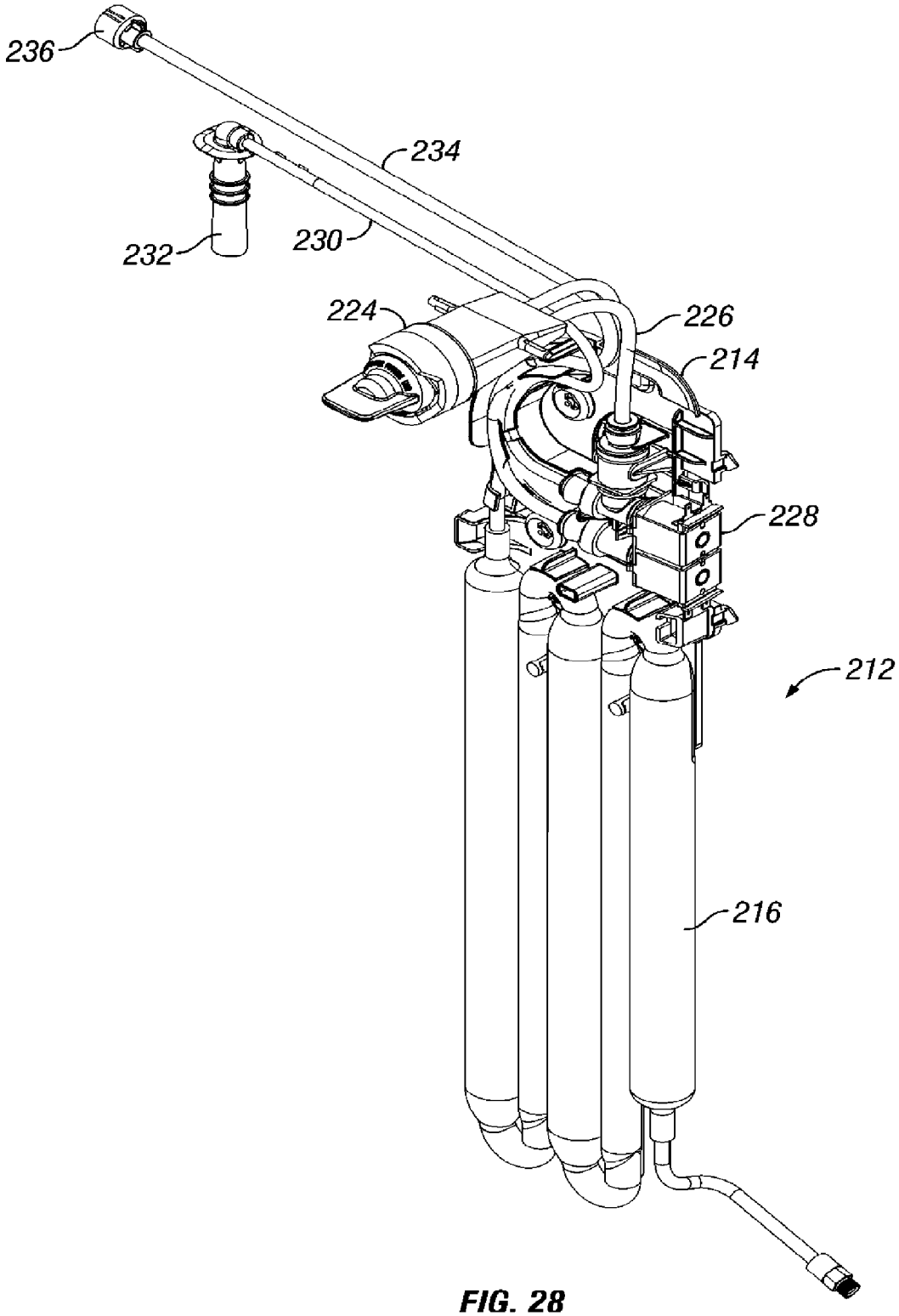
FIG. 28 is a perspective view of the water tank assembly of the present invention.
Figure 29:
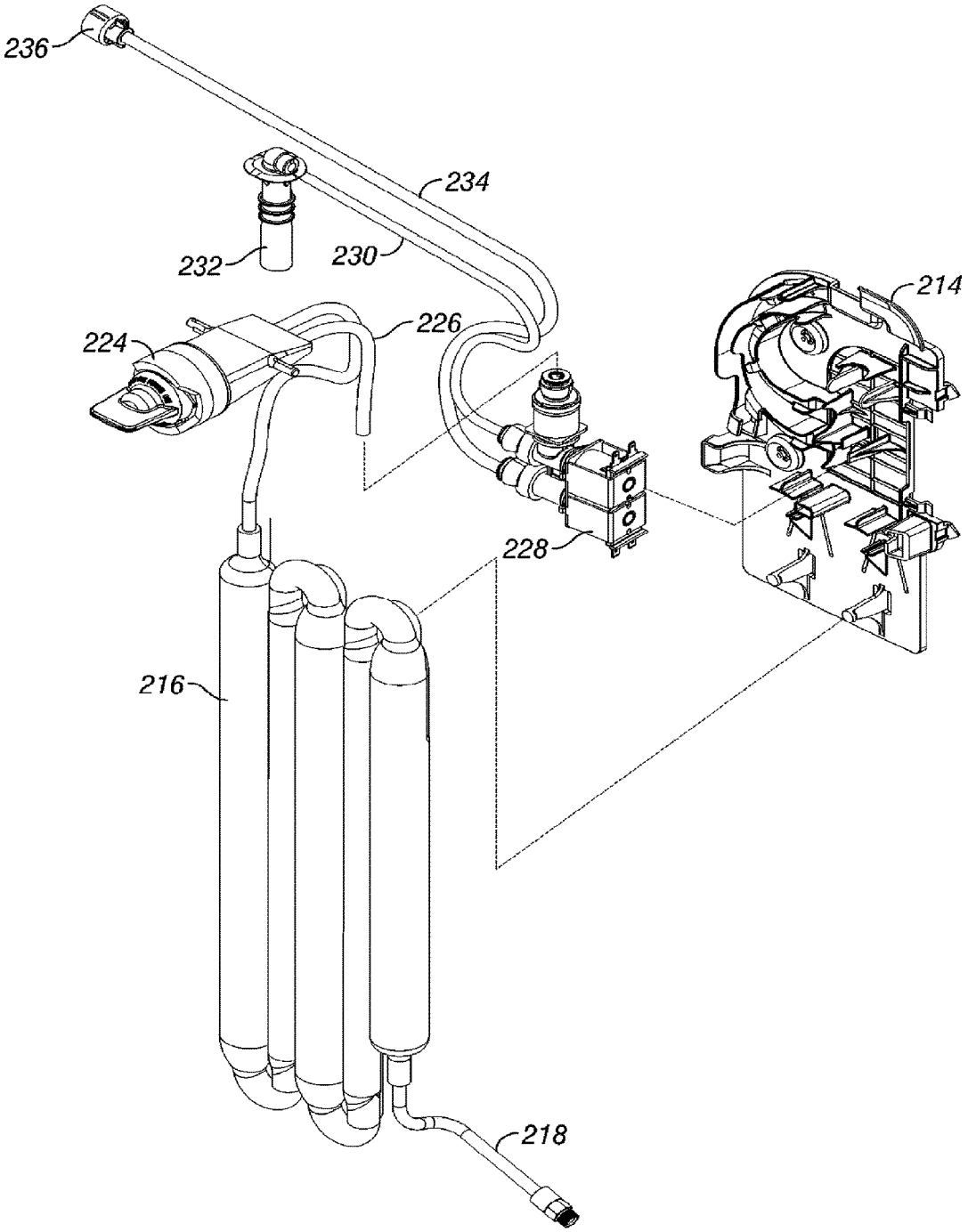
FIG. 29 is an exploded view of the water tank assembly of the present invention.

The fresh food compartment 12 includes a recess or cavity 210 in the rear wall adapted to receive a water valve and tank assembly 212. The water valve and tank assembly 212 is shown in FIGS. 28 and 29. The assembly 212 includes a mounting bracket 214 which is secured in the recess 212 in the back wall of the fresh food compartment 12 in any convenient manner. A water tank 216 is mounted on the bracket 214 and includes a water inlet line 218 and a water outlet line 220. A cover 222 attaches to the rear wall of the fresh food compartment 12 so as to hide the water tank 216 from view when the door 16 of the fresh food compartment 12 is opened.

The water inlet line 218 is connected to a conventional water supply line. The water outlet line 220 is operatively connected to a filter 224. Preferably, the filter 224 is pivotally mounted in the ceiling of the fresh food compartment 12, as disclosed in Applicant's co-pending application Ser. No. 10/195,659, entitled HINGE DOWN REFRIGERATOR WATER FILTER, filed Jul. 15, 2002, which is incorporated herein by reference.

The water filter 220 has an outlet line 226 which is connected to a water solenoid valve 228 mounted on the bracket 214. The valve 228 has a first outlet line 230 leading to the ice maker fill tube 232 and a second outlet line 234 leading to the water dispenser of the refrigerator 10. Line 234 has a fitting 236 which provides a quick connection with a simple ¼ turn, without threads to the water dispenser line in the door 16.

In prior art refrigerators, the water tank is normally located downstream of the water valve and filter, so as to prevent subjecting the water tank to inlet water supply pressures. In this invention, the tank 216 is designed to withstand inlet water supply pressures. The location of the tank 216 in the recess 210 allows greater fresh food storage capacity. Also, the location of the tank 216 upstream from the filter 224 and the valve 228 will reduce the service call rate. The downstream location of the filter 224 also removes plastic tastes associated with the plastic tank 216, and allows chlorinated water to be stored in the tank 216, which prevents microbiological growth on the interior of the water tank 216.

Water Fill Tube

Figure 30:
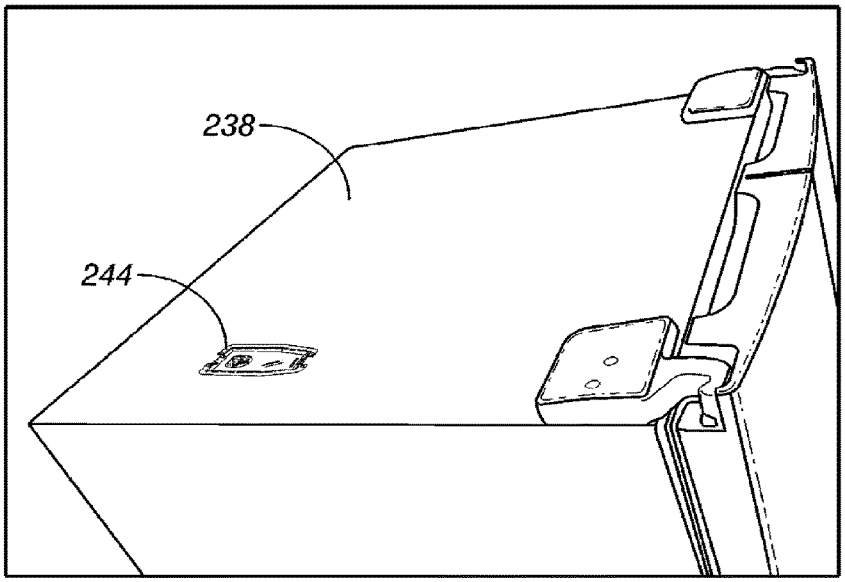
FIG. 30 is a perspective view showing the top of the refrigerator with the water fill tube cup mounted thereon.
Figure 31:
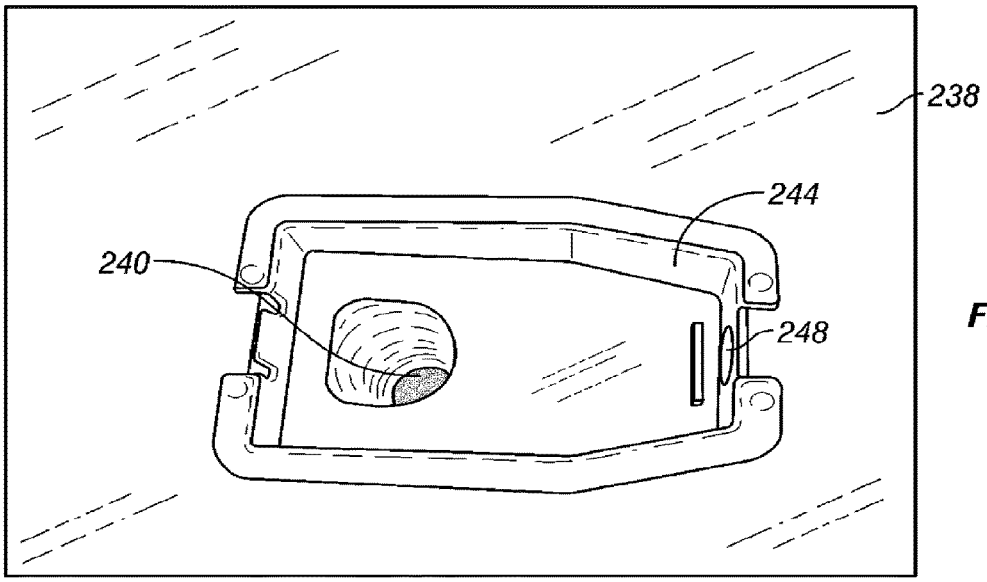
FIG. 31 is an enlarged view of the water tub fill cup showing the vertical hole through which the water fill tube extends.
Figure 32:
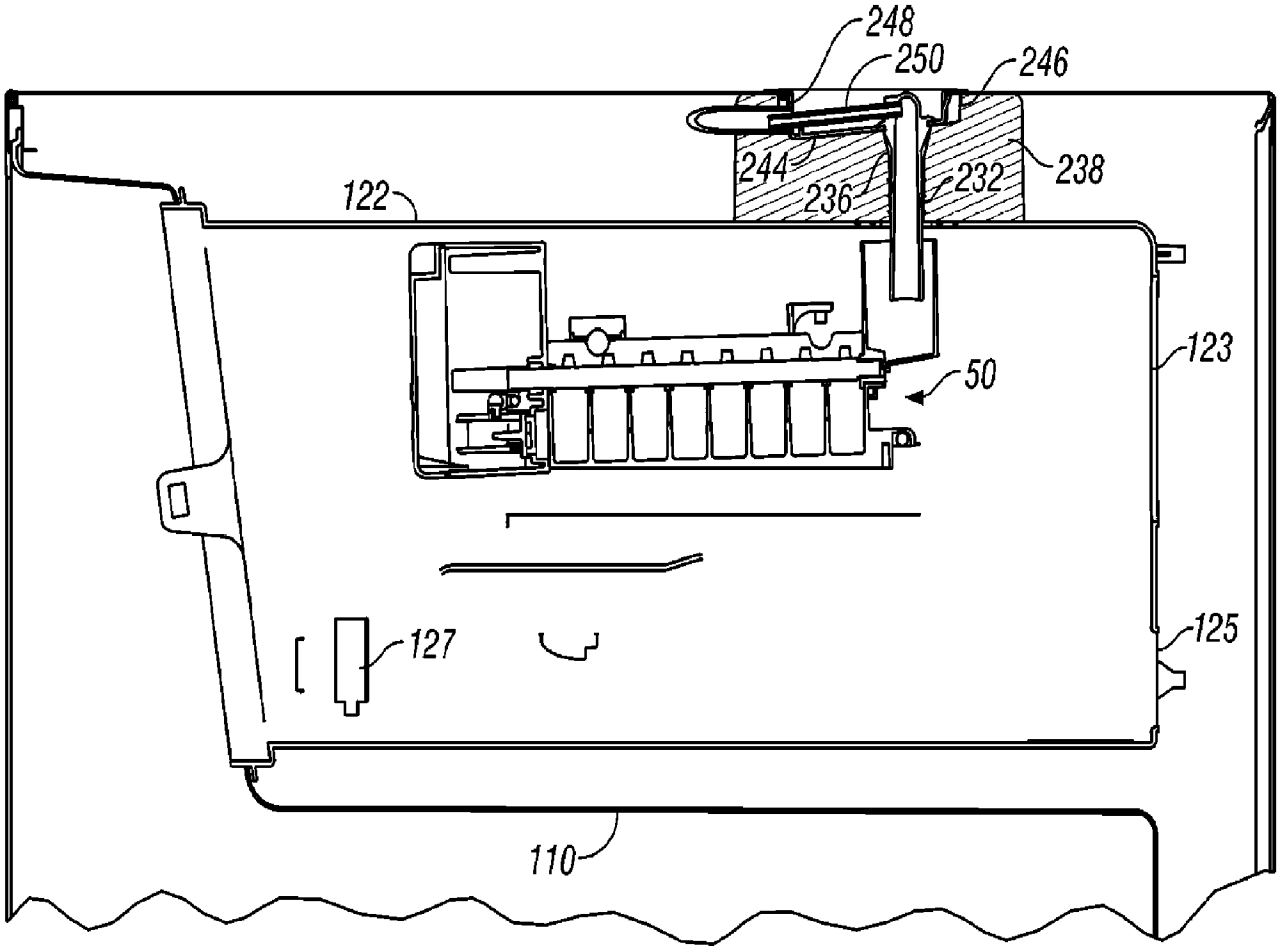
FIG. 32 is a sectional view taking along lines 32-32 of FIG. 31.

Prior art ice maker fill tubes are normally installed in the back of a freezer and run down a sloping tube to the ice maker. As seen in FIGS. 30-32, in the present invention the water fill tube 232 for the ice maker 50 extends downwardly through a vertically disposed hole 236 in the top wall 238 of the refrigerator 10. The fill tube 232 is installed from the top of the refrigerator 10 into a plastic cup 244 positioned within a recess 246 in the top wall 238. The fill tube 232 extends through the insulation in the top wall 238 and into the ice maker 50 in the ice making compartment 22. The water conduit 230 extends through the foam insulation in the top wall 238 and through an opening 248 in the cup 244 for connection to a nipple 250 on the fill tube 232. The nipple 250 is angled slightly upwardly to prevent dripping. The cup 238 is open at the top so as to expose the fill tube 232 to the ambient air, and thereby prevent freeze-up of the fill tube 232. This vertical orientation allows the fill tube 232 to be positioned closer to the end of the ice maker 50.

Easy Access Drawer

Figure 55:
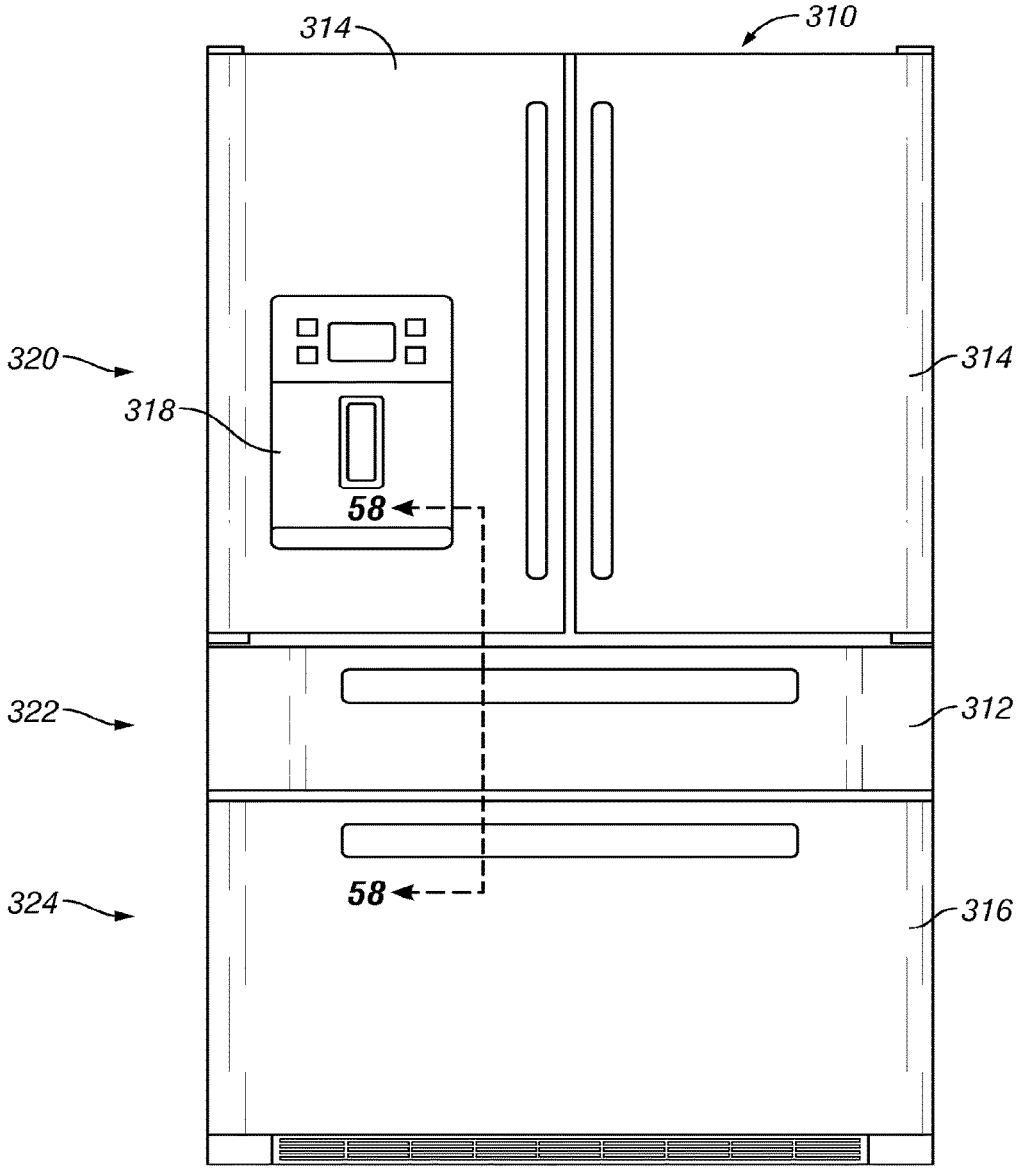
FIG. 55 is a front elevation view of a refrigerator according to one embodiment of the present invention that includes an easy access pantry door.

FIG. 55 shows a refrigerator 310 that includes an easy access drawer 312 according to one embodiment of the present invention. The drawer 312 makes it possible to access fresh food within the refrigerator 310 without the need to open the doors to the fresh food compartment.

With further reference to FIG. 55, it can be seen that the refrigerator 310 includes a fresh food compartment 320, a bottom mounted freezer compartment 324, and a pantry compartment 322 located between the fresh food compartment 320 and the freezer compartment 324. French doors 314 close and seal the fresh food compartment 320. A freezer compartment 324 is provided generally at the bottom portion of the refrigerator 310 and is covered by freezer cover 316 that can be part of a drawer that slides in and out of the refrigerator 310 to provide access to the contents of the freezer drawer. Alternatively, the freezer cover 316 could be hingedly attached to the refrigerator 310 to act as a door for the freezer compartment 324. A slide out drawer 312 seals and covers the pantry compartment 322, and is used to provide easy access to the contents of the pantry compartment 322. An ice dispenser 318 is provided in one of the refrigerator doors 314. Use of the easy access drawer 312 permits access to items within the pantry compartment 322, without the need for opening the refrigerator doors 314, and is especially advantageous in that it does not require the opening of the door 314 that includes the ice dispenser 318. Preferably the ice dispenser 318 will be operable when the drawer 312 is opened to permit ice to be dispensed even while accessing items in the drawer 312.

Figure 56:
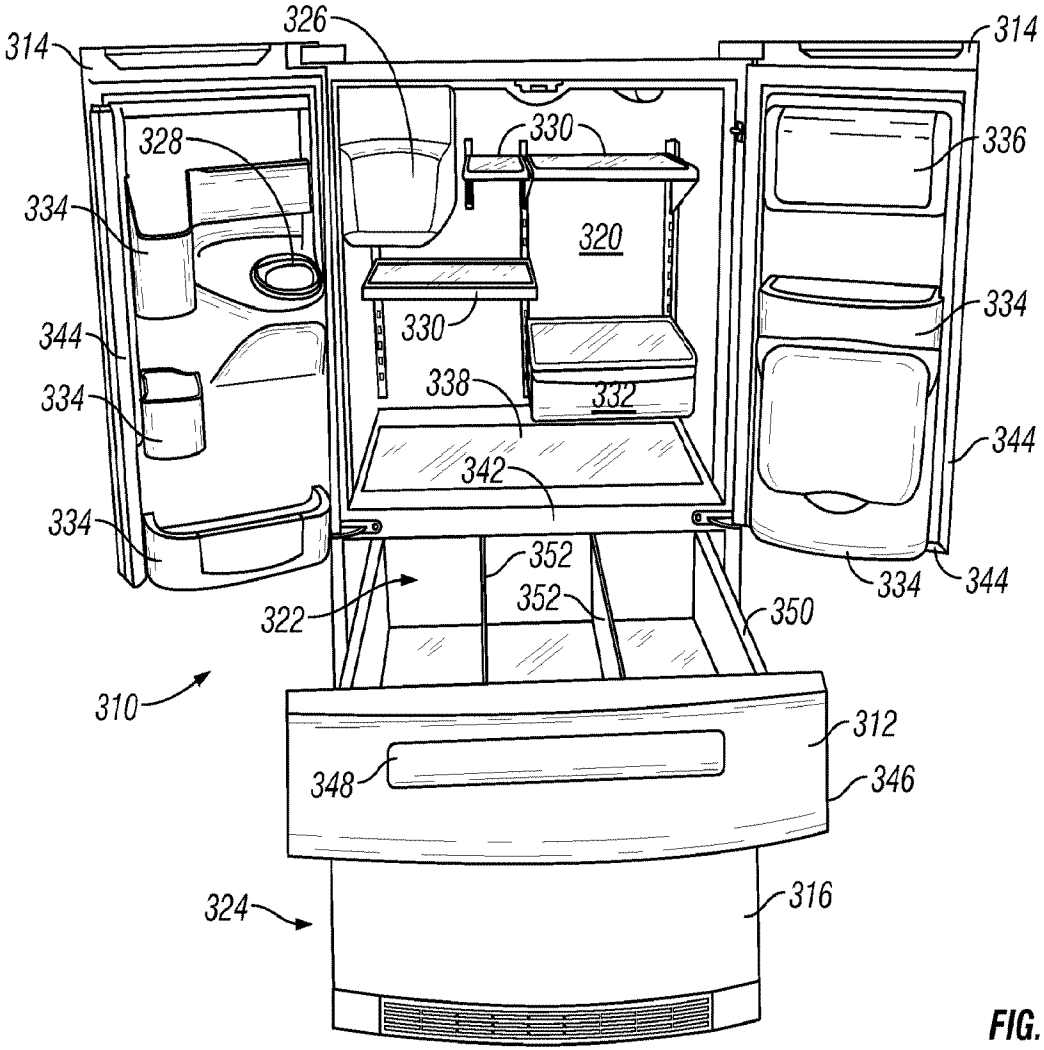
FIG. 56 is a front perspective view of the refrigerator of FIG. 55 with the doors to the fresh food compartment opened and the easy access pantry drawer pulled to an opened configuration.

FIG. 56 shows the refrigerator 310 of FIG. 55 with the fresh food doors 314 opened and the easy access drawer 312 pulled open. With the doors 314 open, the fresh food compartment 320 is accessible. In the preferred embodiment shown in FIG. 56 an ice compartment 326, according to the description generally above, is provided for making, storing, and dispensing ice. One of the doors 314 includes an ice chute 328 that is in communication with the ice compartment 326 when the door 314 is closed in order for the ice to move from the ice compartment 326 to the ice dispensing area 318 on the outside of the door 314. The fresh food compartment 320 may include shelves 330 and a crisper basket 332. The fresh food compartment doors 314 may have formed on their interior portion various door racks 334 and a butter keeper 336.

The pantry compartment 322 is provided below the fresh food compartment 320. A bottom shelf 338 acts as the barrier between the fresh food compartment 320 and the pantry compartment 322. The bottom shelf 338 is preferably formed from a transparent material, such as glass so that the contents of the pantry drawer 312 will be visible from the fresh food compartment 322 when the fresh food doors 314 are in the open position of FIG. 56, even if the drawer 312 is closed. A support ledge 340 (see FIG. 58) is provided along the interior surface of the refrigerator liner to support the shelf 338. A secondary mullion 342 spans between the side walls of the liner of the refrigerator 310 to provide support for the front portion of the shelf 338, and to provide a surface for sealing the doors 314 and the drawer 312 when closed. The doors 314 are provided with gaskets 344 for sealing the doors 314 with each other, and with the refrigerator cabinet.

The drawer 312 may include an insulated outer cover 346, which is preferably provided with a handle 348 that can be used for grabbing and pulling the drawer 312 open. The handle 348 may be any formation that is suitable for a user to grab and pull in order to open the drawer 312. For example, the handle 348 may be a separate piece attached to the cover 346, or may be integrally formed as part of the cover 346 as shown in the drawings. The drawer 312 includes a basket portion 350 into which food items may be placed. Preferably the basket 350 will include dividers 352 to subdivide the basket 350 into individual compartments. The dividers 352 may be removable, to form compartments of various sizes, or to permit the entire basket 350 to be undivided. Alternatively, the dividers 352 may be formed integrally with the drawer basket 350 to be permanent. According to another alternative, the dividers 352 may be small ribs that provide additional structural support to the basket 350. Preferably the basket 350 will be formed from a transparent material, such as hard plastic, Plexiglas, or the like.

Figure 57:
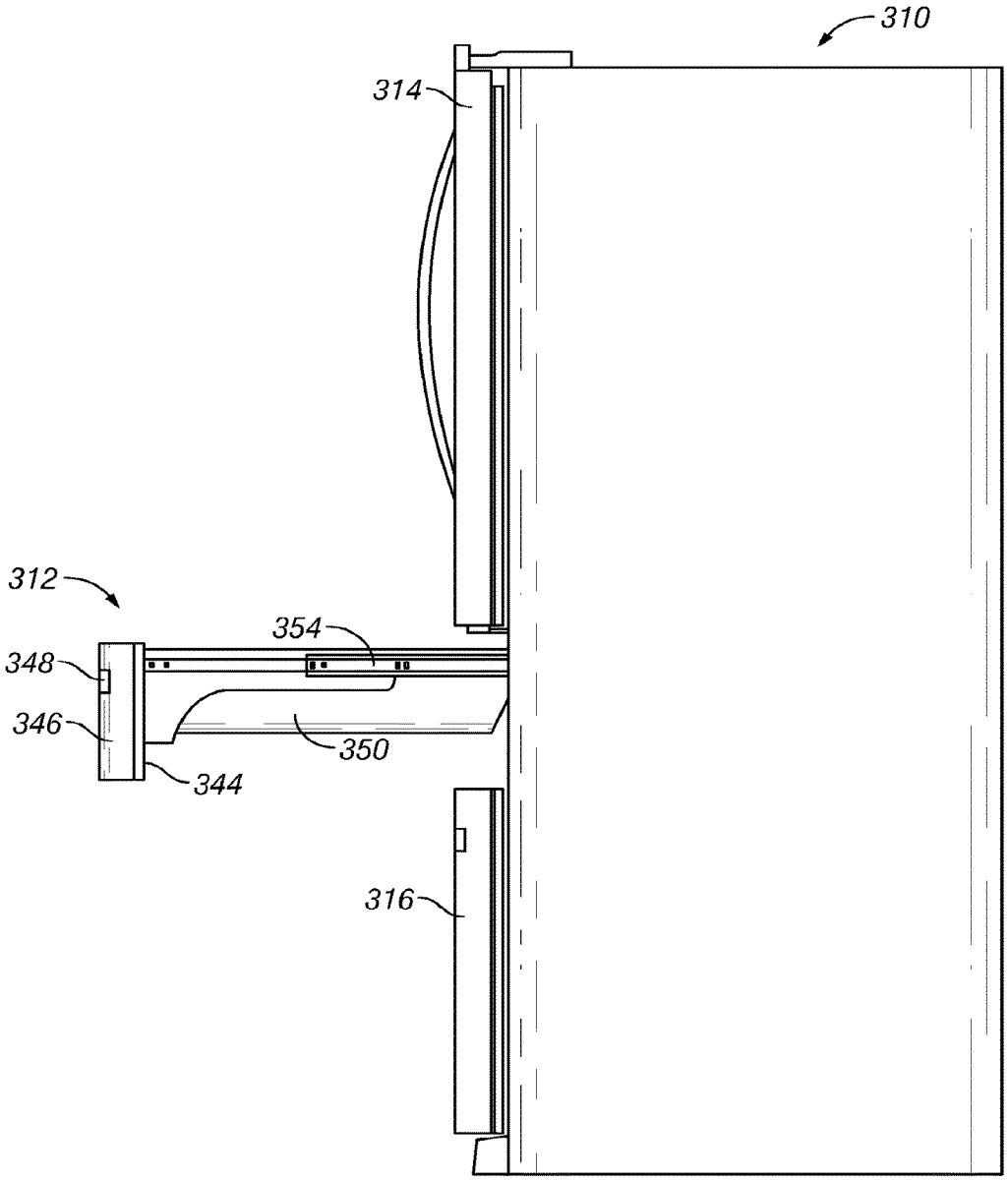
FIG. 57 is a side elevation view of the refrigerator of FIG. 55 with the pantry drawer pulled to an open configuration.

FIG. 57 shows the refrigerator according to FIG. 55 with the drawer 312 pulled out of the refrigerator into an open configuration. In this configuration the user has easy access to the contents of the basket 350. Preferably the top of the drawer 312 will be at about the same height as a standard kitchen counter to provide for ease and convenience of moving contents from the basket 350 to the counter, and from the counter to the basket 350. Therefore, the preferred height for the top of the drawer 312 is about 36", and preferably in the range of 34-38" off the floor. The drawer 312 may be mounted to the refrigerator cabinets using standard hardware, such as rack and pinion sliders 354 to permit the drawer 312 to easily slide in and out of the refrigerator. Other known hardware or configurations that permit the drawer 312 to slide in and out of a cabinet may be used. Preferably the drawer 312 is provided with a mechanism for closing the drawer 312 in a tight sealed configuration once the drawer is brought in close proximity to the closed position. Such mechanisms for closing drawers are well known, and the particular mechanism used is not shown in the drawings. The preferred mechanism (not shown) uses an over-center spring mechanism that will be known to those of skill in the art. Preferably when the drawer 312 is adjusted to the open configuration of FIG. 57, a light source (not visible in FIG. 57, see FIG. 58) will be activated to illuminate the contents of the basket 350.

Figure 58:
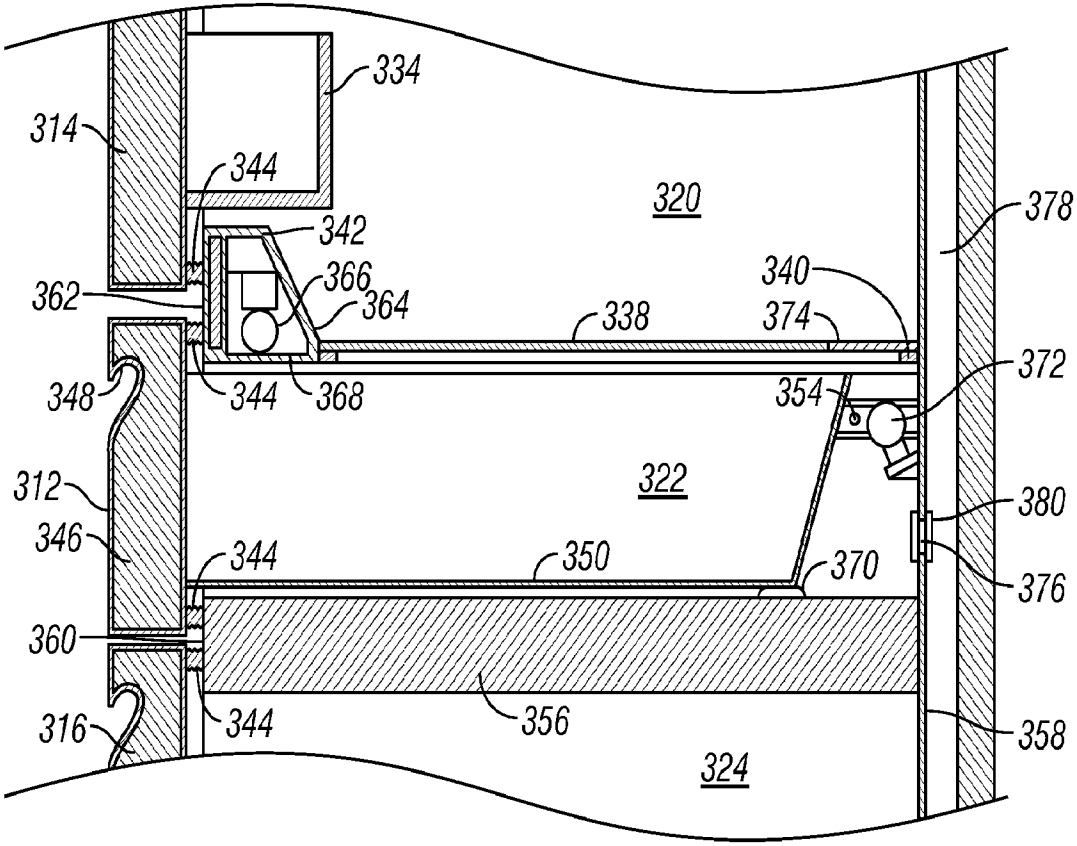
FIG. 58 is a partial cross section view of the refrigerator of FIG. 55 showing the pantry drawer within the pantry compartment of the refrigerator.
Figure 59:
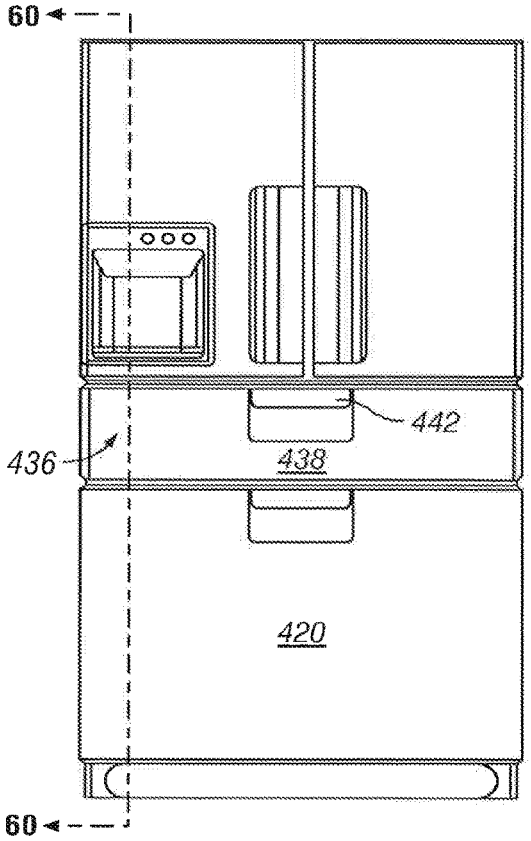
FIG. 59 is a front view of an embodiment of a bottom mount refrigerator according to the present invention including a pantry drawer.
Figure 60:
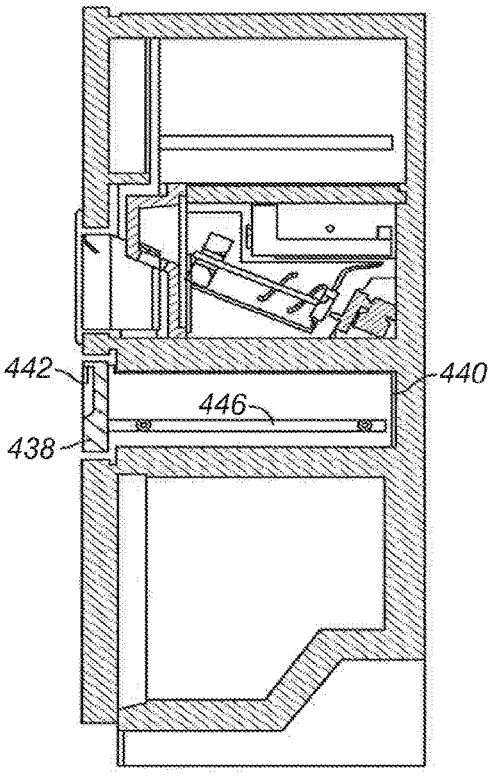
FIG. 60 is a cross-sectional view of an embodiment of a bottom mount refrigerator according to the present invention including a pantry drawer.

FIG. 58 is a partial cross sectional view taken along line 58-58 of FIG. 55 that generally shows the drawer 312 in a closed configuration within the pantry compartment 322. An insulated divider wall 356 is provided integrally with the liner 358 of the refrigerator to separate and insulate the pantry compartment 322 from the freezer compartment 324. Typically the freezer compartment 324 will be maintained at about 0° F. Typically the pantry compartment will be kept at or about 32° F.; though the temperature may be varied and adjusted as described below. The fresh food compartment 320 will typically be maintained within the temperature range of 35-40° F. The drawer 312 includes gaskets 344 that seal against a front face 360 of the divider wall 356 and a front face 362 of the secondary mullion 342.

The secondary mullion 342 includes a sloped rear face 364. The glass shelf 338 is provided generally at the lower end of the sloped rear face 364 to provide a divide between the fresh food compartment 320 and the pantry compartment 322. The glass shelf 338 is supported on the ledge 340 provided on the interior of the refrigerator liner 358 and on a rearward facing surface of the secondary mullion 342. It should be appreciated that while the shelf 338 is preferably made of glass or other transparent material to permit viewing of the contents of the basket 350 when the drawer 312 is closed but the fresh food doors 314 are opened, most of the advantages of the present invention would be realized with an opaque or translucent shelf 338. Also, while a water tight seal may be formed between the shelf 338 and the liner 358, it is generally not necessary or preferred to provide such a seal. It may be desirable to provide a lip, or other structure around the periphery of the shelf 338 in order to contain spills. Alternatively, it may be desired to slope the shelf 338 slightly towards the front of the refrigerator so that spills are directed away from the electrical components at the rear of the refrigerator.

Preferably the secondary mullion 342 will be insulated at its front portion. A light 366 may be provided within the secondary mullion 342. It may be desirable to provide a plurality of such lights 366, typically about three, spaced apart in the secondary mullion 342, in order to at least partially illuminate contents of the basket 350. The lights 366 may be small incandescent lights, such as 40 watt bulbs, or may be light emitting diodes in order to reduce energy consumption and heat generation. It may be desirable to include a diffuser 368 along the bottom of the secondary mullion 342 in order to diffuse and soften the light emitted by the lights 366. Preferably the light 366 will be controlled by a switch 370 that is switched to an off, or opened position, when the drawer 312 is fully inserted into the pantry compartment 322. When the drawer 312 is withdrawn from the pantry compartment 322 it releases switch 370 to a closed, or on, position which activates light 366, in order to illuminate the contents of the basket 350. The mullion lights 366 may also be attached to a switch (not shown) to be activated when the fresh food doors 314 are opened, especially when a transparent shelf 338 is used to permit viewing of the contents of the basket 350 without opening the drawer 312.

A rear light 372 is provided at the rear of the pantry compartment 322 and is configured to shine generally forwardly and upwardly. The rear light 372 may include a plurality of lights, preferably at least three spaced apart across the rear of the pantry compartment 322. The rear lights 372 may be incandescent bulbs, or may be light emitting diodes. The rear lights 372 are adapted to shine generally upwardly through the glass shelf 338 and a diffuser 374 provided at the rear portion of the shelf 338. The rear lights 372 provide illumination for the fresh food compartment 320, as well as providing some illumination for the pantry compartment 322 through the rear wall of the basket 350 and through reflected light passing through shelf 338. Preferably the rear lights 372 will be connected to a switch (not shown) that illuminates the fresh food compartment 320 when one or both of the fresh food compartment doors 314 are opened.

Cold air may be introduced into the pantry compartment 322 through an opening 376 formed in liner 358 at the rear of the pantry compartment 322 that leads to cold air duct 378. A louver 380, or other control mechanisms, may be provided in association with the opening 376 to provide some control over the flow of cold air from the air duct 378 into the pantry compartment 322. According to the embodiment shown, the louver is a simple sliding mechanical device that can partially or completely cover the opening 376. The louver 380 may optionally have three settings: an open setting to permit a maximum flow of air from the air duct 378 to the pantry compartment 322; a partially closed configuration to permit some flow of air from the cold air duct 378 into the pantry compartment 322; and a closed configuration to substantially or completely block flow of air between the cold air duct 378 and the pantry compartment 322. The fully opened configuration may correspond to a setting for meat, the partially open configuration may correspond to storing vegetables within the basket 350, and the fully closed position may correspond to storing fruits within the basket 350. While not shown, it may be desirable to provide ventilation holes, for example through the sloped face 364 of the secondary mullion 342, to permit flow of air from the pantry compartment 322 into the fresh food compartment 320. Also, while not shown, it is preferred that the louver 380 be mechanically attached to a control, or selection device, in order to set the louver in the open, partially closed, or fully closed configurations. Those of ordinary skill in the art will be aware of several acceptable mechanical connections.

It is contemplated that the pantry compartment 322 could be subdivided into individual pantry compartments (not shown) with each individual compartment having their own corresponding opening to the cold air duct 378, in order to maintain the various individual pantry compartments at different temperatures. The pantry compartment 322 may be provided with a sensor (not shown) that is electrically connected to the electronic control system described herein, and the louver 380 could be replaced with an electrically controlled mechanism, such as a damper, for permitting the electronic control system to monitor and maintain the desired temperature within the pantry compartment 322.

A refrigerator according to another embodiment of the present invention is shown in FIGS. 59-63. A pantry or crisper drawer 436 is accessible without the need to open the fresh food compartment door(s) 418 and/or 420. Preferably, the pantry drawer 436 is a refrigerated compartment maintained at a temperature range of about 32-40 degrees Fahrenheit. An insulated divider wall 416 separates the freezer compartment 412 from the pantry drawer 436 and separates the pantry drawer 436 from the fresh food compartment 414. Preferably, a pair of sliding supports 446, such as the brackets used commonly for cabinet drawers, are mounted to the walls of the insulated cabinet 411 and slideably connect to the side of the pantry drawer 436. A front insulated surface 438, similar to the construction of the refrigerator doors 418 and 420 is secured to a drawer body 440. The front insulated surface 438 is preferably provided with gaskets (not shown) or similar features around the periphery to provide a relatively airtight seal with the cabinet 411 and divider wall 416/insulated cabinet 411. The drawer body 440 is preferably made from a stiff molded plastic, but can be constructed of any suitable material. A handle 442 is preferably mounted to the outside portion of the front insulated surface 438.

The pantry drawer 436 eliminates the need to access the interior of the refrigerator compartment by first opening the refrigerator doors 418 and/or 420. Because the opening of the pantry drawer 436 is not dependant on first opening the refrigerator doors 418 and/or 420, the pantry drawer 436 can be fully extended to retrieve and/or add contents regardless of the usable range of motion of the refrigerator doors 418 and/or 420. This also saves the consumer time.

While shown as a single drawer 436, the pantry drawer 436 may include one or more dividers or other organizational features, such as racks, can or bottle supports, etc. to accommodate the items the consumer desires to store in the pantry drawer 436. The pantry drawer 436 may also be separated into two or more drawers, each with customizable temperature settings. For example, an air duct may be used to route air from the area around the evaporator to the one or more pantry drawers 436. This air duct may terminate in an adjustable vent. The adjustable vent may be either hand operated, such as a slideable vent cover, or electronically controlled by an electronic damper or other suitable mechanism. The adjustable vent allows air to flow into an opening in the pantry drawer 436. In this manner, the consumer can vary the temperature within the pantry drawer 436 to suit their needs.

Figure 61:
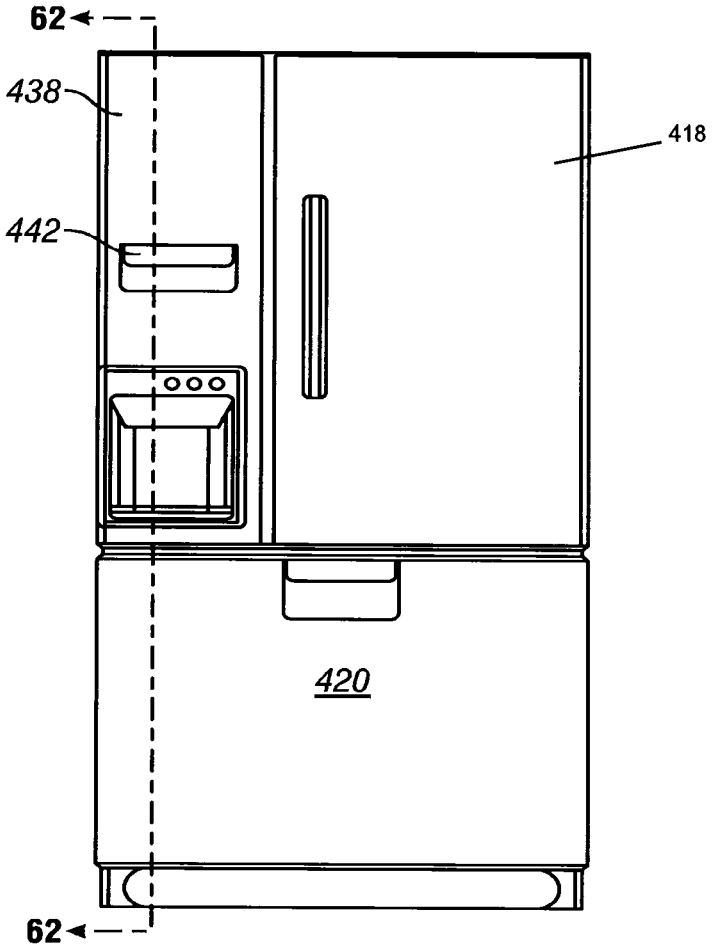
FIG. 61 is a front view of an embodiment of a bottom mount refrigerator according to the present invention including a shelf-style pantry drawer.
Figure 62:
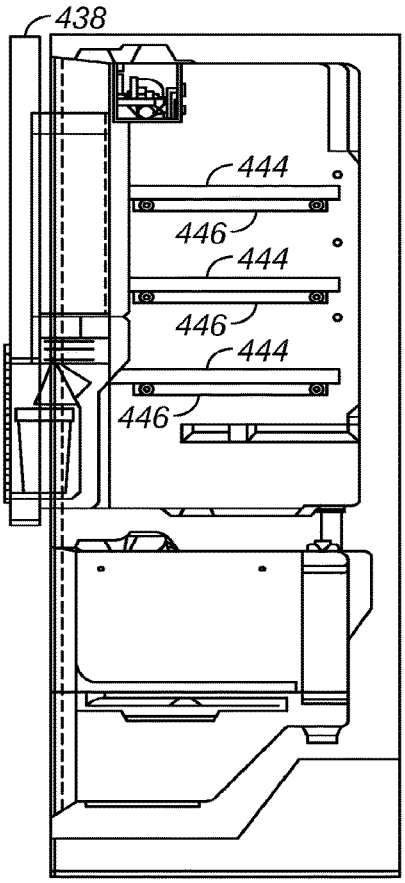
FIG. 62 is a cross-sectional view of an embodiment of a bottom mount refrigerator according to the present invention including a shelf-style pantry drawer in the closed position.
Figure 63:
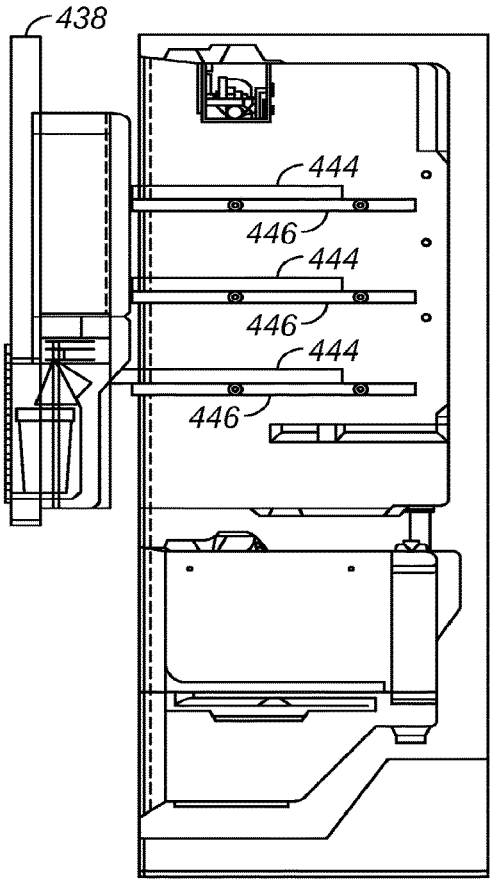
FIG. 63 is a cross-sectional view of an embodiment of a bottom mount refrigerator according to the present invention including a shelf-style pantry drawer in the open position.

Alternatively, as shown in FIGS. 61-63, the pantry drawer 436 may be included beside the fresh food compartment 414. In this arrangement, the pantry drawer 436 includes a space for the ice compartment 424, which is constructed as discussed above. The pantry drawer 436 would again allow the customer to store foods at a refrigeration temperature while still having an ice and water dispensing area 422. The pantry drawer 436 includes an insulated front 438 secured to one or more shelves 444. The insulated front 438 is secured to a plurality of sliding supports 446, such as the brackets used for mounting cabinets. These brackets may also be mounted to the shelves 444 which would then support the insulated front 438. In the alternative, the shelves 444 can be mounted on separately slideable supports. For example, the shelves 444 can have either a plastic-on-plastic sliding support, an integrated wheel that slides upon a track mounted in the surrounding cabinet wall 411, or a cabinet style bracket. In the arrangement shown, the pantry drawer 436 is also secured to the ice storage container 434. As the pantry drawer 436 is extended, the shelves 444 slide out, exposing the shelves 444 and their contents for easy access.

Control System Details

Figure 40:
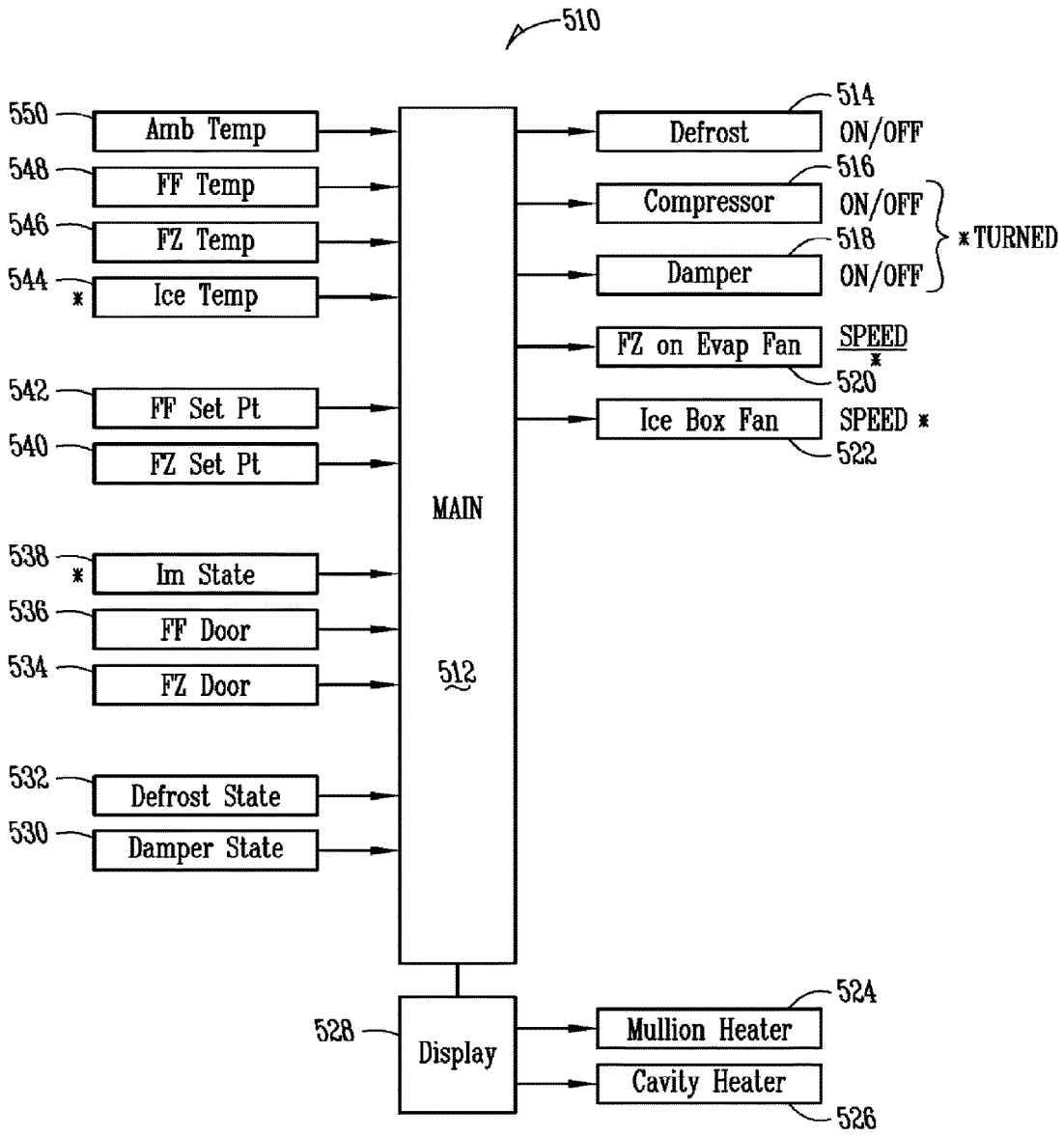
FIG. 40 is a block diagram of one embodiment of a control system according to the present invention.

FIG. 40 illustrates one embodiment of a control system of the present invention suitable for use in a refrigerator having three refrigerated compartments, namely the freezer compartment, the fresh food compartment, and the ice making compartment. The three compartments are preferably able to be set by the user to prescribed set temperatures.

In FIG. 40, a control system 510 includes an intelligent control 512 which functions as a main controller. The present invention contemplates that the control system 510 can include a plurality of networked or otherwise connected microcontrollers. The intelligent control 512 can be a microcontroller, microprocessor, or other type of intelligent control.

Inputs into the intelligent control 512 are generally shown on the left side and outputs from the intelligent control 512 are generally shown on the right side. Circuitry such as relays, transistor switches, and other interface circuitry is not shown, but would be apparent to one skilled in the art based on the requirements of the particular intelligent control used and the particular devices being interfaced with the intelligent control. The intelligent control 512 is electrically connected to a defrost heater 514 and provides for turning the defrost heater on or off. The intelligent control 512 is also electrically connected to a compressor 516 and provides for turning the compressor 516 on or off. The intelligent control 512 is also electrically connected to a damper 518 and provides for opening or closing the damper 518. The intelligent control 512 is also electrically connected to an evaporator fan 520 associated with the freezer compartment and provides for controlling the speed of the evaporator fan 520. Of course, this includes setting the evaporation fan 520 to a speed of zero which is the same as turning the evaporator fan 520 off. The use of a variable speed fan control is advantageous as in the preferred embodiment, the fan is serving an increased number of compartments with more states (freezer, fresh food, ice maker) and the ice compartment is remote from the freezer compartment.

The intelligent control 512 is electrically connected to an ice box fan 522 and provides for controlling the speed of the ice box fan 522. Of course, this includes setting the ice box fan 522 to a speed of zero which is the same as turning the ice box fan 522 off.

The intelligent control 512 also receives state information regarding a plurality of inputs. For example, the intelligent control 512 has a damper state input 530 for monitoring the state of the damper. The intelligent control 512 also has a defrost state input 532 for monitoring the state of the defrost. The intelligent control 512 also has a freezer door input 534 for monitoring whether the freezer door is open or closed. The intelligent control 512 also has a fresh food compartment door input 536 for monitoring whether the fresh food compartment door is open or closed. The intelligent control 512 also has an ice maker state input 538 for monitoring the state of the ice maker. The intelligent control 512 has a freezer set point input 540 for determining the temperature at which the freezer is set by a user. The intelligent control 512 also has a fresh food compartment set point input 542 for determining the temperature at which the fresh food compartment is set by a user. The intelligent control 512 is also electrically connected to four temperature sensors. Thus, the intelligent control 512 has an ice maker temperature input 544, a freezer compartment temperature input 546, a fresh food compartment input 548, and an ambient temperature input 550. The use of four separate temperature inputs is used to assist in providing improved control over refrigerator functions and increased energy efficiency. It is observed that the use of four temperature sensors allows the ice maker temperature, freezer compartment temperature, fresh food compartment temperature, and ambient temperature to all be independently monitored. Thus, for example, temperature of the ice box which is located remotely from the freezer can be independently monitored.

The intelligent control 510 is also electrically connected to a display control 528, such as through a network interface. The display control 528 is also electrically connected to a mullion heater 524 to turn the mullion heater 524 on and off. Usually a refrigerator has a low wattage heater to supply heat to where freezing temperatures are not desired. Typically these heaters are 120 volt AC resistive wires. Due to the fact that these heaters are merely low wattage heaters, conventionally such heaters remain always on. The present invention uses a DC mullion heater and is adapted to control the DC mullion heater to improve overall energy efficiency of the refrigerator and increase safety.

The display control 528 is also electrically connected to a cavity heater 526 for turning the cavity heater 526 on and off. The display control 528 is preferably located within the door and is also associated with water and ice dispensement. Usually a refrigerator with a dispenser with a display on the door will also have an associated heater on the door in order to keep moisture away from the electronics of the dispenser. Conventionally, this heater is continuously on.

It is to be observed that the control system 510 has a number of inputs and outputs that are not of conventional design that are used in the control of the refrigerator. In addition, the control system 510 includes algorithms for monitoring and control of various algorithms. The algorithms used, preferably provide for increased efficiency while still maintaining appropriate temperatures in the ice maker, fresh food compartment, and freezer.

Figure 41:
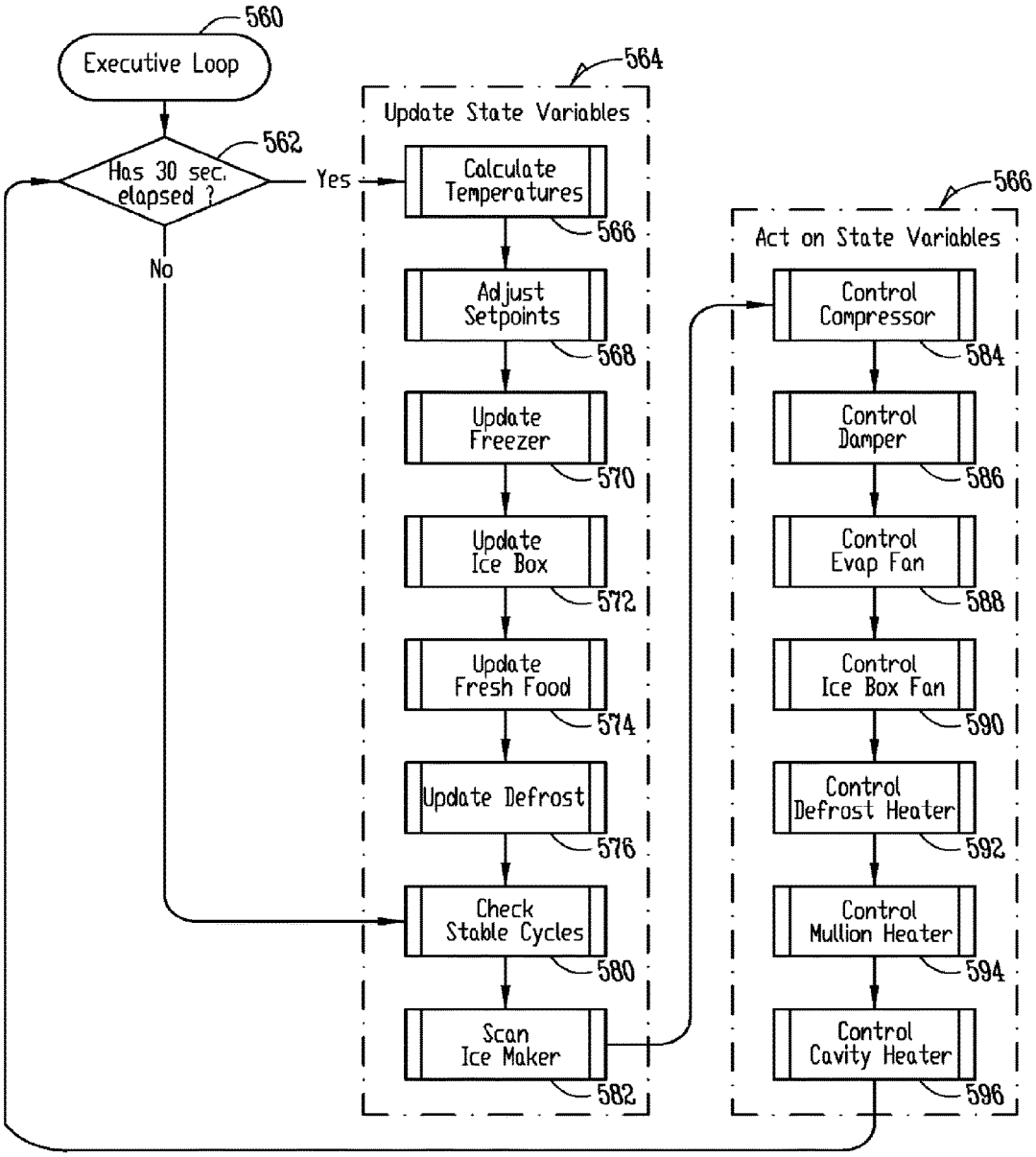
FIG. 41 is a flow diagram of an executive loop according to one embodiment of the present invention.

FIGS. 41-54 provide an exemplary embodiment of the present invention showing how the control system sets the states and controls refrigerator functions based on those states, including states associated with the fresh food compartment, freezer compartment, and ice maker compartment. FIG. 41 is a flow diagram providing an overview of one embodiment of the present invention. In FIG. 41, an executive loop 560 is shown. In step 562 a determination is made as to whether a set time period (such as 30 seconds) has elapsed. If so, then a set of steps 564 are performed to update state variables. These state variables are updated through a calculate temperatures subroutine 566, an adjust setpoints subroutine 568, an update freezer subroutine 570, an update ice box subroutine 572, an update fresh food compartment subroutine 574, an update defrost subroutine 576, a check stable cycles routine 580, and a scan ice maker subroutine 582. Once the state variables are updated, then there are a set of control subroutines 566 which act on the state variables. These control routines include a control compressor subroutine 584, a control damper subroutine 586, a control evaporator fan subroutine 588, a control ice box fan subroutine 590, and a control defrost heater subroutine 592.

As shown in FIG. 41 the status of the state variables are regularly updated in the set of steps 564. After the state variables are updated, appropriate actions are performed to control refrigerator functions.

Figure 42:
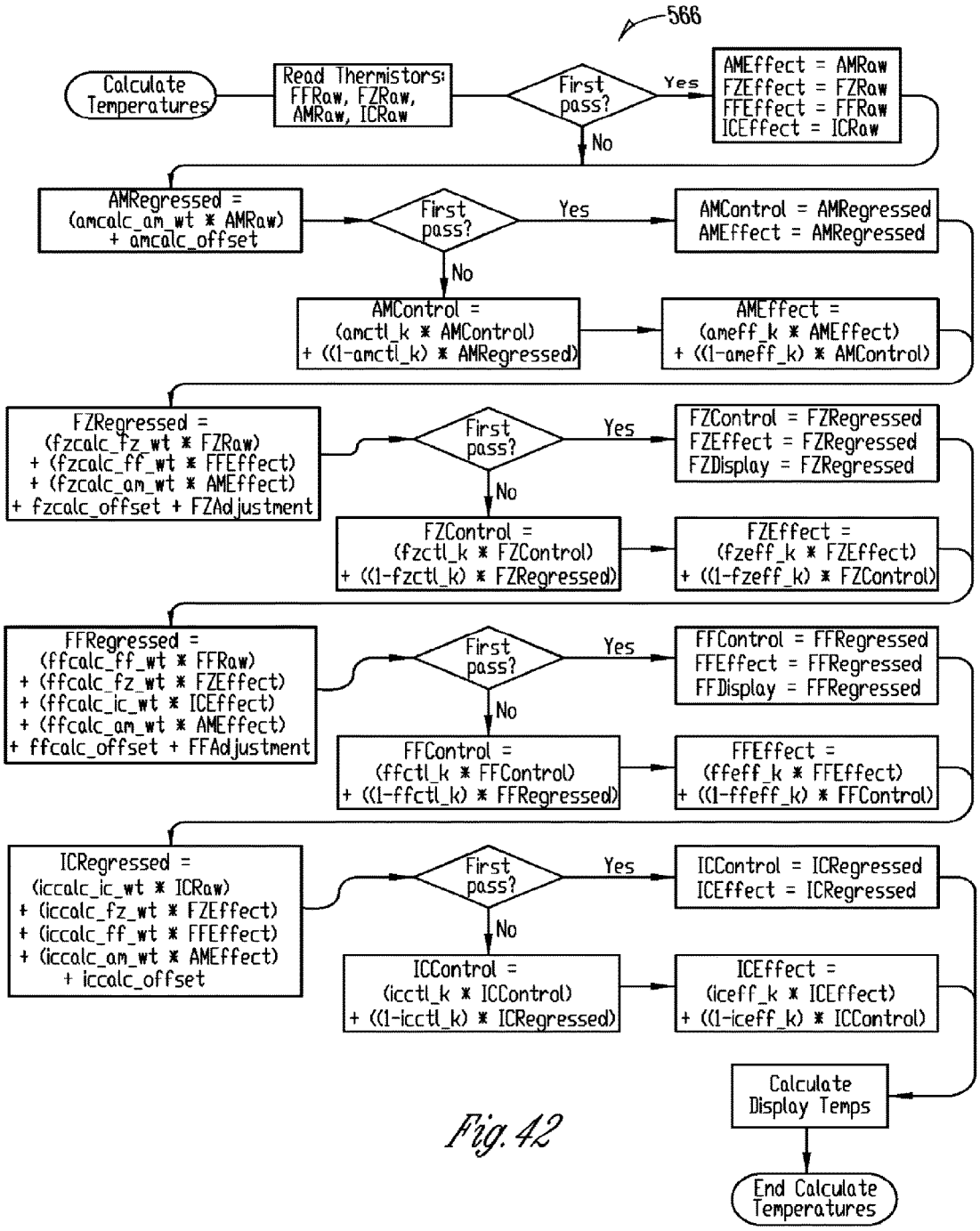
FIG. 42 is a flow diagram of a calculate temperatures subroutine according to one embodiment of the present invention.

The calculate temperatures subroutine 566 is shown in greater detail in FIG. 42. In one embodiment, each compartment's temperature and the ambient temperature are measured with thermistors to provide raw data. Regressed temperatures are calculated based in part on the raw temperatures.

Figure 43:
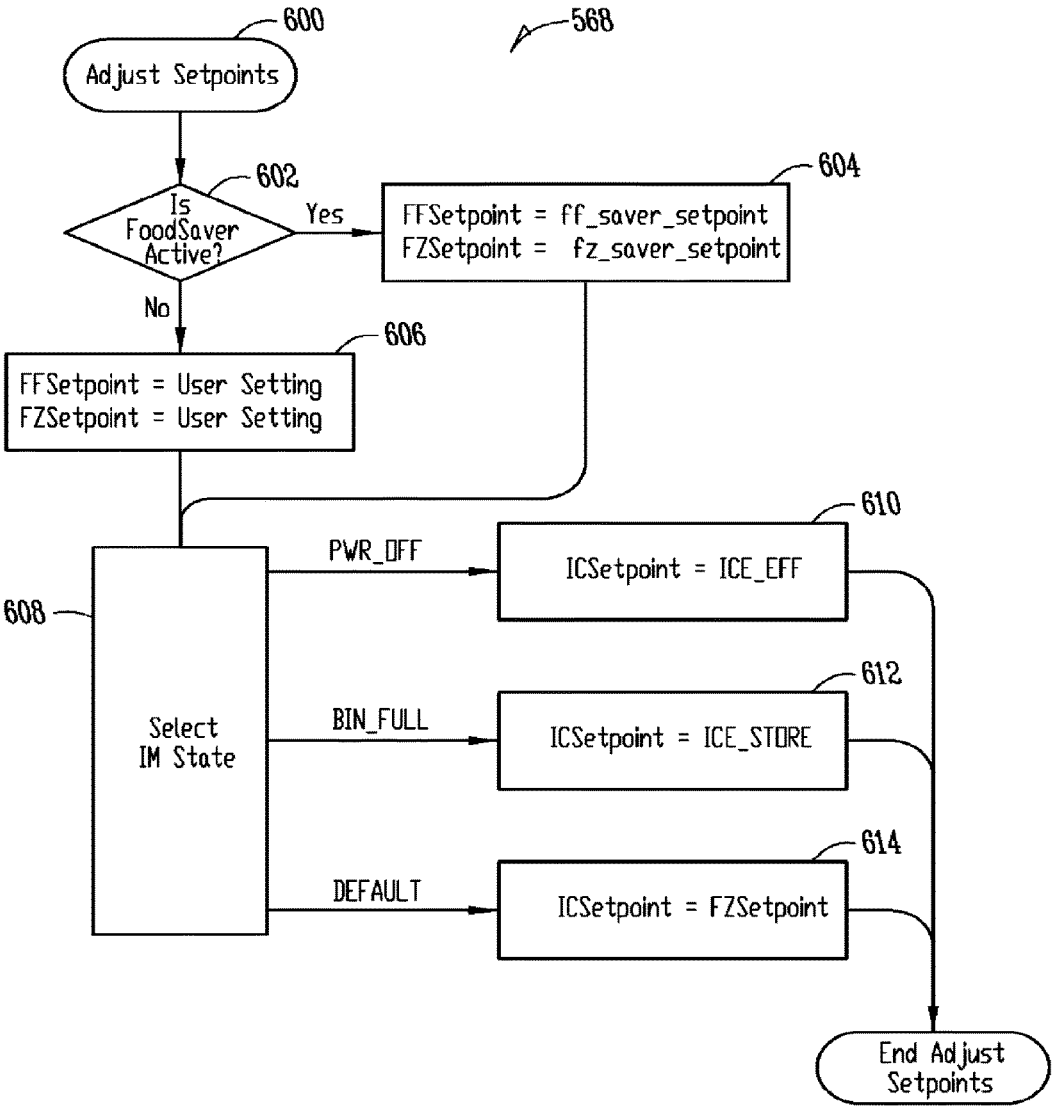
FIG. 43 illustrates one embodiment of a flow diagram for the adjust setpoints subroutine.

FIG. 43 illustrates a flow diagram for the adjust setpoints subroutine 568. The user selects set points for the fresh food compartment (FFSetpoint) and the freezer compartment (FZSetpoint). Based on the user settings, or other settings if a food saver feature is active (ff_saver_setpoint, fz_saver_setpoint), an ice maker set point (ICSetpoint) is set. Under default conditions (DEFAULT) the ice maker set point (ICSetpoint) is the same as the freezer set point (FZSetpoint). If the ice maker's bin is full (BIN_FULL), then the ice maker's set point (ICSetpoint) is set at a lower temperature to maintain the ice and prevent melting. If the ice maker is turned off, then the ice maker's set point is set at a higher temperature (ICE_EFF) thereby providing an efficiency mode to thereby conserve energy. For example, it is generally expected that the ice maker's set point for storage (ICE_STORE) is less than the ice maker's temperature when the power is off such as in an energy efficient mode of operation (ICE_EFF), which is less than the temperature required to melt ice. For example, the ice storage temperature (ICE_STORE) may be around 15 degrees Fahrenheit while the ice maker's efficiency temperature (ICE_EFF) is 25 degrees. Ice might begin to melt at a temperature of 28 degrees Fahrenheit.

Thus, in step 602 a determination is made as to whether the food saver function is active. If it is, then in step 604, the set point for the fresh food compartment (FFSetpoint) is set accordingly to ff_saver_setpoint. Also, the set point for the freezer compartment (FZSetpoint) is set accordingly to fz_saver_setpoint and then the subroutine proceeds to select the ice maker state in step 608. Returning to step 602, if the food saver function is not active, then in step 606, the fresh food set point (FFSetpoint) is set to a user selected temperature setting and the freezer set point (FZSetpoint) is set to a user selected temperature setting.

In step 608, the ice maker state is selected. If the ice maker state is turned off (PWR_OFF) to conserve energy, then the ice maker's set point (ICSetpoint) is set to an energy efficient temperature less than the melting point (ICE_EFF) in step 610. If the ice maker state indicates that the ice bin is full (BIN_FULL) then the ice maker's set point (ICSetpoint) is set to an ice storage temperature (ICE_STORE) in step 612. If the ice maker state is the default state (DEFAULT) then the ice maker's set point (ICSetpoint) is set to the freezer set point (FZSetpoint).

Figure 44A:
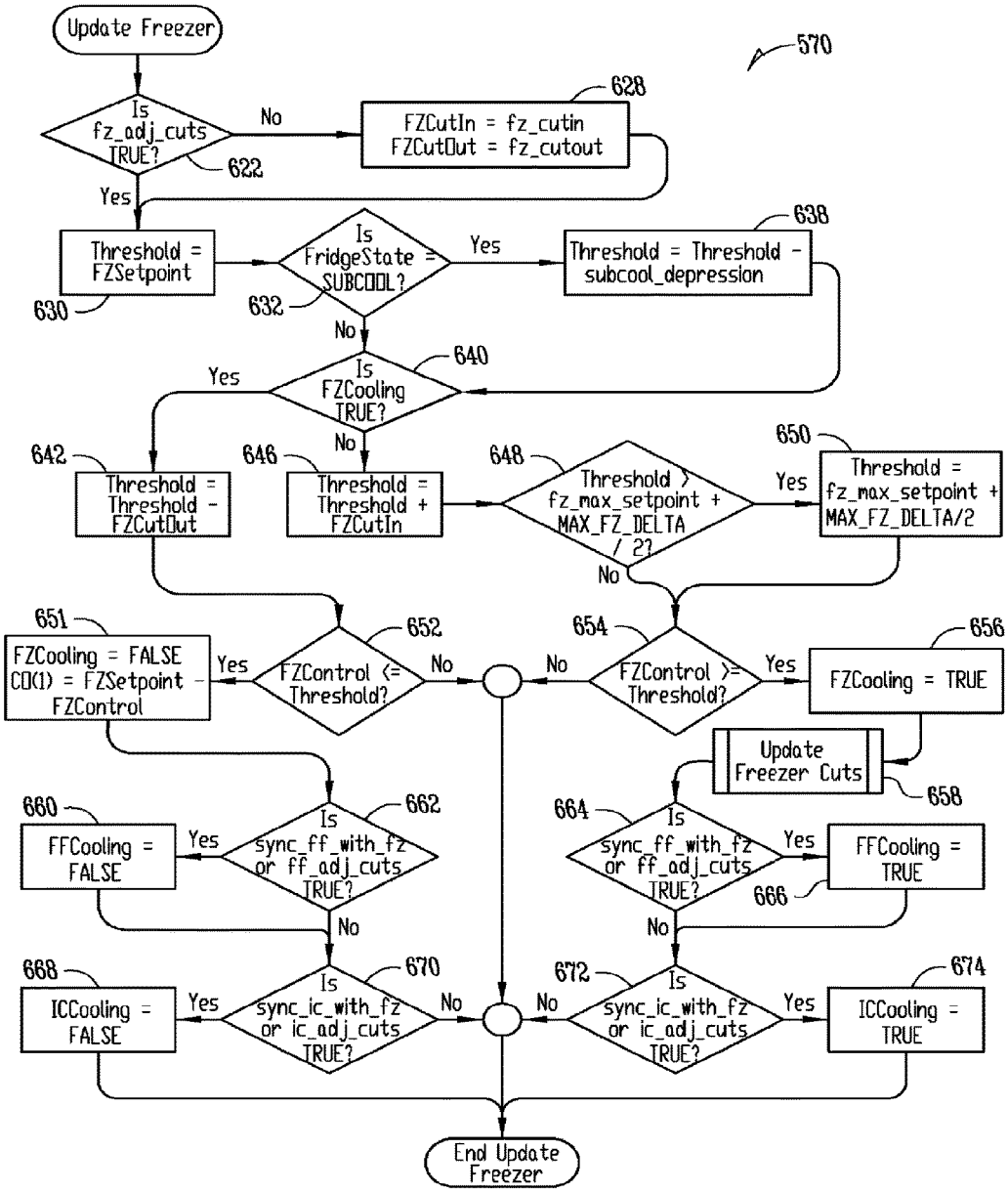
FIG. 44A illustrates one embodiment of a flow diagram for the update freezer subroutine.

FIG. 44A is a flow diagram illustrating one embodiment of the update freezer subroutine 570. The update freezer subroutine assists in increasing the energy efficiency of the appliance because instead of merely turning on the freezer when temperature reaches a particular setpoint, the update freezer subroutine also considers the states of the fresh food compartment and ice maker and how ultimately temperature will be affected over time. The update freezer routing is used to set states associated with the freezer, fresh food compartment and ice maker. In step 622 the fz_adj_cuts state is determined. If true then in step 630, the threshold is set to the freezer set point (FZSetpoint). If in step 622, the fz_adj_cuts state is not true, then in step 628, the freezer cut-in temperature (FZCutIn) is set to fz_cutin and the freezer cut-out temperature is set to fz_cutout. Then in step 630, the threshold is set to the freezer set point (FZSetpoint).

In step 632 a determination is made as to whether the refrigerator state (FridgeState) is set to a sub-cool state (SUBCOOL). If it is, then in step 638, the Threshold is set to the difference of the Threshold and the subcool depression. Then in step 640, a determination is made as to whether the freezer is in the freezer cooling (FZCooling state). If it is, then in step 642, the Threshold is set to be the difference between the Threshold and the freezer cut-out temperature (FZCutOut). Then in step 652, a determination is made whether the freezer control temperature (FZControl) is less than or equal to the threshold temperature (Threshold). If it is, then in step 654, the freezer cooling condition (FZCooling) is set to be FALSE and the first cut-out temperature, CO(1), is set to the difference of the freezer setpoint (FZSetpoint) and the freezer control temperature (FZControl). Next in step 662, a determination is made as to whether the synchronize fresh food compartment with freezer (sync_ff_with_fz) or fresh food adjust cuts (ff_adj_cuts_states are TRUE. If one of these states are true, then in step 660, the fresh food cooling state (FFCooling) is set to be FALSE. If, however, neither of these states are true, in step 670, a determination is made as to whether the synchronize ice maker with freezer (sync_ic_with_fz) or ice maker adjust cuts (ic_adj_cuts) states are true. If one of these states is true, then in step 668, the ice maker cooling state (ICCooling) is set to FALSE.

Returning to step 650, if the freezer cooling state (FZCooling) is not set, then in step 646, the threshold (Threshold) is set to be the sum of the threshold (Threshold) and the freezer cut-in temperature (FZCutin). Then in step 648, a determination is made as to whether the threshold (Threshold) is greater than the sum of freezer's maximum set point (fz_max_setpoint) and the maximum freezer change (MAX_FZ_DELTA) divided by two. If it is, then in step 650, the threshold (Threshold) is set to be the sum of the freezer's maximum set point (fz_max_setpoint) and the maximum freezer change (MAX_FZ_DELTA) divided by two. Then in step 654 a determination is made as to whether the freezer control temperature (FZControl) is greater than or equal to the threshold (Threshold). If it is, then in step 656 the freezer cooling state (FZCooling) is set to be TRUE. Then in step 658, the Update Freezer Cuts subroutine is executed. Next in step 664, a determination is made as to whether the synchronize fresh food compartment with the freezer compartment state (sync_ff_with_fz) or the fresh food adjust cuts state (ff_adj_cuts) state is true. If it is, then in step 666 the fresh food cooling state (FFCooling) is set to be true. Then in step 672, a determination is made as to whether the synchronize ice maker with freezer state (sync_ic_with_fz) or the ice maker adjust cuts (ic_adj_cuts) states are true. If they are, then in step 674, the ice maker cooling state (ICCooling) is set to be true.

Figure 44B:
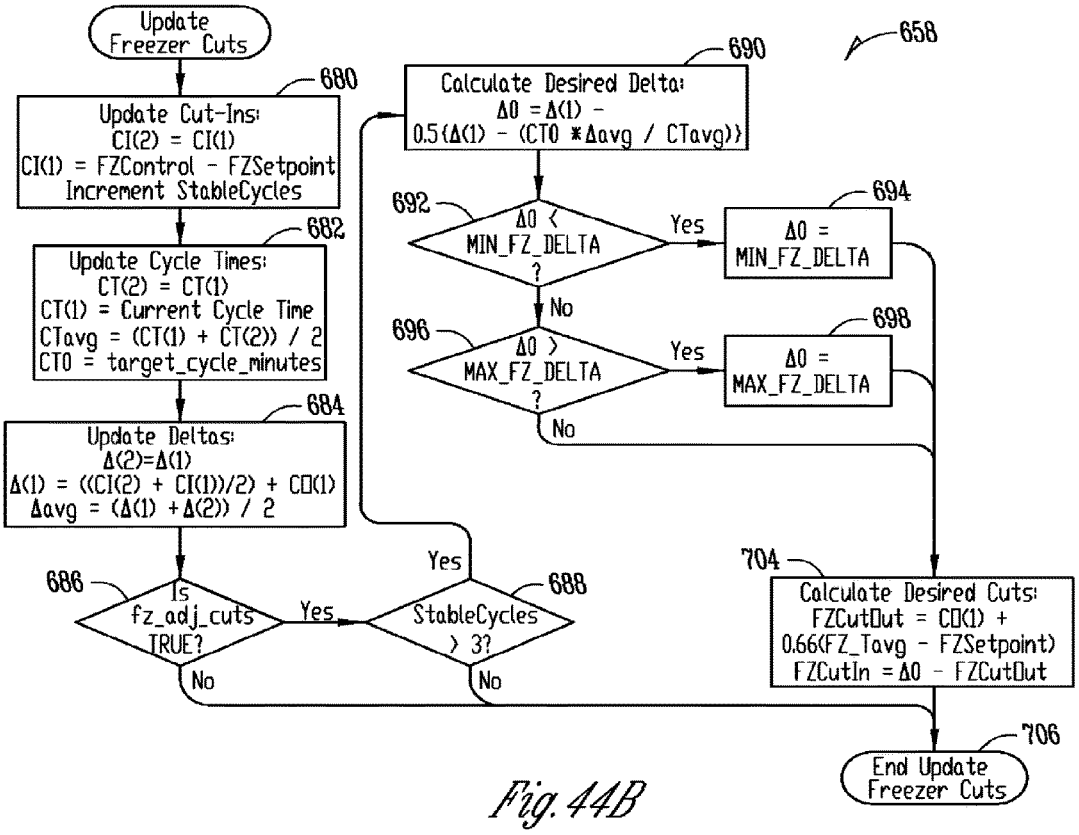
FIG. 44B illustrates one embodiment of a flow diagram for the update freezer cuts subroutine.

FIG. 44B is a flow diagram illustrating one embodiment of the update freezer cuts subroutine 658. In step 680, the cut-in temperatures are updated by setting the second cut-in temperature, CI(2), to be equal to the first cut-in temperature, CI(1). The first cut-in temperature, CI(1), is then set to be equal to the difference of the freezer control temperature (FZControl) and the freezer setpoint (FZSetpoint). Also the stable cycles variable (StableCylces) is incremented. Next in step 682, the cycle times are updated by setting the second cycle time, CT(2), to be equal to the first cycle time, CT(1). The first cycle time, CT(1), is then set to the current cycle time. The average cycle time (CTavg) is then computed as the average of the first cycle time, CT(1), and the second cycle time, CT(2). The CT0 is set to be target cycle minutes (target_cycle_minutes).

Next in step 686, a determination is made as to whether the freezer adjust cuts state (fz_adj_cuts) is true. If it is, then in step 688, a determination is made as to whether there are more than three stable cycles (StableCycles). If there are, then in step 690, the desired delta is calculated from the deltas and the cut-out temperatures as shown. The bounds of the calculated desired delta are then checked in steps 692-698. In step 692, a determination is made as to whether Δ(0) is less than the minimum freezer delta (MIN_FZ_DELTA). If it is, then in step 694, Δ(0) is set to be the minimum freezer delta (MIN_FZ_DELTA). If it is not, then in step 696, a determination is made as to whether Δ(0) is greater than the maximum freezer delta (MAX_FZ_DELTA). If it is, then in step 698, Δ(0) is set to be the maximum freezer delta (MAX_FZ_DELTA). In step 704, the desired freezer cut-out temperature (FZCutOut) and the desired freezer cut-in temperature (FZCutIn) are set.

Then in step 684, the deltas are updated accordingly. In particular, Δ(2) is set to Δ(1). Also, Δ(1) is set to be the sum of the average of CI(1) and CI(2) and CO(1). Also, Δavg is set to be the average of Δ(1) and Δ(2).

Figure 44C:
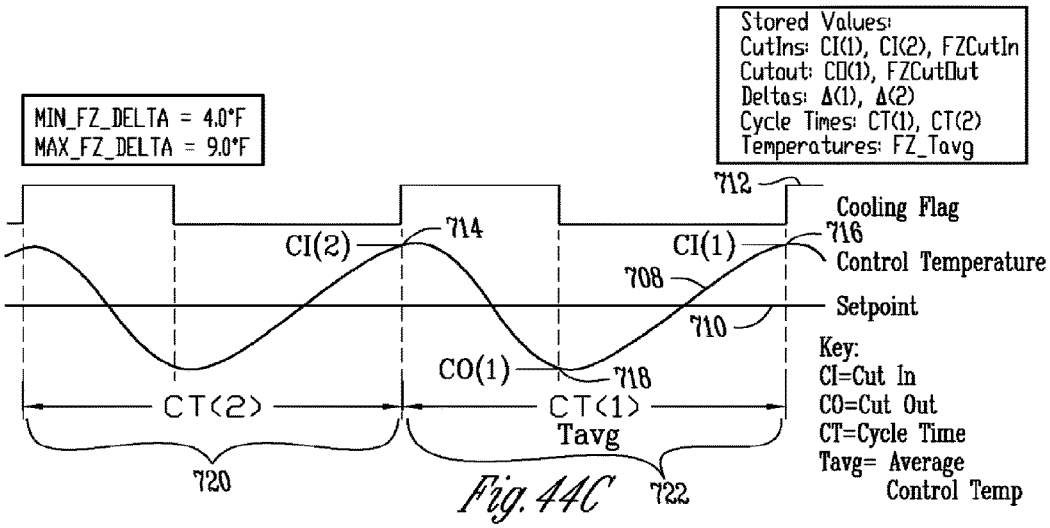
FIG. 44C illustrates relationships between the cooling flag, control, temperature, setpoint, cut-ins, cut-outs, and cycle time for the update freezer cuts subroutine.

FIG. 44C shows the relationship between the cooling state or flag 712, and the control temperature 708 over time. Note that at point 716, CI(1), the cooling state of flag 712 cuts in, at point 714, CI(2), the cooling state or flag also cuts in, at point 718, CO(1), the cooling state or flag cuts out. For cycle CT(1) 722 there is an associated average control temperature (Tavg) and for cycle CT(2) 720 there is an associated average control temperature (Tavg).

Figure 45A:
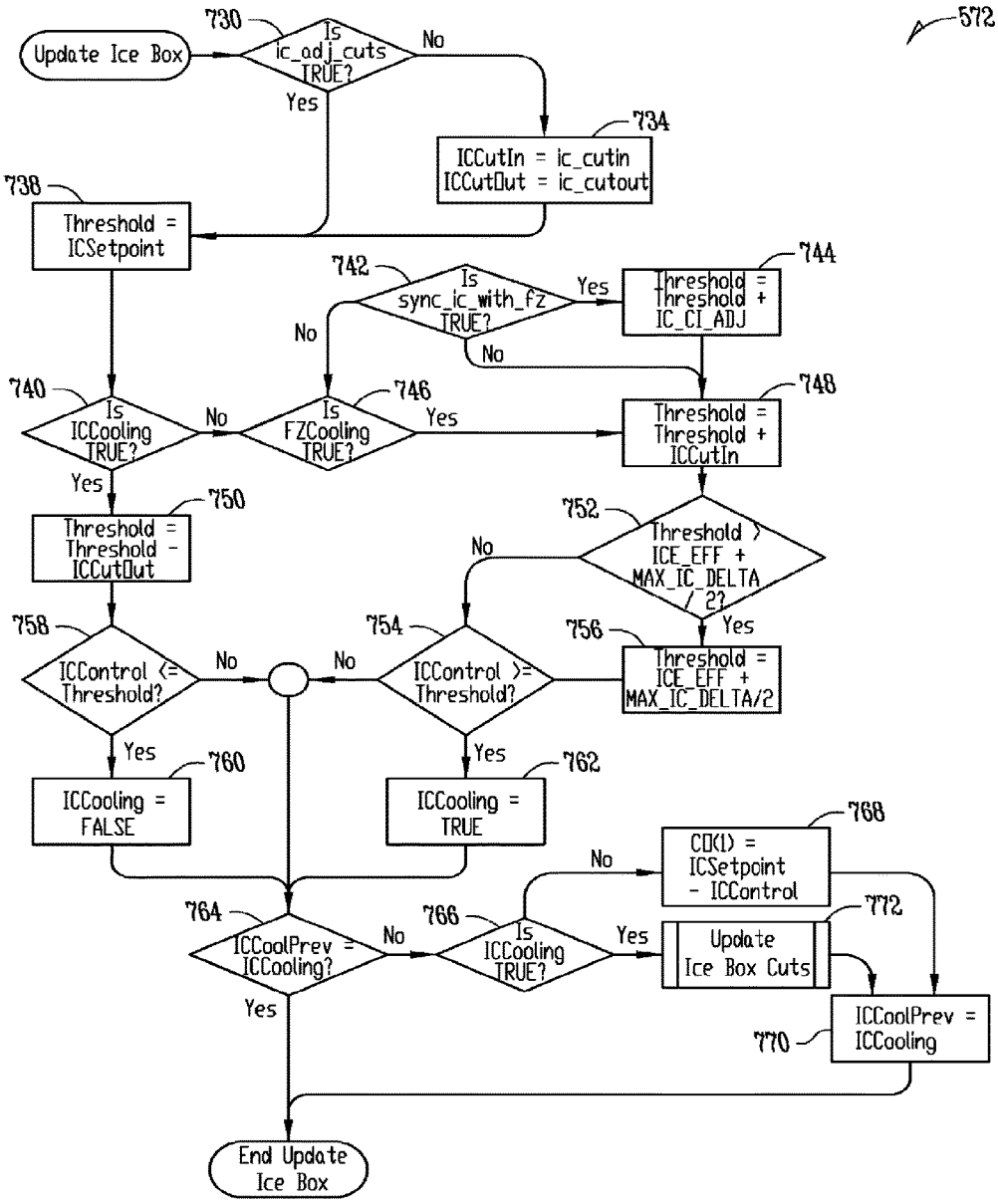
FIG. 45A illustrates one embodiment of a flow diagram for the update ice box subroutine.

FIG. 45A illustrate one embodiment of the update ice box subroutine 572. In FIG. 45A, a determination is made in step 730 as to whether the ice maker adjust cuts state (ic_adj_cuts) is true. If not, then in step 734, the ice maker cut in time (ICCutIn) and the ice maker cut out (ICCutOut) times are set. Then in step 738, the threshold (Threshold) is set to the ice maker set point (ICSetpoint). Next, in step 740, a determination is made as to whether the ice maker cooling state (ICCooling) is set. If not, then in step 746, a determination is made as to whether the freezer cooling state (FZCooling) is set. If not, then in step 743, a determination is made as to whether the synchronize ice maker with freezer state (sync_ic_with_fz) is set. If it is, then in step 744, the threshold (Threshold) is set to the sum of the Threshold and the ice maker cut-in adjustment value (IC_CI_ADJ). In step 748, the threshold (Threshold) is set to be the sum of the threshold (Threshold) and the ice maker cut in (ICCutIn). Next in step 752, the upper bound for the threshold is tested and if the bound is exceeded, in step 756, the threshold is set to be the upper bound. Next in step 754, a determination is made as to whether the ice maker control (ICControl) is greater or equal to the threshold. If it is, then in step 762, the ice maker cooling state is set to true.

Returning to step 740, if the ice maker cooling state is true, then in step 750, the threshold is set to the difference of the threshold and the ice maker cutout. Then in step 758, the ice maker cooling state is set to be false.

In step 764 a determination is made as to whether the ice maker was previously in a cooling state. If not, then in step 766 a determination is made as to whether the ice maker cooling state is true. If not, then the first cut-out time, CO(1) is set to be the difference between the ice maker setpoint (ICSetpoint) and the ice maker control (ICControl). If it is, then in step 772, an update ice box cuts subroutine is executed. In step 770, the previous ice maker cooling stat (ICCoolPrev) is set to cooling (ICCooling).

Figure 45B:
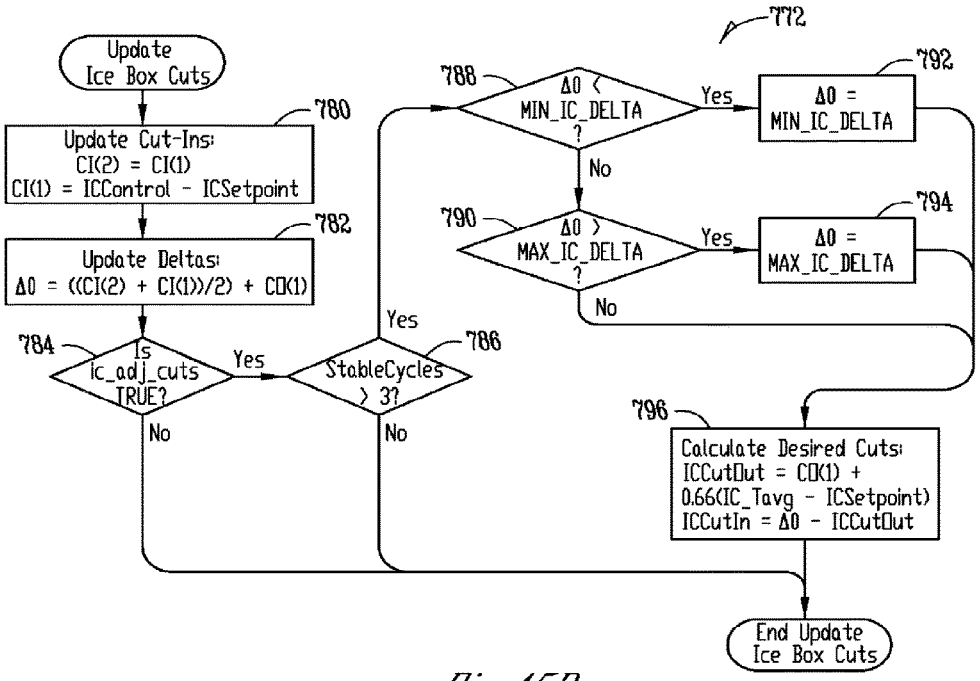
FIG. 45B illustrates one embodiment of a flow diagram for the update ice box cuts subroutine.

FIG. 45B illustrates the ice box cuts subroutine 772. In step 780, the cut-ins are updated. In step 782 the deltas are updated. In step 784, a determination is made as to whether the ice_adj_cuts state is true. If it is, then in step 786 a determination is made as to whether there have been at least three stable cycles. If so, in steps 788, 790, 792, and 794, the boundaries of Δ0 are tested. In step 796 the desired cuts are calculated.

Figure 45C:
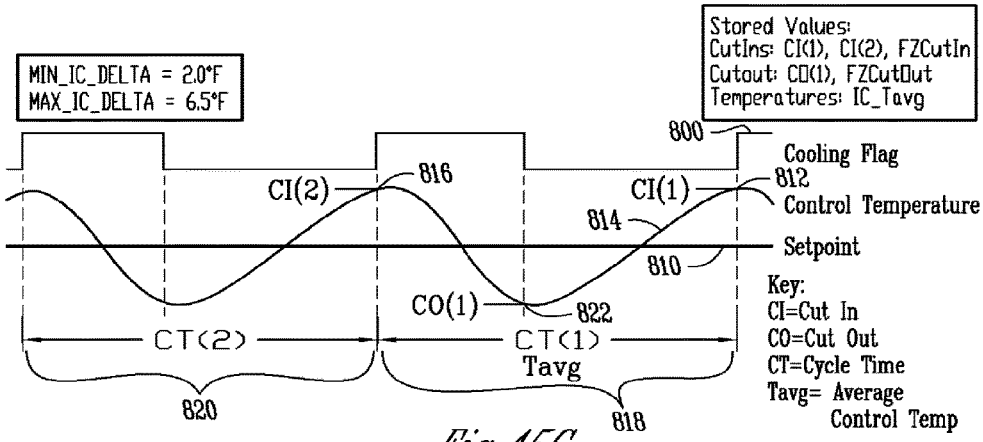
FIG. 45C illustrates relationships between the cooling flag, control, temperature, setpoint, cut-ins, cut-outs, and cycle time for the update ice box cuts subroutine.

FIG. 45C shows the relationship between the cooling state or flag 800, and the control temperature 814 over time. Note that at point 812, CI(1), the cooling state of flag 800 cuts in, at point 816, CI(2), the cooling state or flag also cuts in, at point 822, CO(1), the cooling state or flag cuts out. For cycle CT(1) 818 there is an associated average control temperature (Tavg) and for cycle CT(2) 820 there is an associated average control temperature (Tavg).

Figure 46A:
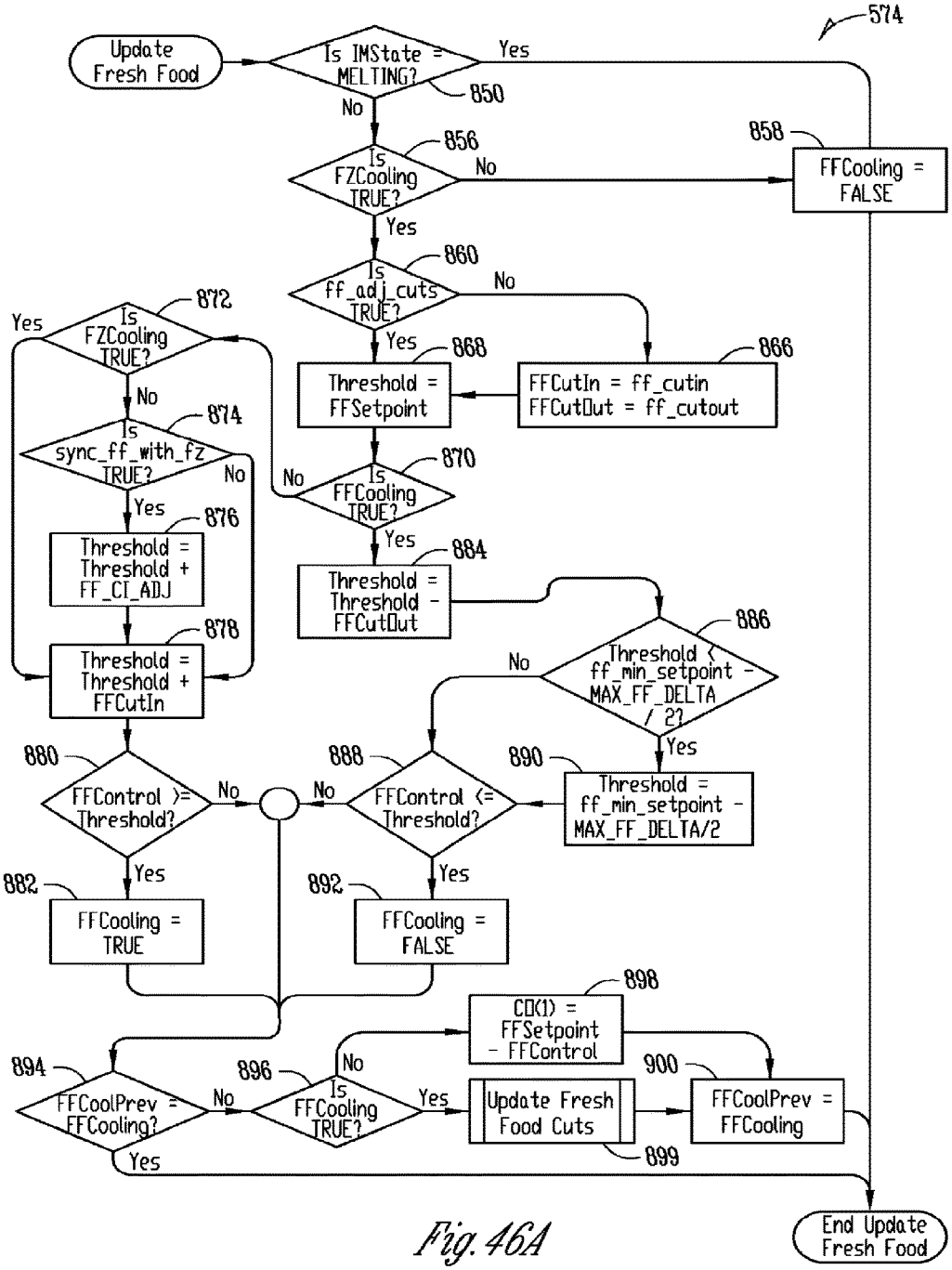
FIG. 46A illustrates one embodiment of a flow diagram for the update fresh food subroutine.

FIG. 46A illustrates one embodiment of a flow diagram for the update fresh food subroutine 574. In FIG. 46A, a determination is made as to whether the ice maker state (IMState) is melting. If it is, then in step 858, the fresh food compartment cooling state is set to false. If it is not, then in step 856 a determination is made as to whether the freezer cooling state (FZCooling) is true. If it is not then in step 858 the fresh food compartment cooling (FFCooling) state is set to false. If the freezer cooling (FZCooling) state is true, then in step 860, a determination is made as to whether the ff_adj_cuts state is true. If it is not, then in step 866 values for the fresh food cut-in and cut-out values are set accordingly. In step 868, the threshold (Threshold) is set to the fresh food compartment setpoint. In step 870, a determination is made as to whether the fresh food cooling (FFCooling) state is true. If not in the fresh food cooling (FFCooling) state, then in step 872, a determination is made as to whether the freezer cooling state is true. If it is then, the threshold is set in step 878. If it is not, then in step 874 a decision is made as to whether the threshold needs to be adjusted to compensate for the synchronization state. If it does not then, in steps 876 and 878 the threshold is adjusted accordingly. Then in step 880 a determination is made as to whether the fresh food compartment temperature is greater than or equal to the threshold. If it is, then in step 882, the fresh food cooling state (FFCooling) is set to be true.

Returning to step 870, if the fresh food compartment cooling (FFCooling) state is true, then the threshold is modified in step 884. In step 886 a determination is made as to whether the threshold is less than the difference of the fresh food compartment's minimum setpoint and half of the maximum fresh food compartment change. If it is, then in step 890, the threshold is set to the difference of the fresh food compartment's minimum setpoint and half of the maximum fresh food compartment change. Then in step 888 a determination is made as to whether the fresh food compartment control temperature is less than or equal to a threshold. If it is then the fresh food cooling state (FFCooling) is set to be false. In step 894, the fresh food cooling's previous state (FFCoolPrev) is compared to the present fresh good cooling (FFCooling). If they are not equal, then in step 896, a determination is made as to whether the fresh food cooling (FFCooling) state is true. If it is then, an Update Fresh Food Cuts subroutine 898 is run to update cut-in and cut-out temperatures. If it is not then the cutout temperature, CO(1), is set to be the difference between the fresh food setpoint (FFSetpoint) and the fresh food control setting (FFControl). Then in step 900 the previous fresh food cooling state (FFCoolPrev) is updated to the current fresh food cooling state.

Figure 46B:
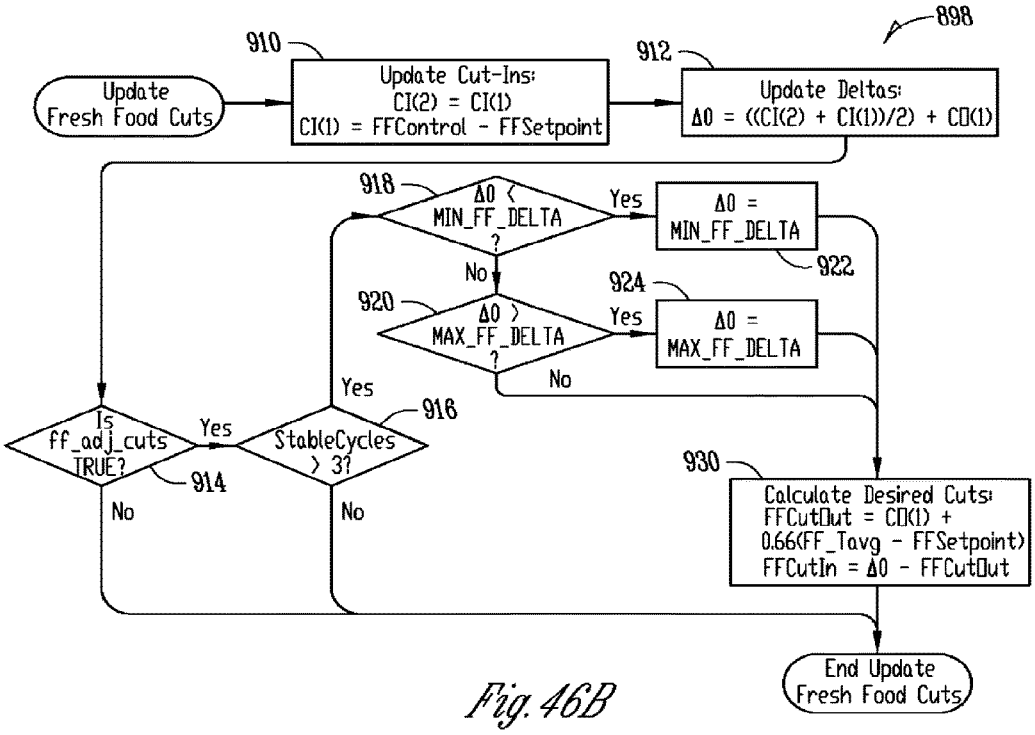
FIG. 46B illustrates one embodiment of a flow diagram for the update fresh food cuts subroutine.

FIG. 46B illustrates one embodiment of a flow diagram for the update fresh food cuts subroutine 898. In step 910 the cut-in temperatures are updated. In step 912, the deltas are updated. In step 914, a determination is made as to whether the fresh food compartment cut-in and cut-out temperatures need adjustment. If they do, in step 916 a determination is made as to whether there has been more than three consecutive stable cycles. If there has, then in steps 918, 920, 922, and 924, the delta is recalculated. In step 930 the cut-in and cut-out temperatures for the fresh food compartment are adjusted accordingly.

Figure 46C:
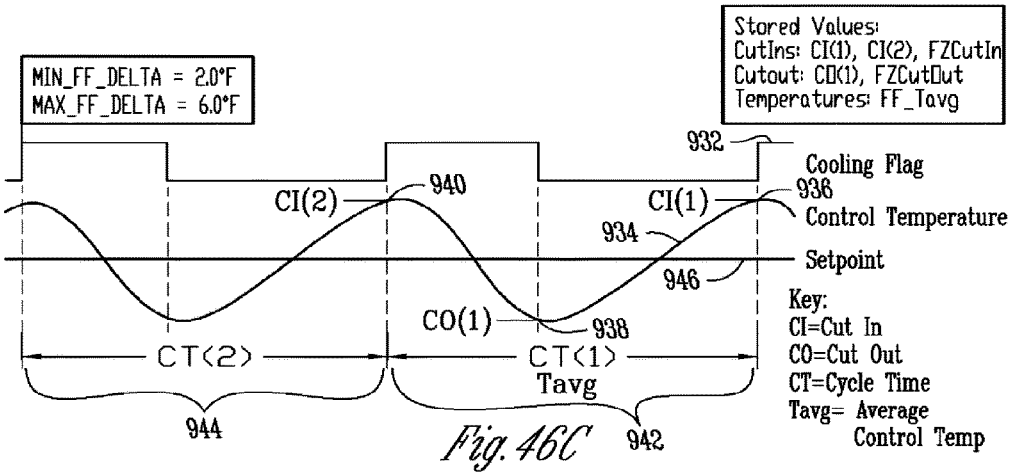
FIG. 46C illustrates relationships between the cooling flag, control, temperature, setpoint, cut-ins, cut-outs, and cycle time for the update fresh food cuts subroutine.

FIG. 46C illustrates relationships between the cooling flag, control, temperature, setpoint, cut-ins, cut-outs, and cycle time for the update fresh food cuts subroutine. FIG. 46C shows the relationship between the cooling state or flag 932, and the control temperature 934 over time. Note that at point 936, CI(1), the cooling state of flag 932 cuts in, at point 940, CI(2), the cooling state or flag also cuts in, at point 938, CO(1), the cooling state or flag cuts out. For cycle CT(1) 942 there is an associated average control temperature (Tavg) and for cycle CT(2) 944 there is an associated average control temperature (Tavg).

Figure 47:
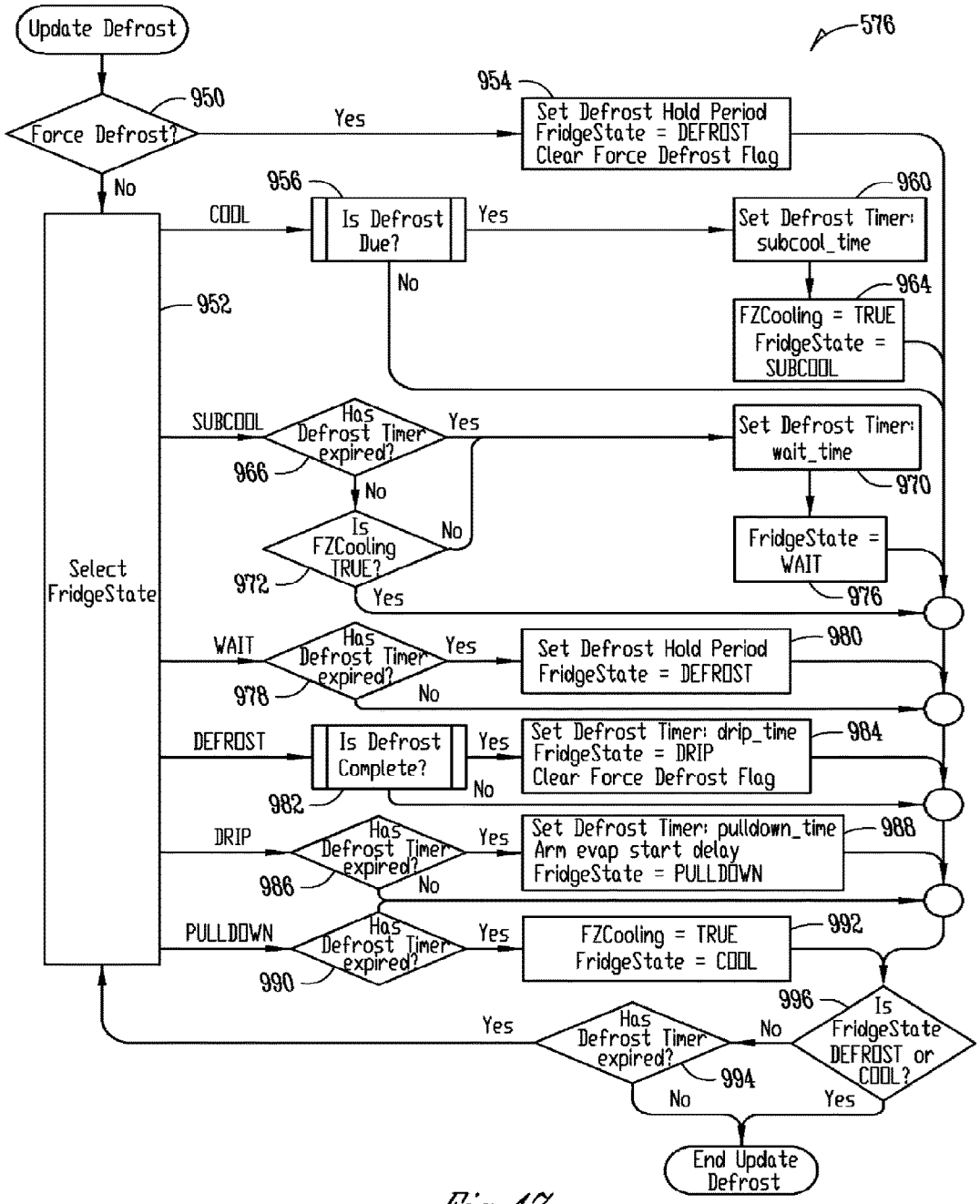
FIG. 47 illustrates one embodiment of a flow diagram for the update defrost subroutine.

FIG. 47 illustrates one embodiment of a flow diagram for the update defrost subroutine 576. In step 950 a determination is made as to whether to force a defrost. If a defrost is not forced, then in step 952 the refrigerator state is selected. If a defrost is forced, then in step 984 the defrost hold period is set, the refrigerator state is set to defrost and a flag for forcing a defrost is cleared.

Returning to step 952, the refrigerator state can be COOL, SUBCOOL, WAIT, DEFROST, DRIP, or PULLDOWN. If the refrigerator state is cool, then in step 956 a determination is made as to whether defrost is due. If it is, then in step 960 the defrost timer is set and in step 965, the freezer cooling (FZCooling) state is set to true and the refrigerator state is set to SUBCOOL.

Returning to step 952, if the refrigerator is in the subcool state, then in step 966 a determination is made as to whether the defrost timer has expired. If it has, then in step 970, the defrost timer is set and in step 976 the refrigerator state (FridgeState) is set to WAIT. If in step 966 the defrost timer has not expired, then in step 972 a determination is made as to whether the freezer is in the cooling state. If it is not, then in step 970 the defrost timer is set and in step 976 the refrigerator state (FridgeState) is set to WAIT.

Returning to step 952, if the refrigerator state (FridgeState) is WAIT, then in step 978 a determination is made as to whether the defrost timer has expired. If it has, then in step 980 the defrost hold period is set and the refrigerator state is set to DEFROST.

Returning to step 952, if the refrigerator state (FridgeState) is DEFROST, then in step 982, a determination is made as to whether the defrost is complete. If it is then in step 984, the defrost timer is set for time associated with dripping (drip_time), the refrigerator state (FridgeState) is set to DRIP and the flag associated with forcing defrost is cleared.

Returning to step 952, if the refrigerator state (FridgeState) is DRIP, then in step 986, a determination is made as to whether the defrost timer has expired. If it has, then in step 988, the defrost timer is set and the refrigerator state is set to PULLDOWN.

Returning to step 980, if the state is PULLDOWN, a determination is made as to whether or not the defrost timer has expired. If it has then in step 992, the freezer cooling state (FZCooling) is set to true and the refrigerator state (FridgeState) is set to COOL.

In step 996, a determination is made as to whether the refrigerator is in a DEFROST or COOL state. If it is, then the subroutine ends. If it is not, then in step 994 a determination is made as to whether the defrost timer has expired. If it has then the process returns to step 952. If the defrost timer has not expired then the subroutine ends.

Figure 48:
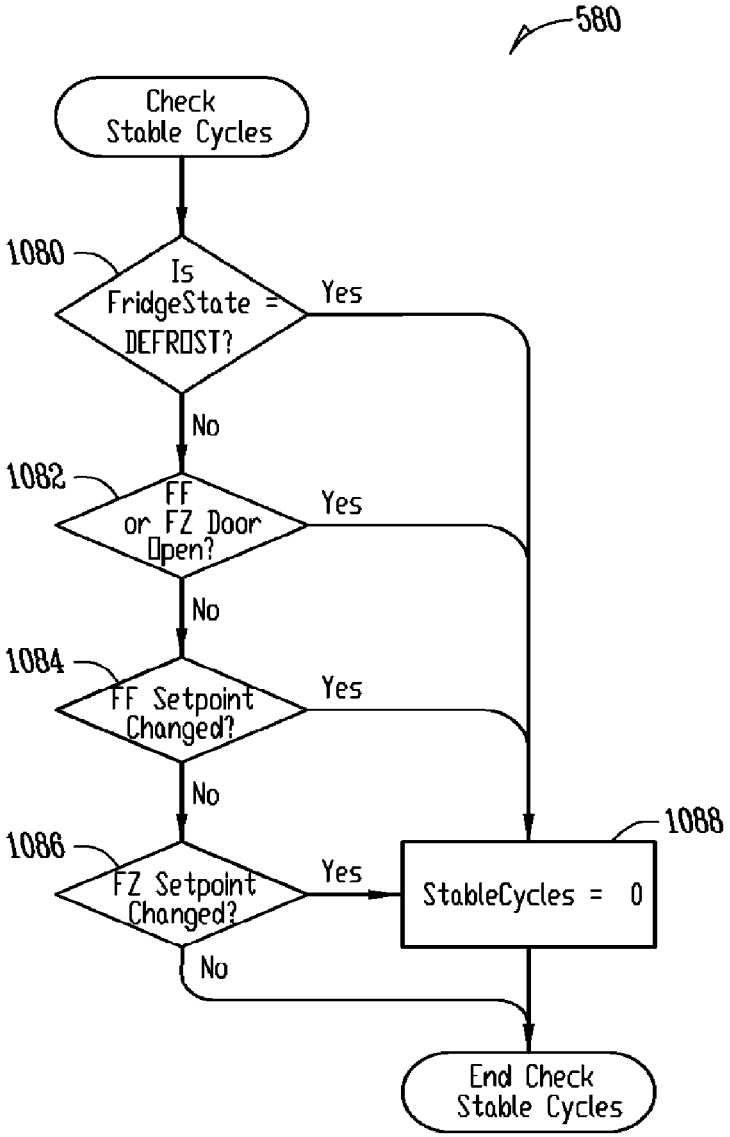
FIG. 48 illustrates one embodiment of a flow diagram for the check stable cycles subroutine.

FIG. 48 illustrates one embodiment of a flow diagram for the check stable cycles subroutine 580. The number of stable cycles is reset in step 1088 if in step 1080 the refrigerator is in the defrost state, in step 1082 the fresh food or freezer doors are open, in step 1084 the fresh food setpoint has changed, or in step 1086 the freezer setpoint has changed.

Figure 49:
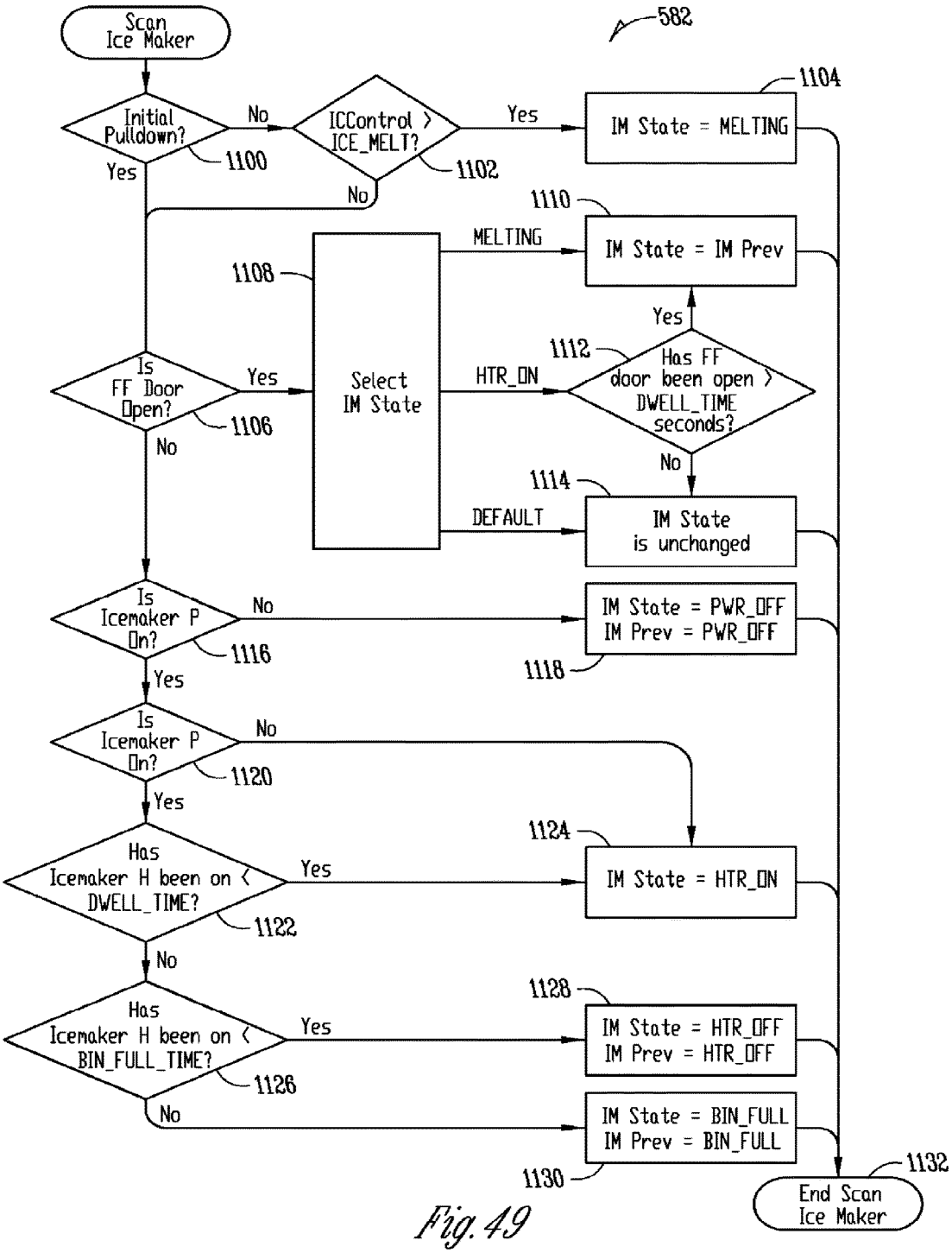
FIG. 49 illustrates one embodiment of a flow diagram for the scan ice maker subroutine.

FIG. 49 illustrates one embodiment of a flow diagram for the scan ice maker subroutine 582. This subroutine scans the ice maker to check for various conditions that may affect control functions and sets states associated with the ice maker appropriately. In step 1100 a determination is made as to whether the ice maker is in initial pulldown. If it is not, then in step 1102 a determination is made as to whether the ice maker control is above the melting temperature of ice. If it is then in state 1104, the ice maker state is set to MELTING. If not, then in step 1106 a determination is made as to whether the fresh food compartment door is open. If it is, then in step 1108 the ice maker state is selected. If the ice maker state is MELTING, then in step 1110 the ice maker state is set to the previous ice maker state. If the ice maker state is set to HTR_ON then in step 1112 a determination is made as to whether the fresh food compartment door has been open for longer than a set dwell time. If it has, then in step 1110 the ice maker state is set to the previous ice maker state. If has not then in step 1114 the ice maker state remains unchanged. Similarly if the ice maker state is DEFAULT in step 1108 then the ice maker state remains unchanged in step 1114.

In step 1116 a determination is made as to whether the ice maker power is on. If not, then in step 1118 the ice maker state and the ice maker's previous state are set accordingly to indicate that the power is off. In step 1120 a determination is made as to whether the ice maker's heater is on. If it is no then in step 1124 the ice maker's state is set to indicate that the heater is on. In step 1122 a determination is made as to whether the ice maker has been on less than a set dwell time. If it has, then in step 1124 the ice maker's state is set to indicate that the heater is on.

In step 1126 a determination is made has to whether the ice maker's heater has been on less than the amount of time associated with a full bin (such as 120 minutes). If it has then in step 1128 the ice maker's current state and previous state are set to indicate that the heater is off. If not, then in step 1130 the ice maker's current state and previous state are set to indicate that the bin is full.

Figure 50:
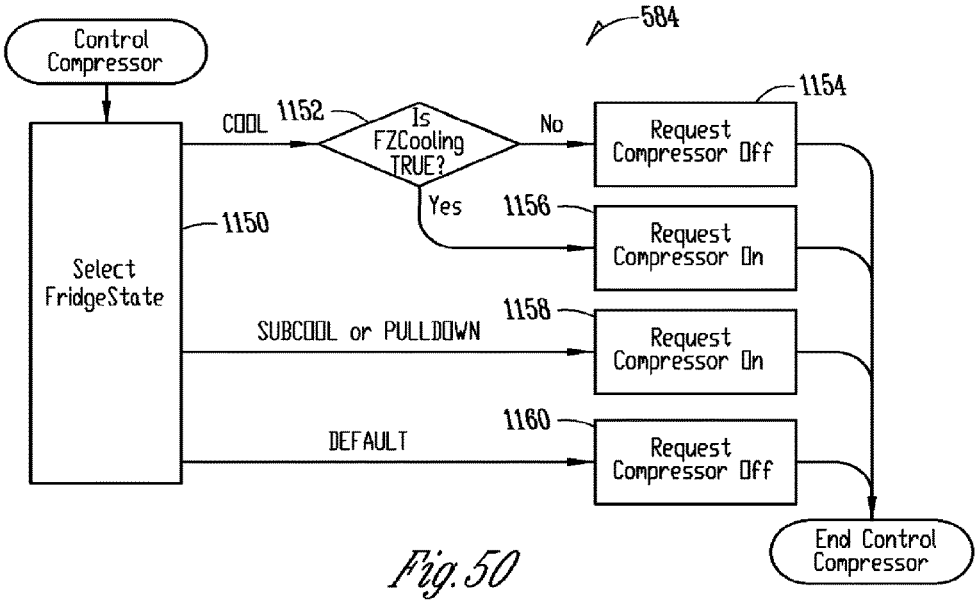
FIG. 50 illustrates one embodiment of a flow diagram for the control compressor subroutine.

FIG. 50 illustrates one embodiment of a flow diagram for the control compressor subroutine 584. In step 1150 the refrigerator's state (FridgeState) is examined. If the refrigerator is in the COOL state, then in step 1152 a determination is made as to whether the freezer cooling state is true. If it is not, then in step 1154 a request is made to turn the compressor off. If it is, then a request is made in step 1156 to request that the compressor be on. If the state is SUBCOOL or PULLDOWN, then in step 1158 a request is made to turn the compressor on. If the state is DEFAULT, then in step 1160 a request is made to turn the compressor off.

Figure 51:
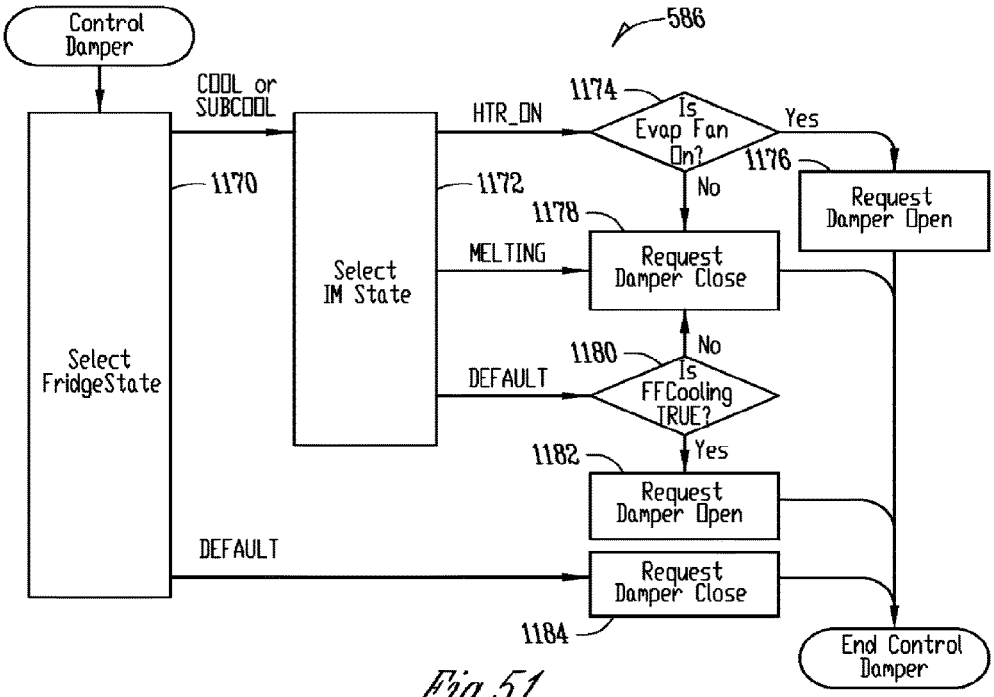
FIG. 51 illustrates one embodiment of a flow diagram for the control damper subroutine.

FIG. 51 illustrates one embodiment of a flow diagram for the control damper subroutine 586. In step 1170 the refrigerator state is selected. If the refrigerator state is COOL or SUBCOOL then in step 1172 the ice maker state is selected. IF the ice maker state is HTR_ON then in step 1174 a determination is made as to whether the evaporator fan is on. If it is then in step 1174 a request is made for the damper to be open. If not, then in step 1178 a request is made for the damper to be closed. If in step 1172 the ice maker state is MELTING< then in step 1178 a request is made for the damper to be closed. If the ice maker is in a different state (DEFAULT) then in step 1180 a determination is made as to whether the fresh food compartment is cooling. If it is not, then in step 1178 a request is made for the damper to be closed. If it is, then in step 1182 a request is made for the damper to be open. Returning to step 1170, if the refrigerator is in a DEFAULT state, then in step 1184 a request is made to close the damper.

Figure 52:
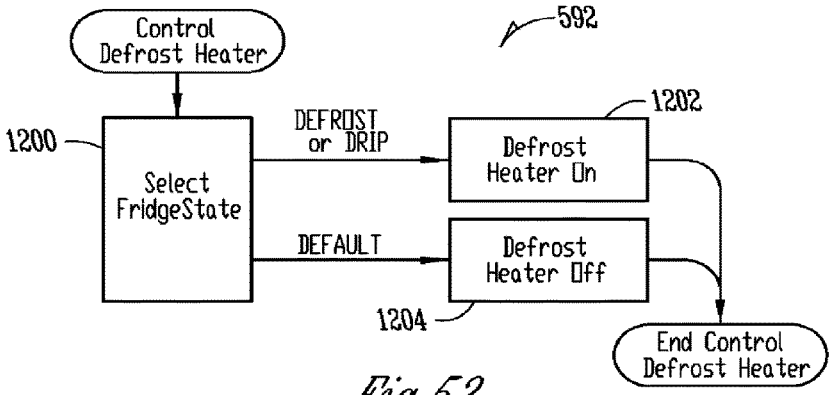
FIG. 52 illustrates one embodiment of a flow diagram for the control defrost heater subroutine.

FIG. 52 illustrates one embodiment of a flow diagram for the control defrost heater subroutine 592. In step 1200 the refrigerator state is selected. If the refrigerator state is DEFROST or DRIP, then in step 1202 the defrost heater is turned on. If the refrigerator state is a different or DEFAULT state then in step 1204 the defrost heater is turned off.

Figure 53:
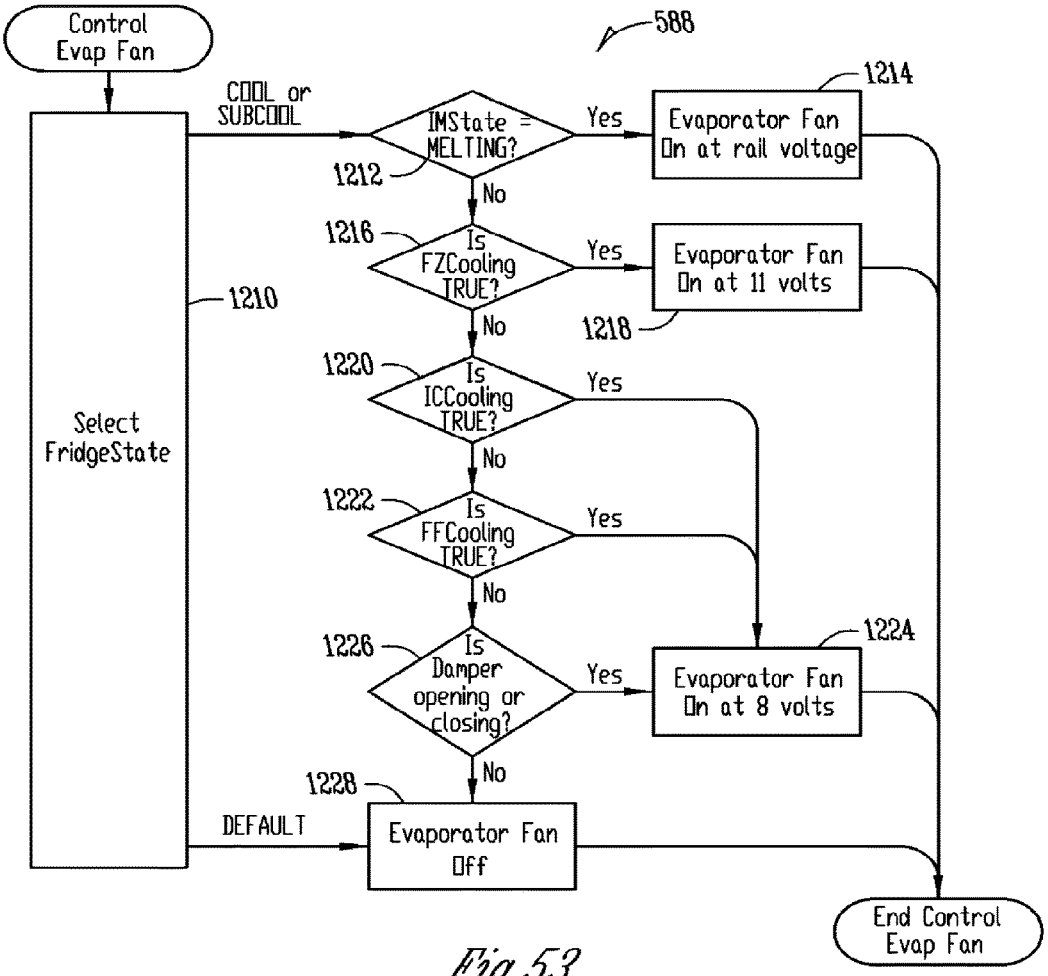
FIG. 53 illustrates one embodiment of a flow diagram for the control evaporator fan subroutine.

FIG. 53 illustrates one embodiment of a flow diagram for the control evaporator fan subroutine 588. In step 1210, the refrigerator state (FridgeState) is selected. If the state is COOL or SUBCOOL then in step 1212 a determination is made as to whether the ice maker is in the melting state (MELTING). If it is, then in step 1214, the evaporator fan is turned full-on at the rail voltage. If not, then in step 1216, a determination is made as to whether the freezer is in a cooling (FZCooling) state. If it is, then in step 1218, the evaporator fan is turned on at less than the rail voltage. If not, then in step 1220, a determination is made as to whether the ice compartment is cooling (ICCooling).

Figure 54:
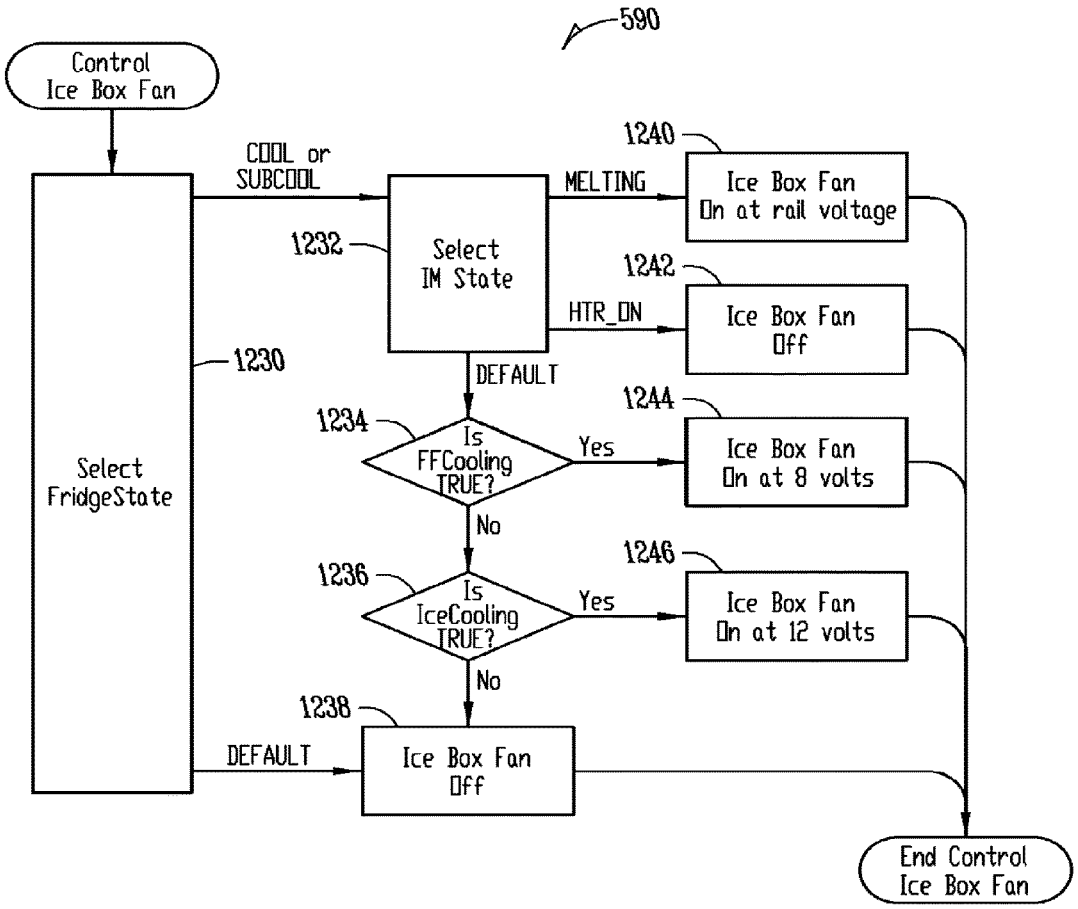
FIG. 54 illustrates one embodiment of a flow diagram for the control ice box fan subroutine.

FIG. 54 illustrates one embodiment of a flow diagram for the control ice box fan subroutine 590. In step 1230, a refrigerator state (FridgeState) is determined. If the refrigerator state is COOL or SUBCOOL, then in step 1232, the ice maker state is selected. If the ice maker state is MELTING, then the ice box fan is turned full-on in step 1240 such as by applying the rail voltages to the ice box fan. If the ice maker state indicates that the heater is on (HTR_ON), then the ice box fan is turned of in step 1242. If the ice maker state is in a different or DEFAULT state, then in step 1234 a determination is made as to whether the fresh food compartment is in a cooling (FFCooling) state. If it is, then in step 1244 the ice box fan is turned at less than full voltage to conserve energy. If not, then in step 1236 a determination is made as to whether the ice compartment is in a cooling (IceCooling) state. If it is in then in step 1246, the icebox fan Is turned on at a higher voltage than in step 1244. In step 1238, if neither the fresh good compartment is cooling or the ice maker compartment is cooling, the ice box fan is turned off. Thus the ice box fan is controlled in an energy efficient manner.

Miscellaneous

Applicant's provisional application, Ser. No. 60/613,241 filed Sep. 27, 2004, entitled APPARATUS AND METHOD FOR DISPENSING ICE FROM A BOTTOM MOUNT REFRIGERATOR, is hereby incorporated by reference in its entirety. This application and the provisional application both relate to a refrigerator with a bottom mount freezer and an ice making compartment for making ice at a location remote from the freezer.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator comprising:

a cabinet;

an insulated freezer compartment;

an insulated fresh food compartment disposed above the freezer compartment, the fresh food compartment having a door;

a pantry compartment located above the freezer compartment and beside the fresh food compartment;

an ice compartment with an icemaker, the ice compartment disposed within the pantry compartment;

a pantry drawer accessible without opening the door and comprising a front face; and a temperature control sub-system to control temperature in the pantry drawer at least substantially independently of the fresh food compartment, ice compartment, and freezer compartment; and an ice dispenser in the pantry drawer for dispensing ice through the front face.

2. The bottom mount refrigerator of claim 1 wherein the ice compartment is insulated and thermally isolated from the pantry compartment.

3. The bottom mount refrigerator of claim 2 wherein the pantry compartment has an upper portion and the ice compartment is in the upper portion, further comprising an ice chute in communication between the icemaker and the ice dispenser when the door on the fresh food compartment is closed.

4. The bottom mount refrigerator of claim 1 wherein the pantry drawer is maintained at a temperature different than the freezer compartment.

5. The bottom mount refrigerator of claim 1, wherein the pantry compartment is substantially the same height as the fresh food compartment.

6. The bottom mount refrigerator of claim 1, wherein ice can be dispensed from the ice dispenser when the pantry drawer is in an open position.

7. The bottom mount refrigerator of claim 1 wherein the pantry drawer is slideable between an extended open position and a retracted closed position.

8. The bottom mount refrigerator of claim 1 further comprising a control circuit in the cabinet operatively connected to the temperature control sub-system.

9. The bottom mount refrigerator of claim 8 further comprising a temperature control subsystem for the fresh food, freezer, and ice compartments.

10. A refrigerator comprising:

an insulated cabinet;

a fresh food compartment within the insulated cabinet, the fresh food compartment configured to be held above 32 degrees Fahrenheit;

a fresh food door mounted on the insulated cabinet and having a closed position and an open position, the fresh food door sealing the fresh food compartment in the closed position and permitting access to the fresh food compartment in the open position;

a freezer compartment within the insulated cabinet and thermally separated from the fresh food compartment, the freezer compartment configured to be held below 32 degrees Fahrenheit;

a freezer compartment cover mounted on the insulated cabinet and having a closed position and an open position, the freezer compartment cover sealing the freezer compartment in the closed position and permitting access to the freezer compartment in the open position;

a pantry compartment within the insulated cabinet beside the fresh food compartment and above the freezer compartment, thermally separated from the fresh food compartment and the freezer compartment, and having an ice dispenser, the pantry compartment being accessible without opening the fresh food door or the freezer compartment cover; and an ice compartment disposed within the pantry compartment and accessible by opening a pantry door, the ice compartment having an icemaker.

11. The refrigerator of claim 10, further comprising a divider for thermally separating the fresh food compartment from the pantry compartment, the divider comprising a mullion at the front of the insulated cabinet.

12. The refrigerator of claim 11 further comprising a light source within the mullion for providing illumination of the pantry door when the pantry drawer is in an open position.

13. The refrigerator of claim 10 further comprising a mechanism for adjusting an opening for varying an amount of cold air permitted to flow into the pantry compartment to selectively adjust a pantry compartment temperature.

14. The refrigerator of claim 13, further comprising a temperature sensor for sensing pantry compartment temperature, the temperature sensor being electrically connected to an electronic control system, the electronic control system being electrically connected to the mechanism for adjusting the opening to control the pantry temperature within a desired range.

15. The refrigerator of claim 10 further comprising an ice chute in communication between the icemaker and the ice dispenser when the fresh food door is closed.

16. The refrigerator of claim 15 further comprising an ice bin in one or both of the ice compartment and the fresh food compartment door.

17. The refrigerator of claim 10, wherein the pantry door is a drawer and the pantry compartment is substantially the same height as the fresh food compartment.

18. A bottom mount refrigerator comprising:

a freezer compartment;

a fresh food compartment located above the freezer compartment, and having a fresh food door for providing selective access to an interior portion of the fresh food compartment;

a pantry compartment insulated from, located beside, and substantially the same height as the fresh food compartment, the pantry compartment having an ice compartment that is thermally insulated from the pantry compartment;

an icemaker in the ice compartment;

a pantry drawer configured to provide selective access to the pantry compartment and comprising an ice dispenser for dispensing ice through a front face of the drawer;

a compressor;

an airflow sub-system, including a fan, in communication with one or more of the freezer, fresh food, and ice compartments;

an electrically-controlled damper; and a controller operatively connected to the ice dispenser, icemaker, compressor, fan, and damper.

19. The refrigerator of claim 18 further comprising an ice chute in communication between the icemaker and the ice dispenser when the fresh food door is closed.

20. The refrigerator of claim 19 further comprising an ice bin in one or both of the ice compartment and the fresh food compartment door.

* * * * *